US010231596B2

(12) United States Patent
Jung et al.

(10) Patent No.: US 10,231,596 B2
(45) Date of Patent: Mar. 19, 2019

(54) FIXED NOZZLE ASSEMBLY AND DISH WASHING MACHINE HAVING THE SAME

(71) Applicant: Samsung Electronics Co., Ltd., Suwon-si, Gyeonggi-do (KR)

(72) Inventors: Hyun Dong Jung, Suwon-si (KR); Chang Wook Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/984,848

(22) Filed: May 21, 2018

(65) Prior Publication Data

US 2018/0263460 A1 Sep. 20, 2018

Related U.S. Application Data

(63) Continuation of application No. 14/584,340, filed on Dec. 29, 2014, now Pat. No. 9,993,133.

(30) Foreign Application Priority Data

Dec. 31, 2013 (KR) ..... 10-2013-0169542

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01); *A47L 15/4278* (2013.01)

(58) Field of Classification Search
CPC ..... A47L 15/4282
See application file for complete search history.

(56) References Cited

U.S. PATENT DOCUMENTS 2,712,826 A 7/1955 Schleyer et al.
2,873,141 A 2/1959 Myllenberg et al.
3,921,651 A 11/1975 Weihe, Jr.
(Continued)

FOREIGN PATENT DOCUMENTS

CN 101426410 A 5/2009
CN 101947092 A 1/2011
CN 101947092 B 5/2012
(Continued)

OTHER PUBLICATIONS

Extended European Search Report dated May 6, 2015 in related European Patent Application No. 14199877.3 (5 pages).
(Continued)

*Primary Examiner* — Jason Y Ko
(74) *Attorney, Agent, or Firm* — Staas & Halsey LLP

(57) ABSTRACT

There is provided a dish washing machine, including a main body; a washing tank provided inside the main body; and a fixed nozzle assembly fixed in one side of the washing tank and configured to jet washing water, wherein the fixed nozzle assembly includes, a nozzle body having a jet nozzle configured to jet washing water; and a nozzle front cover combined with a front surface of the nozzle body, and wherein the nozzle front cover and/or the nozzle body include corresponding ribs to cover a combining portion between the nozzle front cover and the nozzle body to minimize a foreign substance from being introduced into the combining portion of the nozzle front cover and the nozzle body. According to such a configuration, it is possible to minimize contaminants from accumulating in the fixed nozzle assembly.

9 Claims, 80 Drawing Sheets

(56) References Cited

U.S. PATENT DOCUMENTS

| | | | |
|---|---|---|---|
| 7,523,758 | B2 | 4/2009 | Vanderroest |
| 2009/0101182 | A1 | 4/2009 | Buesing et al. |

FOREIGN PATENT DOCUMENTS

| | | | |
|---|---|---|---|
| CN | 103462574 | A | 12/2013 |
| WO | WO 83/01186 | | 4/1983 |

OTHER PUBLICATIONS

US Notice of Allowance dated Feb. 9, 2018 in U.S. Appl. No. 14/584,340.
US Notice of Allowance dated Jan. 16, 2018 in U.S. Appl. No. 14/584,340.
US Office Action dated Aug. 29, 2017 in U.S. Appl. No. 14/584,340.
US Office Action dated Mar. 28, 2017 in U.S. Appl. No. 14/584,340.
U.S. Appl. No. 14/584,340, filed Dec. 29, 2014, Hyun Dong Jung, et al., Samsung Electronics Co., Ltd.
Chinese Office Action dated May 4, 2018 in corresponding Chinese Patent Application No. 2014108585028, 22 pgs.

FIXED NOZZLE ASSEMBLY AND DISH WASHING MACHINE HAVING THE SAME

CROSS-REFERENCE TO RELATED APPLICATIONS

This application is a continuation of U.S. patent application Ser. No. 14/584,340, filed on Dec. 29, 2014, which claims the benefit of Korean Patent Application No. 10-2013-0169542, filed on Dec. 31, 2013 in the Korean Intellectual Property Office, the disclosures of which are incorporated herein by reference.

BACKGROUND

1. Field

Embodiments of the present invention relate to a dish washing machine including a jet nozzle fixed in one side of a washing tank and a vane that is movably provided inside the washing tank and reflects washing water jetted from the jet nozzle toward a dish.

2. Description of the Related Art

A dish washing machine is a home appliance that includes a main body having a washing tank therein, a basket configured to accommodate a dish, a sump configured to store washing water, a jet nozzle configured to jet washing water, and a pump configured to supply washing water in the sump to the jet nozzle, and washes the dish by jetting washing water at a high pressure to the dish.

In general, dish washing machines use a rotor type jet structure that has a rotating jet nozzle. The rotating nozzle rotates by a hydraulic pressure and jets washing water. Since such a rotating nozzle jets washing water to only a range within a rotation radius, there may be an area in which washing water is not jetted. Therefore, in order to prevent the area in which washing water is not jetted, called a linear type jet structure has been proposed.

The linear type jet structure includes a fixed nozzle fixed in one side of a washing tank and a vane that moves in the washing tank and reflects washing water jetted from the fixed jet nozzle toward a dish, and may jet washing water to an entire area of the washing tank according to movement of a reflection plate.

The fixed nozzle includes a plurality of jet holes that are arranged in a horizontal direction of the washing tank and is fixed in a back wall side of the washing tank. The vane extends in the horizontal direction of the washing tank to reflect washing water jetted from the plurality of jet holes and may be provided to linearly reciprocate in a forward and backward direction of the washing tank.

The linear type jet structure may further include a driving device capable of driving the vane. The driving device may be implemented by various methods. As an example, the driving device includes a motor, a belt connected to the motor and configured to deliver a driving force to the vane, and a rail configured to guide movement of the vane, and when the motor is driven, the belt rotates and the vane moves on the rail.

In a distribution device that distributes washing water accumulated in the sump to jet nozzles, a distribution device of a different structure may be preferred in the linear type jet structure, compared to the rotor type jet structure.

When a jet nozzle disposed below the washing tank is the rotating nozzle, it is preferable that an outlet of the distribution device be provided to face an upper side since a length of a flow path connecting the outlet of the distribution device and the rotating nozzle may be reduced and a pressure loss of washing water may be minimized.

However, when a jet nozzle disposed below the washing tank is the fixed nozzle, since the fixed nozzle is disposed adjacent to the back wall of the washing tank, the outlet of the distribution device need not be provided to face the upper side. When the outlet is provided to face the upper side, since the flow path connecting the outlet of the distribution device and the fixed nozzle should be bent toward the back side at a start point of the outlet of the distribution device, a pressure loss of washing water may increase.

Meanwhile, since jet nozzles are fixed in the linear type jet structure, by distributing washing water to only some jet nozzles among all jet nozzles, distributive washing in which washing water is jetted to only some area of the washing tank may be possible.

SUMMARY

An aspect of the present invention provides a dish washing machine that minimizes introduction of a foreign substance into a fixed nozzle assembly in a dish washing machine having a linear type jet structure.

According to an aspect of the present invention, there is provided a dish washing machine, including a main body; a washing tank provided inside the main body; and a fixed nozzle assembly fixed in one side of the washing tank and configured to jet washing water, wherein the fixed nozzle assembly includes, a nozzle body having a jet nozzle configured to jet washing water; and a nozzle front cover combined with a front surface of the nozzle body, and wherein the nozzle front cover includes a guide rib provided to cover a combining portion to prevent a foreign substance from being introduced into the combining portion of the nozzle front cover and the nozzle body.

The guide rib may be formed to extend backward at a rear surface of the nozzle front cover.

The guide rib may be separated a predetermined interval from the nozzle body and cover at least a part of one side surface of the nozzle body.

The guide rib may include a rib bottom surface that is provided downward and formed to be inclined upward in a direction in which the guide rib extends.

The nozzle body may include a nozzle support rib that supports an outer circumferential surface of the jet nozzle and is disposed to have a predetermined interval from the guide rib, and the guide rib may be disposed to overlap at least a part of the nozzle support rib in a vertical direction.

The guide rib may be separated a predetermined interval from the nozzle support rib and disposed below the nozzle support rib.

The predetermined interval may be 3 mm or more.

The nozzle support rib and the guide rib may be formed to extend in crossing directions.

The guide rib may include a rib top surface that is provided to face a lower part of the nozzle body and is formed to be inclined downward in a direction in which the guide rib extends.

The nozzle body may include a nozzle side cover that is formed to surround at least a part of the jet nozzle and provided to be combined with the nozzle front cover.

The nozzle side cover may include a concave combining portion of which at least a part is formed along an end portion of the nozzle front cover and that is formed to be bent and stepped inward in an outer circumferential surface of an adjacent nozzle side cover.

The nozzle front cover may include a convex combining portion that is formed to be bent and stepped outward from an inner circumferential surface of the nozzle side cover to correspond to the concave combining portion such that the nozzle front cover is combined with the nozzle side cover.

The dish washing machine may further include an inlet flow path formed by the concave combining portion and the convex combining portion such that washing water is introduced by a combination of the nozzle front cover and the nozzle body, and the guide rib may include a rib top surface that is provided to face a lower part of the nozzle body and is formed to be inclined downward in a direction in which the guide rib extends, and the nozzle body may be configured such that washing water introduced into the inlet flow path is discharged to the outside of the nozzle body along an inside surface of the nozzle front cover and the rib top surface.

The fixed nozzle assembly may be disposed in a bottom surface of the washing tank.

The nozzle body may include a nozzle back surface cover that is combined with a back surface of the nozzle body, and the nozzle back cover may include: a back surface cover combining portion that is provided to abut an end portion of the nozzle body and is formed such that the nozzle back cover is combined with the nozzle body; and a back flow path surface that forms one side of a nozzle flow path configured to supply washing water to the jet nozzle, is inserted into the nozzle body, and is disposed inside the nozzle body relative to the back surface cover combining portion.

The fixed nozzle assembly may include: a nozzle inlet in which washing water is introduced into the nozzle body; and the back flow path surface may be formed to be inclined such that the nozzle flow path becomes narrower away from the nozzle inlet.

The dish washing machine may include a bottom plate cover that is provided in a bottom of the washing tank such that the fixed nozzle assembly is fixed in the washing tank, wherein a top surface of the bottom plate cover may be formed to be inclined toward a center of the washing tank with respect to a reference horizontal plane.

According to another aspect of the present invention, there is provided a dish washing machine, including a main body; a washing tank provided inside the main body; and a fixed nozzle assembly configured to jet washing water toward the washing tank, wherein the fixed nozzle assembly includes: a nozzle body having a plurality of jet nozzles configured to jet washing water and a nozzle side cover that is formed to cover at least a part of the jet nozzle and forms an internal space with the jet nozzle; a nozzle front cover combined with a front surface of the nozzle body; and a rib provided to prevent a foreign substance from being introduced into the internal space from the outside, wherein the rib includes: a nozzle support rib that is formed between the plurality of jet nozzles and blocks a lower part of the nozzle body; and a guide rib that is formed in a back surface of the nozzle front cover and extends from the nozzle front cover.

The nozzle support rib and the guide rib may be formed to extend in crossing directions.

The guide rib may be separated a predetermined interval from the nozzle support rib and disposed below the nozzle support rib.

The guide rib may be disposed to overlap at least a part of the nozzle support rib in a vertical direction.

The guide rib may include a guide rib top surface facing the nozzle support rib and a guide rib bottom surface provided in the other side surface of the guide rib top surface, and wherein the guide rib top surface and the guide rib bottom surface may be formed to be inclined downward and upward in a lengthwise direction of the guide rib, respectively.

The nozzle body may include a nozzle side cover that is formed to cover at least a part of the jet nozzle and provided to be combined with the nozzle front cover, wherein the nozzle side cover may include a concave combining portion of which at least a part is formed along an end portion of the nozzle side cover and that is formed to be bent and stepped inward in an outer circumferential surface of an adjacent nozzle side cover, and wherein the nozzle front cover may include a convex combining portion that is formed to be bent and stepped outward from an inner circumferential surface of the nozzle side cover to correspond to the concave combining portion such that the nozzle front cover is combined with the nozzle side cover.

The dish washing machine may include an inlet flow path formed by the concave combining portion and the convex combining portion such that washing water is introduced by a combination of the nozzle front cover and the nozzle body, wherein the nozzle body may be configured such that washing water introduced into the inlet flow path is discharged to the outside of the nozzle body along an inside surface of the nozzle front cover and a top surface of the guide rib.

According to still another aspect of the present invention, there is provided a fixed nozzle assembly of a dish washing machine that washes a target to be washed, the fixed nozzle assembly including: a nozzle body having a jet nozzle configured to jet washing water, a nozzle side cover that is formed to cover at least a part of the jet nozzle, and a flow path in which washing water flows therein; and a nozzle front cover that is combined with the nozzle side cover at a front surface of the nozzle body and forms an inlet flow path at a portion combined with the nozzle body such that washing water is introduced from the outside, wherein the nozzle front cover includes a guide rib that is formed to extend backward at a back surface of the nozzle front cover and guides washing water such that washing water introduced from the inlet flow path washes a foreign substance inside the nozzle body and is discharged to the outside.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Hereinafter, exemplary embodiments of the present invention will be described in detail.

Figure 1:
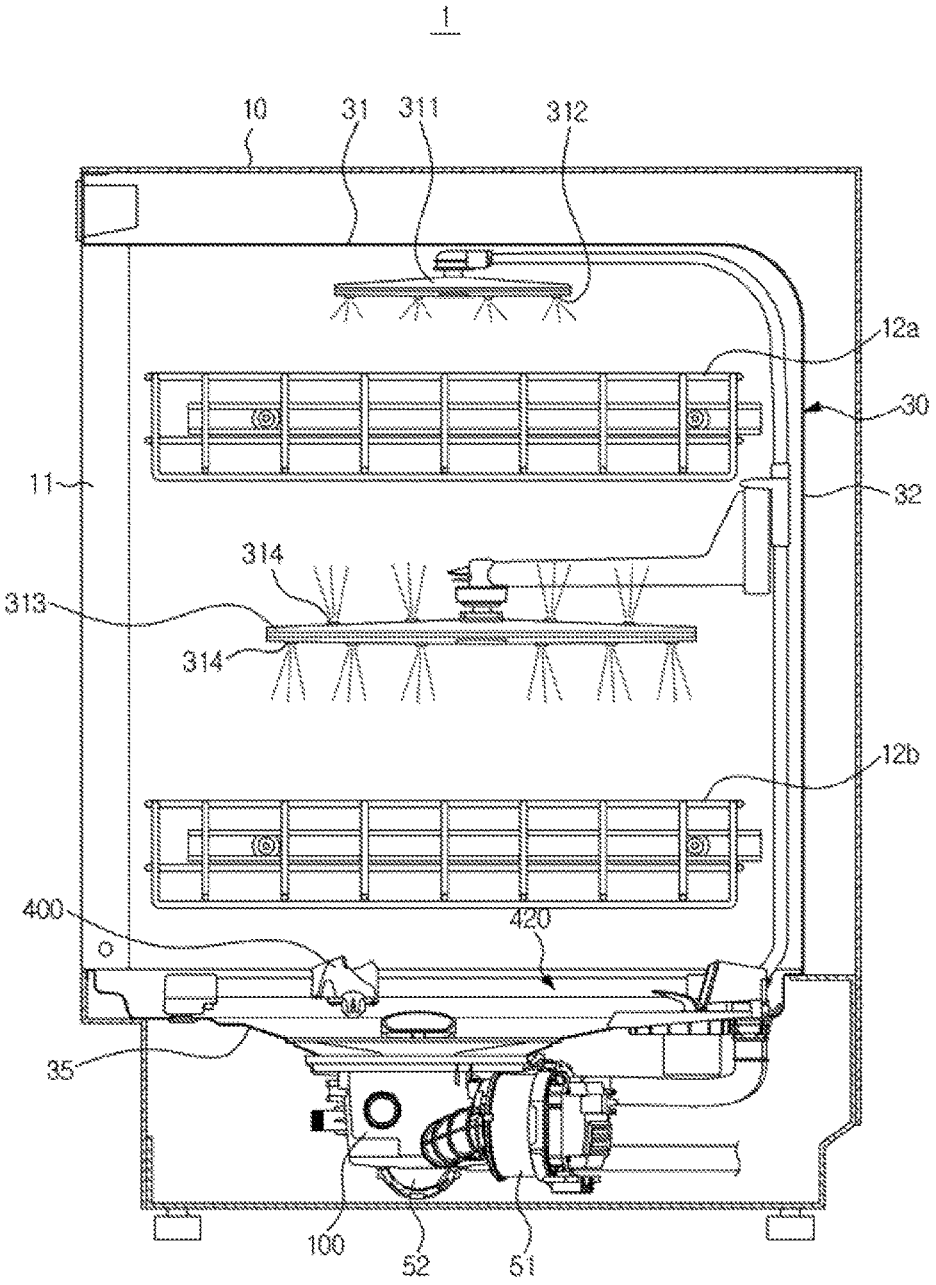
FIG. 1 is a cross sectional view schematically illustrating a dish washing machine according to an embodiment of the present invention.
Figure 2:
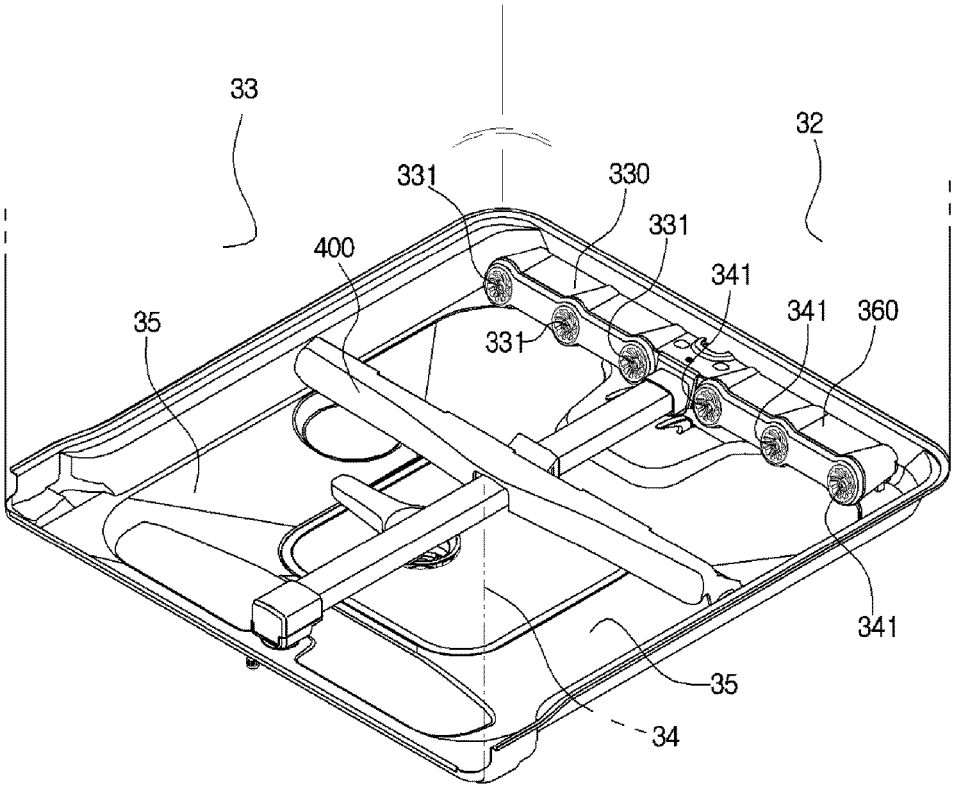
FIG. 2 is a diagram illustrating a lower part of the dish washing machine in FIG. 1.

FIG. 1 is a cross sectional view schematically illustrating a dish washing machine according to an embodiment of the present invention. FIG. 2 is a diagram illustrating a lower part of the dish washing machine in FIG. 1.

An entire structure of the dish washing machine according to the embodiment of the present invention will be generally described with reference to FIGS. 1 to 2.

A dish washing machine 1 includes a main body 10 forming an appearance, a washing tank 30 provided inside the main body 10, baskets 12*a* and 12*b* provided inside the washing tank 30 and configured to accommodate a dish, jet nozzles 311, 313, and 320 configured to jet washing water, a sump 100 configured to store washing water, a circulation pump 51 configured to pump washing water of the sump 100 and supply the water to the jet nozzles 311, 313, and 320, a drainage pump 52 configured to discharge washing water of the sump 100 along with contaminants to the outside of the main body 10, a vane 400 configured to move inside the washing tank 30 and reflect washing water toward a dish, and a driving device 420 configured to drive the vane 400.

The washing tank 30 may have an approximately box shape whose front is opened to receive and remove a dish. A front opening of the washing tank 30 may be opened or closed by a door 11. The washing tank 30 may include an upper wall 31, a back wall 32, a left side wall 33, a right side wall 34, and a bottom plate 35.

The baskets 12*a* and 12*b* may be wire racks made of a wire such that washing water passes through without accumulation. The baskets 12*a* and 12*b* may be detachably provided inside the washing tank. The baskets 12*a* and 12*b* may include the upper basket 12*a* disposed at an upper portion of the washing tank 30 and the lower basket 12*b* disposed at a lower portion of the washing tank 30.

The jet nozzles 311, 313, and 320 may jet washing water at a high pressure and wash a dish. The jet nozzles 311, 313, and 320 may include the upper rotation nozzle 311 provided at an upper portion of the washing tank 30, the intermediate rotation nozzle 313 provided at a center portion of the washing tank 30, and the fixed nozzle assembly 320 provided at a lower portion of the washing tank 30.

The upper rotation nozzle 311 is provided above the upper basket 12*a* and may jet washing water downward while rotating due to a hydraulic pressure. For this purpose, jet holes 312 may be provided below the upper rotation nozzle 311. The upper rotation nozzle 311 may directly jet washing water toward a dish accommodated in the upper basket 12*a*.

The intermediate rotation nozzle 313 is provided between the upper basket 12*a* and the lower basket 12*b* and may jet washing water upward and downward while rotating due to a hydraulic pressure. For this purpose, jet holes 314 may be provided above and below the intermediate rotation nozzle 313. The intermediate rotation nozzle 313 may directly jet washing water toward dishes accommodated in the upper basket 12*a* and the lower basket 12*b*.

Unlike the rotation nozzles 311 and 313, the fixed nozzle assembly 320 is immovably provided and fixed in one side of the washing tank 30. The fixed nozzle assembly 320 is disposed approximately adjacent to the back wall 32 of the washing tank 30 and may jet washing water toward the front of the washing tank 30. Therefore, washing water jetted from the fixed nozzle assembly 320 may not be directed directly toward a dish.

Washing water jetted from the fixed nozzle assembly 320 may be reflected toward a dish by the vane 400. The fixed nozzle assembly 320 may be disposed below the lower basket 12*b* and the vane 400 may reflect washing water jetted from the fixed nozzle assembly 320 upward. That is, washing water jetted from the fixed nozzle assembly 320 may be reflected toward a dish accommodated in the lower basket 12*b* by the vane 400.

The fixed nozzle assembly 320 may include a plurality of jet holes 331 and 341 arranged in a horizontal direction of the washing tank 30. The plurality of jet holes 331 and 341 may jet washing water forward.

The vane 400 may extend in a horizontal direction of the washing tank 30 such that all washing water jetted from the plurality of jet holes 331 and 341 of the fixed nozzle assembly 320 may be reflected. That is, one end portion of the vane 400 in a lengthwise direction may be provided to be adjacent to the left side wall 33 of the washing tank 30 and the other end portion of the vane 400 in the lengthwise direction may be provided to be adjacent to the right side wall 34 of the washing tank 30.

The vane 400 may linearly reciprocate in a jet direction of washing water jetted from the fixed nozzle assembly 320. That is, the vane 400 may linearly reciprocate in a forward and backward direction of the washing tank 30.

Therefore, a linear jet structure including the fixed nozzle assembly 320 and the vane 400 may wash an entire area of the washing tank 30 without a blind area. It is different from the rotation nozzles that can jet washing water within a range of a rotation radius.

The fixed nozzle assembly 320 may include a left fixed nozzle 330 disposed on the left of the washing tank 30 and a right fixed nozzle 360 disposed on the right of the washing tank 30.

As will be described below, the rotation nozzles 311 and 313 and the fixed nozzle assembly 320 may independently jet washing water. Further, the left fixed nozzle 330 and the right fixed nozzle 360 may also independently jet washing water.

Washing water jetted from the left fixed nozzle 330 may be reflected to only a left area of the washing tank 30 by the vane 400, and washing water jetted from the right fixed nozzle 360 may be reflected to only a right area of the washing tank 30 by the vane 400.

Therefore, the dish washing machine may independently wash the left side and the right side of the washing tank 30 in a divided manner. Needless to say, unlike this embodiment in which the washing tank is divided into the left side and the right side, the washing tank may be subdivided further as necessary.

A main configuration of the dish washing machine according to the embodiment of the present invention will be described in order below.

Figure 3:
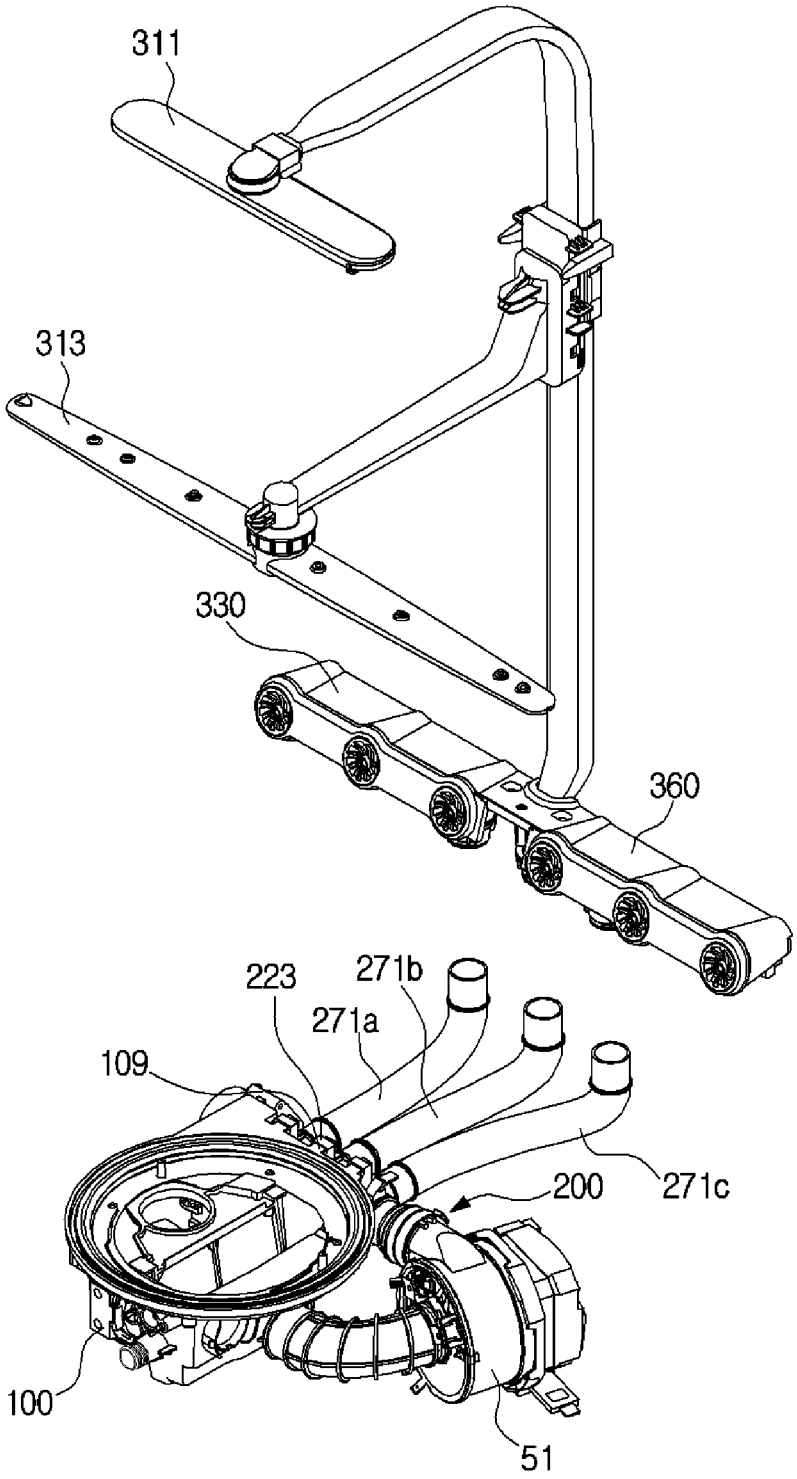
FIG. 3 is a diagram illustrating a flow path structure of the dish washing machine in FIG. 1.
Figure 4A:
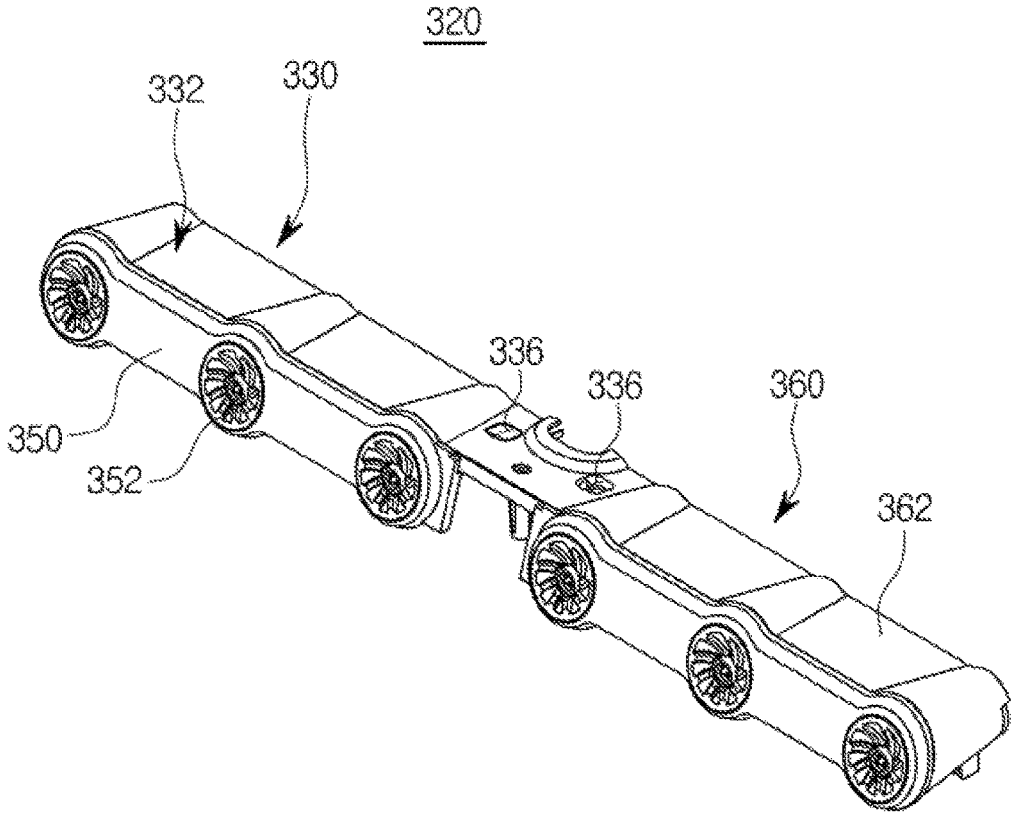
FIG. 4A is a perspective view of the fixed nozzle assembly of the dish washing machine in FIG. 1.
Figure 4B:
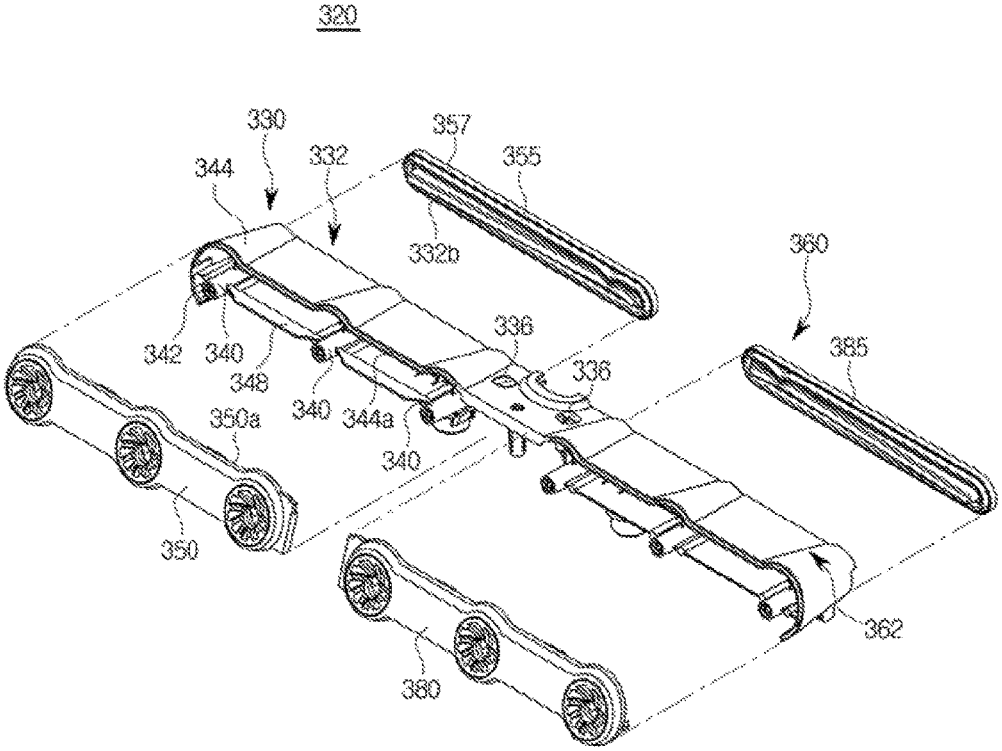
FIGS. 4B and 4C are exploded diagrams illustrating the fixed nozzle assembly of the dish washing machine in FIG. 1.
Figure 4C:
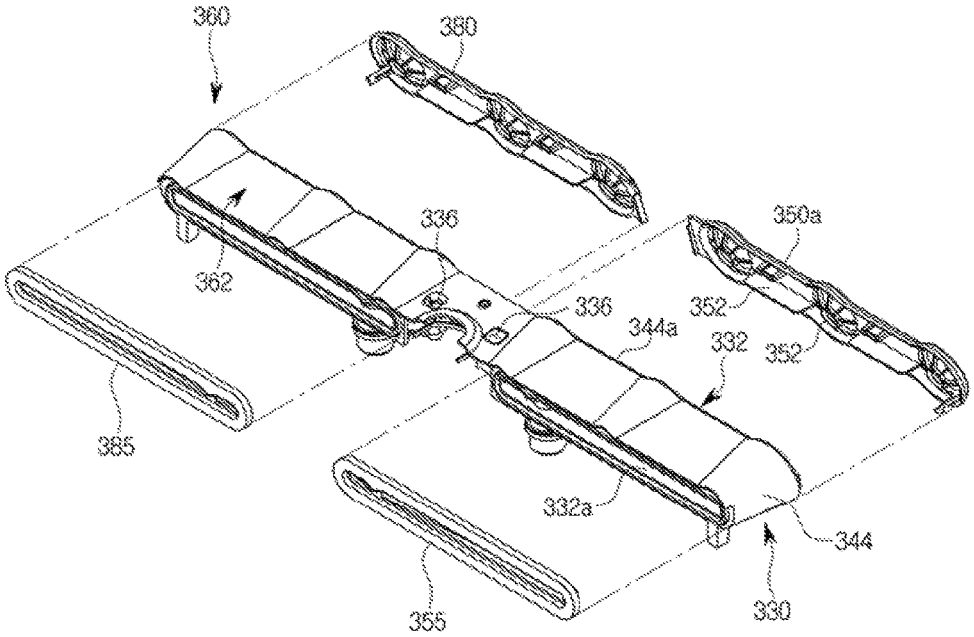
Figure 5A:
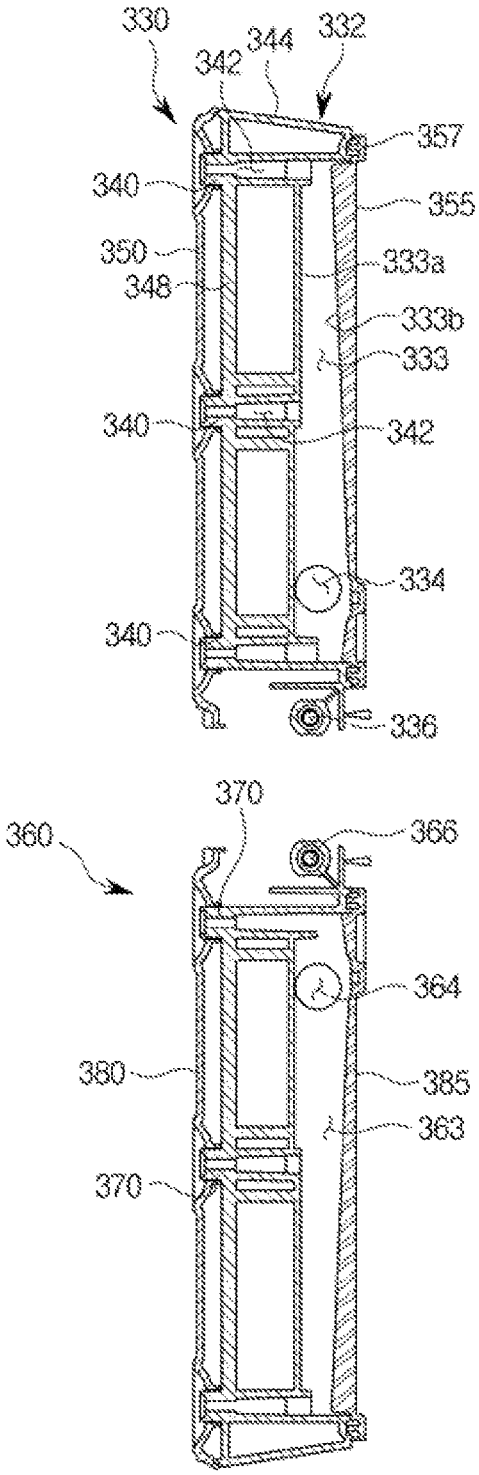
FIGS. 5A and 5B are cross sectional views of the fixed nozzle assembly of the dish washing machine in FIG. 1.
Figure 5B:
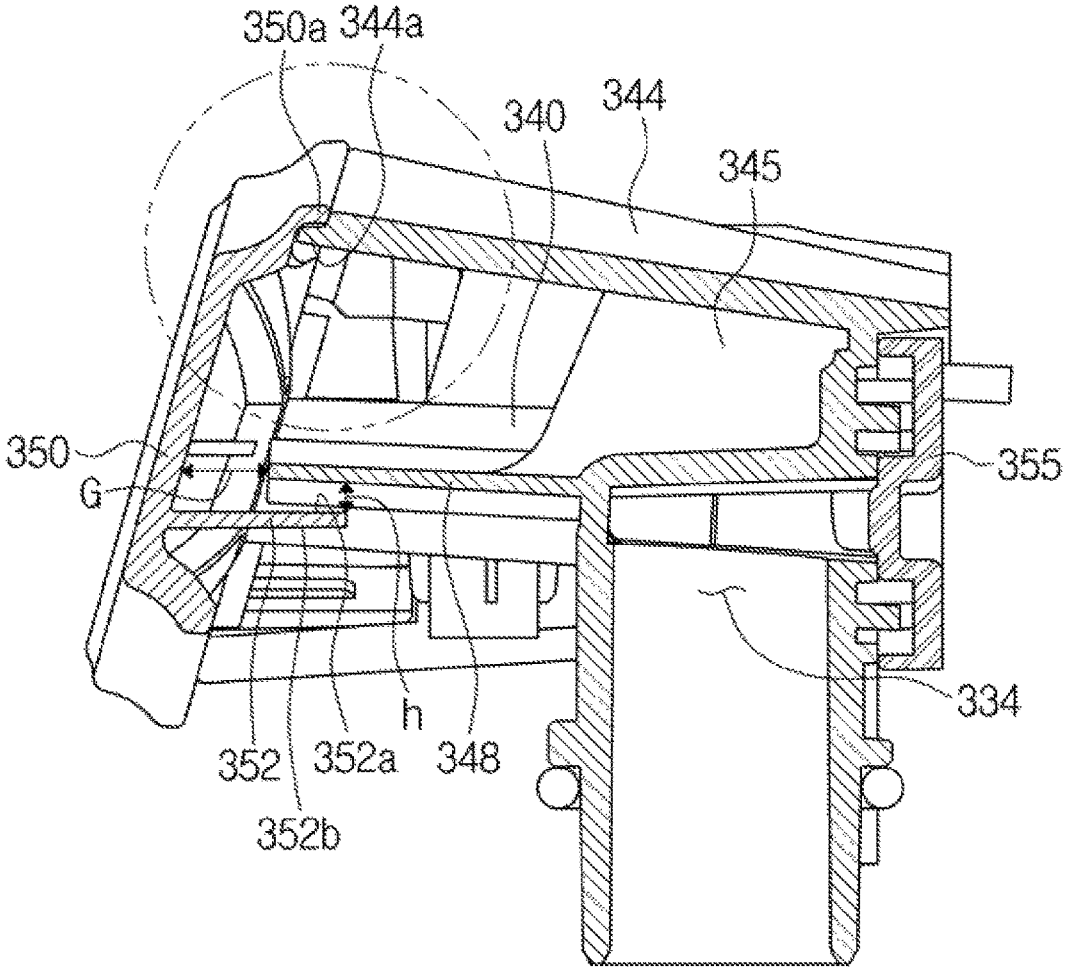
Figure 5C:
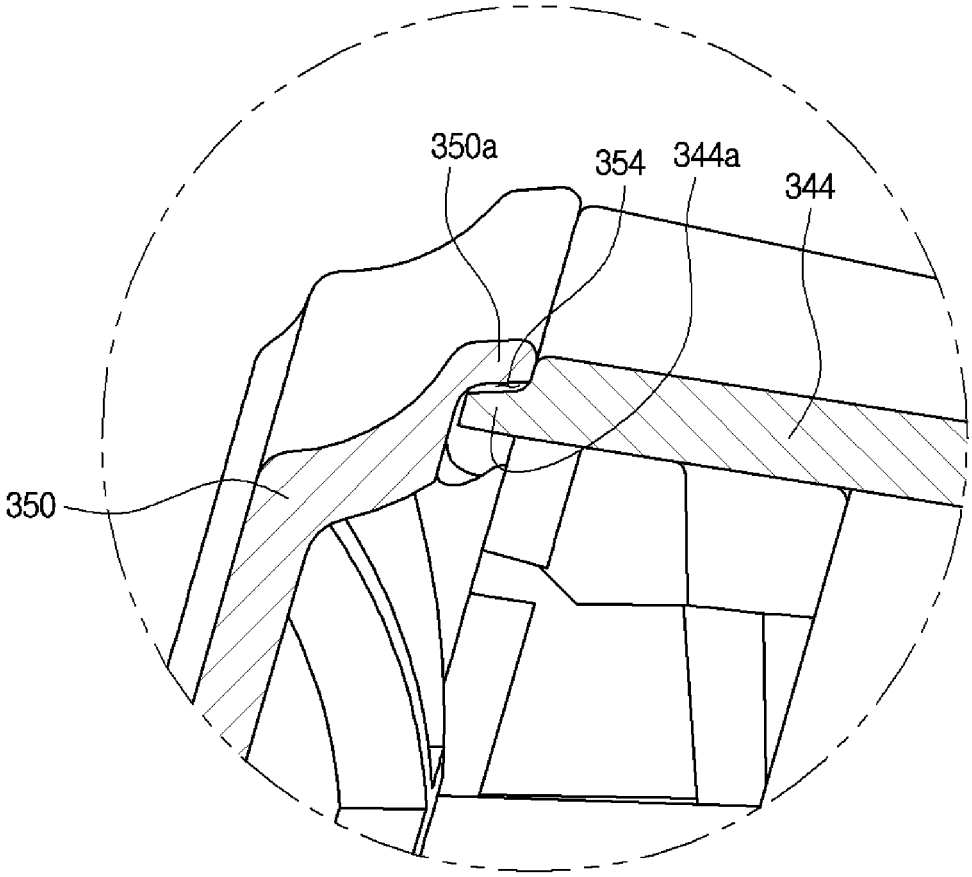
FIG. 5C is an enlarged view of a part of FIG. 5B.

FIG. 3 is a diagram illustrating a flow path structure of the dish washing machine in FIG. 1. FIG. 4A is perspective view of the fixed nozzle assembly of the dish washing machine in FIG. 1. FIGS. 4B and 4C are exploded diagrams illustrating the fixed nozzle assembly of the dish washing machine in FIG. 1. FIGS. 5A and 5B are cross sectional views of the fixed nozzle assembly of the dish washing machine in FIG. 1. FIG. 5C is an enlarged view of a part of FIG. 5B.

A process, the flow path structure, a structure of the fixed nozzle assembly, and a washing water distribution structure of the dish washing machine according to the embodiment of the present invention will be described with reference to FIGS. 3 to 5.

The dish washing machine may include a water supplying process, a washing process, a draining process, and a drying process.

In the water supplying process, washing water may be supplied into the washing tank 30 through a water supply pipe (not illustrated). Washing water supplied into the washing tank 30 may flow into the sump 100 provided below the washing tank 30 due to an inclination of the bottom plate 35 of the washing tank 30 and may be stored in the sump 100.

In the washing process, the circulation pump 51 may be operated to pump washing water of the sump 100. Washing water pumped by the circulation pump 51 may be distributed to the rotation nozzles 311 and 313, the left fixed nozzle 330, and the right fixed nozzle 360 through a distribution device 200. Due to a pumping force of the circulation pump 51, washing water at a high pressure may be jetted from the jet nozzles 311, 313, and 320 and wash a dish.

Here, the upper rotation nozzle 311 and the intermediate rotation nozzle 313 may receive washing water from the distribution device 200 through a second hose 271*b*. The left fixed nozzle 330 may receive washing water from the distribution device 200 through a first hose 271*a*. The right fixed nozzle 360 may receive washing water from the distribution device 200 through a third hose 271*c*.

In this embodiment, the distribution device 200 includes four distribution modes in total.

In a first mode, the distribution device 200 may supply washing water to only the rotation nozzles 311 and 313 through a second hose 271*b*.

In a second mode, the distribution device 200 may supply washing water to only the right fixed nozzle 360 through the third hose 271*c*.

In a third mode, the distribution device 200 may supply washing water to only the left fixed nozzle 330 and the right fixed nozzle 360 through the first hose 271*a* and the third hose 271*c*.

In a fourth mode, the distribution device 200 may supply washing water to only the left fixed nozzle 330 through the first hose 271*a*.

However, needless to say, the distribution device 200 may include various distribution modes unlike this embodiment.

Washing water jetted from the jet nozzles 311, 313, and 320 may hit a dish, remove contaminants on the dish, fall along with contaminants, and be stored in the sump 100 again. The circulation pump 51 may pump again washing water stored in the sump 100 to circulate. During the washing process, the circulation pump 51 may be repeatedly operated and stopped several times. Contaminants fell into the sump 100 along with washing water during the process are collected by a filter mounted in the sump 100, do not circulate to the jet nozzles 311, 313, and 320, and remain in the sump 100.

In the draining process, the drainage pump 52 may be operated to drain washing water and contaminants remaining in the sump 100 together to the outside of the main body 10.

In the drying process, a heater (not illustrated) mounted in the washing tank 30 may be operated to dry a dish.

FIG. 4A is a perspective view of the fixed nozzle assembly of the dish washing machine in FIG. 1. FIGS. 4B and 4C are exploded diagrams illustrating the fixed nozzle assembly of the dish washing machine in FIG. 1.

The fixed nozzle assembly 320 will be described in detail.

The fixed nozzle assembly 320 may be disposed in the bottom plate 35 of the washing tank, and specifically, may be provided to be fixed in a bottom plate cover 600.

Since the left fixed nozzle assembly 330 and the right fixed nozzle 360 may be symmetrically provided with respect to a center, detailed description will be provided focusing on the left fixed nozzle assembly 330.

The left fixed nozzle assembly 330 may include a nozzle body 332, a nozzle front cover 350, and a nozzle back cover 355.

The nozzle body 332 is provided to form an appearance, includes the jet nozzle 340 configured to jet washing water, and includes a nozzle flow path 333 in which washing water flows therein. Specifically, the nozzle flow path 333 may be formed to be combined with the nozzle back cover 355 to be described below.

The jet nozzle 340 includes a jet flow path 342 through which washing water passes and jets washing water into the washing tank through the jet flow path 342. A plurality of jet nozzles 340 may be provided with a predetermined interval therebetween.

The fixed nozzle assembly 320 may include ribs 348 and 352 configured to prevent a foreign substance from being introduced into an internal space from the outside. The ribs 348 and 352 may include the nozzle support rib 348 and the guide rib 352 to be described below.

The nozzle support rib 348 configured to support the jet nozzle 340 may be provided between the plurality of jet nozzles 340. The nozzle support rib 348 is provided to support an outer circumferential surface of the jet nozzle 340 such that deformation of the jet nozzle 340 due to a pressure of washing water jetted through the jet nozzle 340 is prevented.

The nozzle body 332 may include a nozzle side cover 344.

The nozzle side cover 344 is formed to cover at least a part of the jet nozzle 340 and is provided to be combined with the nozzle front cover 350 to be described below. The nozzle side cover 344 may be injected and formed along with the nozzle body 332 and be integrally formed with the nozzle body 332. The nozzle side cover 344 may be provided to cover the upper side and the lateral side of the jet nozzle 340.

At least one separation rib 345 may be provided between the nozzle side cover 344 and the jet nozzle 340. The separation rib 345 separates the jet nozzle 340 and the nozzle side cover 344 and is provided such that the configurations may firmly support each other.

The nozzle front cover 350 may be combined with a front surface of the nozzle body 332. The nozzle front cover 350 includes a discharge hole 351 configured to communicate with the jet flow path 342 of the jet nozzle 340 and may be provided to cover an inside of the nozzle body 332 in the front surface of the nozzle body 332.

The nozzle front cover 350 is combined with the nozzle side cover 344, a combining method thereof, and a configuration thereof will be described in detail below.

The guide rib 352 may be provided in a back surface of the nozzle front cover 350. The guide rib 352 is provided to prevent a foreign substance from being introduced into the nozzle body 332 and guide the foreign substance introduced into the nozzle body 332 to be discharged to the outside along with washing water.

The nozzle back cover 355 is provided to be combined with a back side of the nozzle body 332. The nozzle back cover 355 may be combined with the nozzle body 332 to form the nozzle flow path 333.

FIG. 5A is a cross sectional view of the fixed nozzle assembly of the dish washing machine in FIG. 1.

The nozzle body 332 may include the nozzle flow path 333 configured to communicate with the jet flow path 342 of the jet nozzle 340 and supply washing water to the jet nozzle 340, a nozzle inlet 334 in which washing water is introduced into the nozzle flow path 333, and a combining hole 336 formed in the nozzle body 332 to combine the fixed nozzle assembly 320 with the bottom plate cover 600 to be described below therein.

The nozzle back cover 355 may be combined with the nozzle body 332 to form the nozzle flow path 333.

The nozzle body 332 includes a nozzle body flow path surface 333*a* and a back flow path surface 333*b* provided in one side surface of the nozzle back cover 355 therein. Through the combination of the nozzle body 332 and the nozzle back cover 355, the nozzle body flow path surface 333*a* and the back flow path surface 333*b* are combined to form the nozzle flow path 333.

That is, one side of the nozzle flow path 333 is formed by the nozzle body 332 and the other side thereof is formed by the nozzle back cover 355.

The back flow path surface 333*b* may be formed to be inclined toward an inside of the nozzle flow path 333 away from the nozzle inlet 334. That is, the back flow path surface 333*b* is inclined such that the nozzle flow path 333 becomes narrower away from the nozzle inlet 334. According to such a configuration, in the process of supplying washing water introduced from the nozzle inlet 334 to the plurality of jet nozzles 340 through the nozzle flow path 333, compensation can be performed when a pressure of washing water supplied to the jet nozzle 340 disposed farther from the nozzle inlet 334 becomes lower than a pressure of washing water supplied to the jet nozzle 340 disposed closer to the nozzle inlet 334.

The back flow path surface 333*b* may be formed to be convex relative to the adjacent nozzle back cover 355 and the other side surface thereof may be formed to be concave. That is, a portion in which the back flow path surface 333*b* is formed is formed in a depressed form in the nozzle back cover 355 and may be formed to be convex.

Specifically, the nozzle back cover 355 is combined with the nozzle side cover 344. The nozzle back cover 355 and the nozzle side cover 344 may be combined by several methods, but both configurations are combined by a heat fusion method in the embodiment of the present invention.

The nozzle back cover 355 may include a back surface cover combining portion 357 to be combined with the nozzle side cover 344. The back surface cover combining portion 357 is provided to abut an end portion of the nozzle body 332 and may be formed such that the nozzle back cover 355 is combined with the nozzle body 332.

The back flow path surface 333*b* is inserted into the nozzle body 332 and is provided to be disposed inside the nozzle body 332 relative to the back surface cover combining portion 357. That is, when the back flow path surface 333*b* forming the nozzle flow path 333 is provided inside the nozzle body 332 relative to the back surface cover combining portion 357, the nozzle flow path 333 may have less external influence. Also, when the back flow path surface 333*b* is formed inside the nozzle body 332 relative to the back surface cover combining portion 357, it is possible to easily change a design of the nozzle flow path 333 according to a supply amount of washing water to be applied, which results in convenient operations.

FIG. 5B is a cross sectional view of the fixed nozzle assembly of the dish washing machine in FIG. 1.

The guide rib 352 may be provided in the back surface of the nozzle front cover 350. The guide rib 352 is provided to prevent a foreign substance from being introduced into the nozzle body 332 and guide the foreign substance introduced into the nozzle body 332 to be discharged to the outside along with washing water.

The guide rib 352 may be formed to extend toward the back side in the rear surface of the nozzle front cover 350 and separated a predetermined interval from the nozzle body 332 to cover at least a part of one side surface of the nozzle body 332.

The guide rib 352 may be disposed to overlap at least a part of the nozzle support rib 348 in a vertical direction. That is, the guide rib 352 may be disposed below the nozzle support rib 348 and disposed to overlap the nozzle support rib 348 in a vertical direction.

The nozzle support rib 348 connect the plurality of jet nozzles 340 in the nozzle body 332, and an end portion of the front thereof may have a gap (G) of a predetermined interval with the nozzle front cover 350. The nozzle front cover 350 and the nozzle body 332 may be completely combined to prevent a foreign substance from being introduced into the nozzle body 332. However, a constant gap (G) is provided between the nozzle front cover 350 and the nozzle body 332, and when a foreign substance is introduced into the nozzle body 332, the foreign substance may be discharged to the outside of the nozzle body 332 through introduction of washing water, thereby preventing or minimizing introduction, lodging, or becoming stuck of a foreign substance, or contaminants, other than the washing water into/in the nozzle body 332.

For this purpose, the constant gap (G) is provided between the nozzle front cover 350 and the nozzle support rib 348. The guide rib 352 is provided to cover the constant gap (G) between the nozzle front cover 350 and the nozzle support rib 348 while being separated a predetermined interval and prevents water from being introduced through the gap (G) in a lower part of the nozzle body 332. For this purpose, the guide rib 352 and the nozzle support rib 348 are disposed to overlap in a vertical direction. That is, the guide rib 352 and the nozzle support rib 348 may be formed to extend from the nozzle front cover 350 and the nozzle body 332, respectively, in crossing directions.

The guide rib 352 and the nozzle support rib 348 may be separated a predetermined interval (h) to discharge washing water introduced into the nozzle front cover 350 and the nozzle body 332. A separation interval between the guide rib 352 and the nozzle support rib 348 may be 3 mm or more. However, the interval is not limited thereto but may include any interval at which washing water introduced into the fixed nozzle assembly 320 may be smoothly discharged.

The guide rib 352 may include a rib top surface 352*a* facing the nozzle body 332 and a rib bottom surface 352*b* provided to face downward in the other side surface of the rib top surface 352*a*.

The rib top surface 352*a* may be formed to be inclined downward in a direction in which the guide rib 352 extends. That is, the rib top surface 352*a* may be formed to be inclined downward away from the nozzle front cover 350. According to such a configuration, washing water or the foreign substance introduced into the nozzle body 332 may flow along the rib top surface 352*a* and be discharged to the outside of the fixed nozzle assembly 320.

The rib bottom surface 352*b* may be formed to be inclined upward in the direction in which the guide rib 352 extends. That is, the rib bottom surface 352*b* may be formed to be inclined upward away from the nozzle front cover 350. According to such a configuration, washing water or the foreign substance introduced from the lower part of the washing tank flows along the rib bottom surface 352*b* not to be introduced into the fixed nozzle assembly 320.

FIG. 5C is an enlarged view of a part of FIG. 5B.

The nozzle front cover 350 may be combined with the nozzle side cover 344 of the nozzle body 332. The nozzle front cover 350 and the nozzle side cover 344 could be combined to seal an inside of the nozzle body 332, but according to an aspect of an embodiment are combined such that washing water may be introduced and discharged to the outside of the nozzle body 332 along with the internal foreign substance.

The nozzle side cover 344 may include a concave combining portion 344*a*.

The concave combining portion 344*a* is partially formed along an end portion of the nozzle side cover 344 side and formed to be bent and stepped inward at an outer circumferential surface of the adjacent nozzle side cover 344.

The nozzle front cover 350 may include a convex combining portion 350*a*.

The convex combining portion 350*a* is formed to be bent and stepped outward at an inner circumferential surface of the nozzle side cover 344 to correspond to the concave combining portion 344*a* such that the nozzle front cover 350 is combined with the nozzle side cover 344.

The concave combining portion 344*a* and the convex combining portion 350*a* form an inlet flow path 354 such that a small amount of washing water may flow therebetween.

A small of washing water is introduced through the inlet flow path 354 and flows along an inside surface of the nozzle front cover 350 and the rib top surface 352*a* of the guide rib 352. According to such a flow, washing water introduced into the nozzle body 332 through the inlet flow path 354 is discharged to the outside of the nozzle body 332 along with the foreign substance introduced into the nozzle body 332.

While the left fixed nozzle assembly 330 has been described above, the right fixed nozzle 360 may also have the same configuration.

That is, the right fixed nozzle 360 may include the plurality of jet nozzles 340 configured to jet washing water, the nozzle flow path 333 configured to supply washing water to the jet nozzle 340, the nozzle inlet 334 in which washing water is introduced into the nozzle flow path 333, the nozzle body 332 forming an appearance and configured to form the nozzle flow path 333 therein, the nozzle back cover 355 combined with the back side of the nozzle body 332 to form the nozzle flow path 333 with the nozzle body 332, the nozzle front cover 350 combined with the front of the nozzle body 332, and the combining hole 336 formed in the nozzle body 332 to combine the right fixed nozzle 360 with a bottom plate cover.

Figure 6:
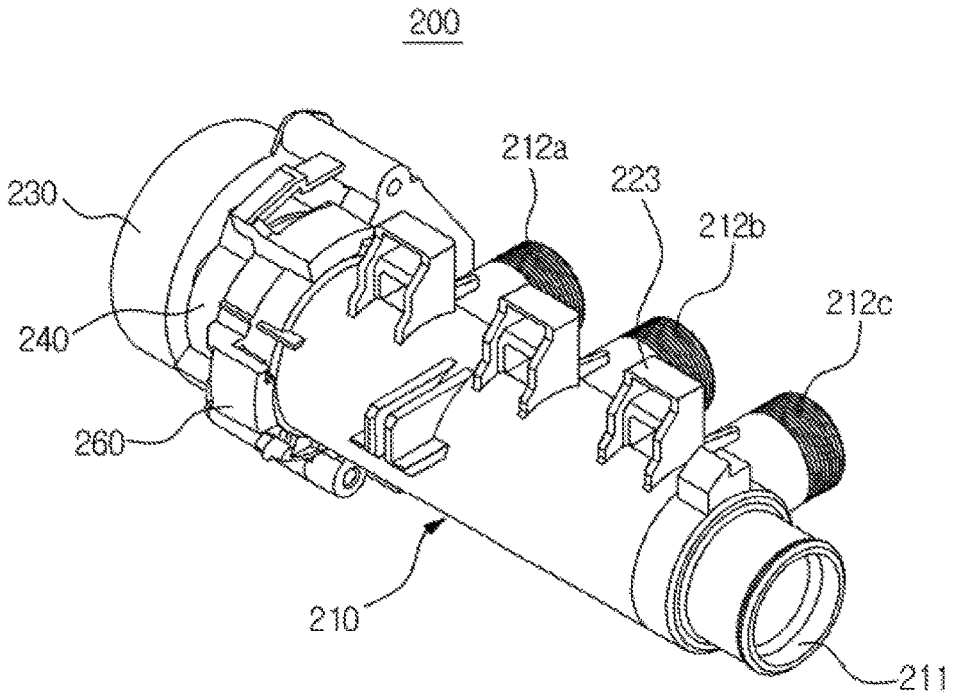
FIG. 6 is a diagram illustrating a distribution device of the dish washing machine in FIG. 1.
Figure 7:
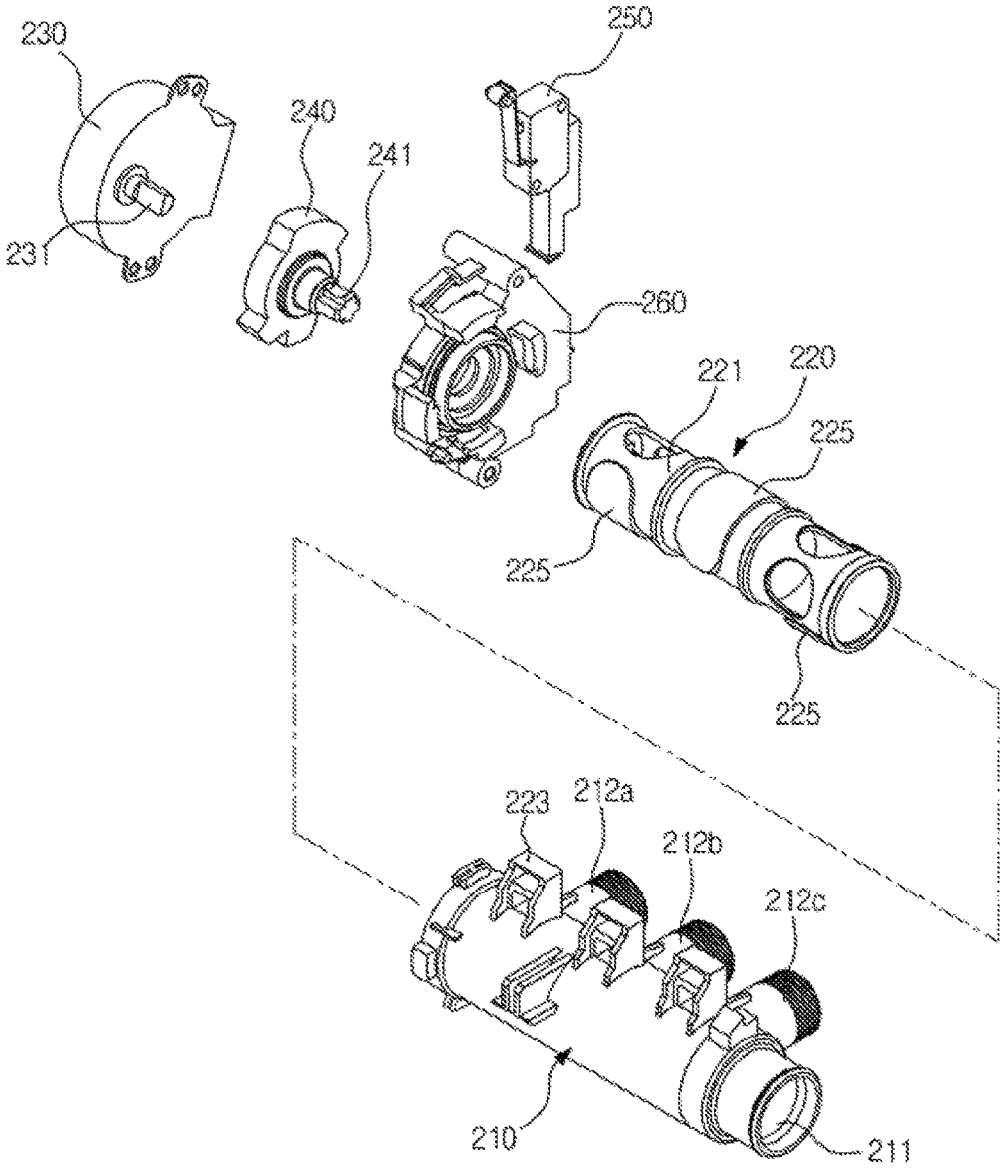
FIG. 7 is an exploded diagram illustrating a configuration of the distribution device of the dish washing machine in FIG. 1.
Figure 8:
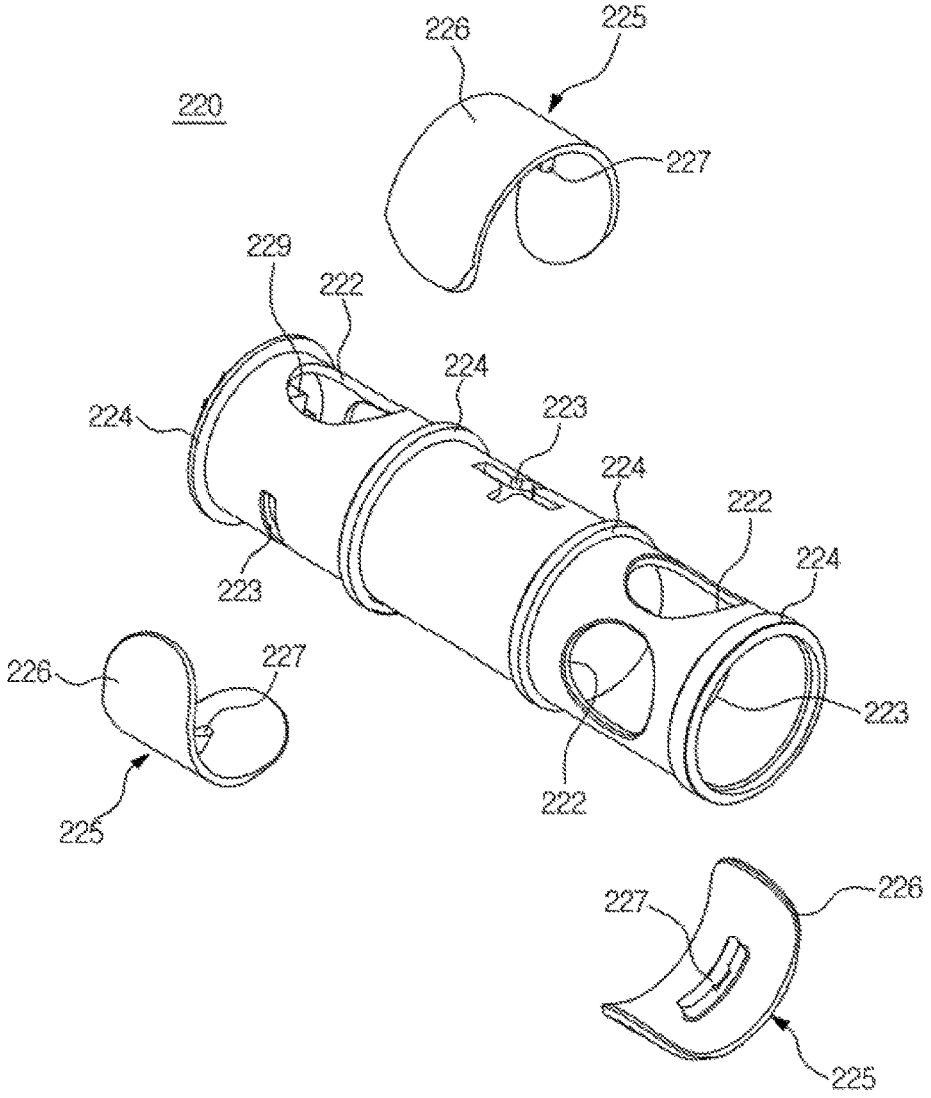
FIG. 8 is an exploded diagram illustrating a configuration of an opening and closing member of the distribution device of the dish washing machine in FIG. 1.
Figure 9:
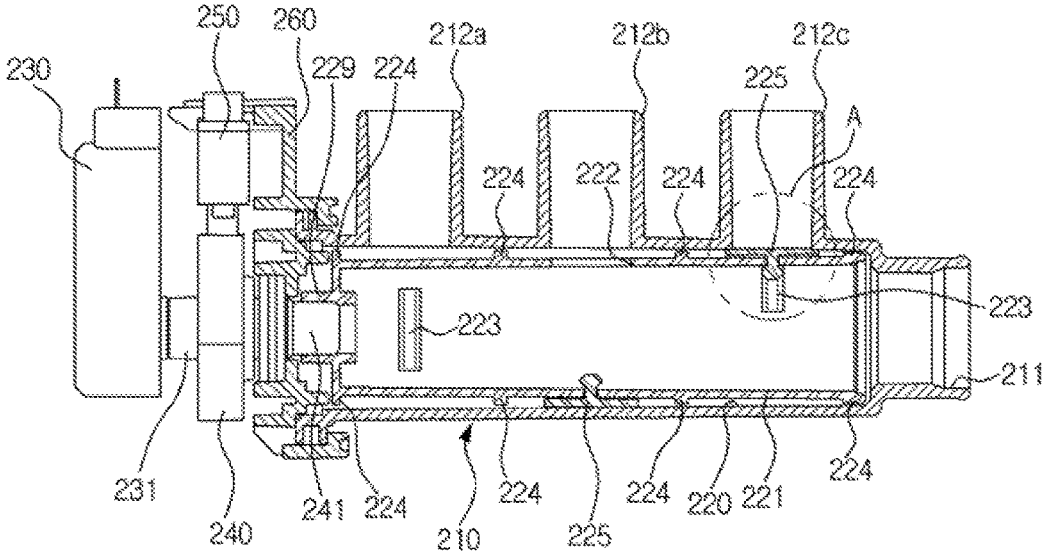
FIG. 9 is a cross sectional view of the distribution device of the dish washing machine in FIG. 1.
Figure 10:
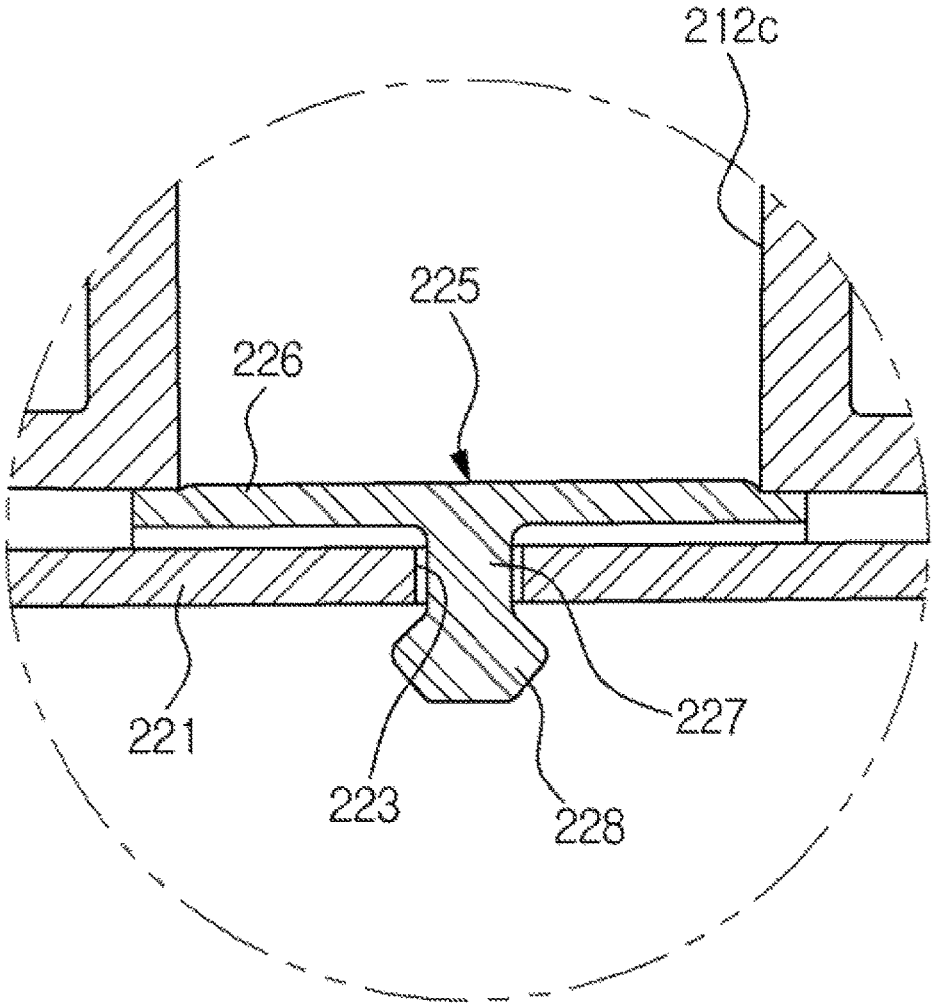
FIG. 10 is an enlarged view of the part A in FIG. 9.

FIG. 6 is a diagram illustrating a distribution device of the dish washing machine in FIG. 1. FIG. 7 is an exploded diagram illustrating a configuration of the distribution device of the dish washing machine in FIG. 1. FIG. 8 is an exploded diagram illustrating a configuration of an opening and closing member of the distribution device of the dish washing machine in FIG. 1. FIG. 9 is a cross sectional view of the distribution device of the dish washing machine in FIG. 1. FIG. 10 is an enlarged view of the part A in FIG. 9.

The distribution device of the dish washing machine according to the embodiment of the present invention will be described with reference to FIGS. 6 to 10.

The distribution device 200 has an approximately cylindrical shape.

The distribution device 200 includes a housing 210 having an approximately hollow and cylindrical shape and forming an appearance, an opening and closing member 220 rotatably provided inside the housing 210, a motor 230 configured to rotate the opening and closing member 220, a support member 260 configured to support the motor 230 and the housing 210, a cam member 240 combined with the motor 230 and the opening and closing member 220 to rotate along with the opening and closing member 220, and a micro switch 250 coming in contact with the cam member 240 to detect a rotation position of the opening and closing member 220.

The housing 210 may be disposed to extend toward both side walls 33 and 34 (FIG. 2) of the washing tank 30. Hereinafter, a lengthwise direction of the housing 210 is referred to as an axis direction. An inlet 211 in which washing water is introduced into the housing 210 is formed in one end portion of the housing 210 in the axis direction. The motor 230 is disposed in the other end portion of the housing 210 in the axis direction.

Specifically, the inlet 211 may be provided to face the right side wall 34 of the washing tank 30. The circulation pump 51 is connected to the inlet 211. When the circulation pump 51 is operated, washing water stored in the sump 100 may be introduced into the housing 210 through the inlet 211.

A plurality of outlets 212*a*, 212*b*, and 212*c* are formed in a circumferential surface of the housing 210. The plurality of outlets 212*a*, 212*b*, and 212*c* are arranged at predetermined intervals in the axis direction. The plurality of outlets 212*a*, 212*b*, and 212*c* include the first outlet 212*a*, the second outlet 212*b*, and the third outlet 212*c*.

Here, the plurality of outlets 212*a*, 212*b*, and 212*c* are provided to face a back wall 32 (FIG. 2) of the washing tank 30. In this manner, the distribution device 200 according to the embodiment of the present invention has a structure in which the housing 210 has a cylindrical shape, the housing 210 is disposed to extend toward the both side walls 33 and 34, and the opening and closing member 220 rotates with respect to the axis direction of the housing 210 to open or close the outlets 212*a*, 212*b*, and 212*c* so that the plurality of outlets 212*a*, 212*b*, and 212*c* may be provided to face the back wall 32 of the washing tank 30.

Additionally, since a distribution device generally used in a dish washing machine in the related art includes a hemispherical-shaped housing and a flat disk type opening and closing device rotatably provided above the housing, it has a structure in which outlets should be provided above the distribution device.

As described above, in the distribution device 200 according to the embodiment of the present invention, since the outlets 212*a*, 212*b*, and 212*c* are provided to face the back wall 32 of the washing tank 30, it is advantageous in that a pressure loss of washing water supplied to the fixed nozzle assembly 320 disposed adjacent to the back wall 32 of the washing tank 30 decreases in the distribution device 200.

This is because the flow path connecting the outlets 212*a*, 212*b*, and 212*c* and the fixed nozzle assembly 320 may be formed gradually without a sharp bent portion.

On the other hand, when the distribution device in the related art in which outlets are provided to face the upper side of the distribution device is applied to the fixed nozzle assembly 320 according to the embodiment of the present invention, the flow path connected to the outlets should be sharply bent toward the back side at a start point thereof, the pressure loss is large.

The first outlet 212*a*, the second outlet 212*b*, and the third outlet 212*c* may be sequentially arranged from the left to the right of the washing tank 30.

That is, the first outlet 212*a* is disposed relatively closer to the left fixed nozzle 330, the third outlet 212*c* is disposed relatively closer to the right fixed nozzle 360, and the second outlet 212*b* is disposed at the center thereof.

The first outlet 212*a* may be connected to the left fixed nozzle 330 through the first hose 271*a* (FIG. 3). The second outlet 212*b* may be connected to the rotation nozzles 311 and 313 through the second hose 271*b* (FIG. 3). The third outlet 212*c* may be connected to the right fixed nozzle 360 through the third hose 271*c* (FIG. 3).

In this manner, since each of the outlets 212*a*, 212*b*, and 212*c* is connected to the jet nozzle 311, 313, or 320 that is closest thereto, lengths of the hoses 271*a*, 271*b*, and 271*c* may decrease, no twist may occur and a pressure loss of washing water may decrease.

A sump combining portion 213 to be combined with the sump 100 may be provided in the housing 210 and a distribution device combining portion 109 (FIG. 3) to be combined with the sump combining portion 213 may be provided in the sump 100. In this embodiment, the sump combining portion 213 is provided in the form of a groove and the distribution device combining portion 109 may be provided in the form of a protrusion. When the sump combining portion 213 and the distribution device combining portion 109 are combined, positions of the distribution device 200 and the sump 100 may be aligned.

The opening and closing member 220 selectively opens or closes the outlets 212*a*, 212*b*, and 212*c* while rotating with respect to the axis direction of the housing 210 inside the housing 210. Therefore, the opening and closing member 220 may substantially distribute washing water to the jet nozzles 311, 313, and 320.

The opening and closing member 220 has an approximately hollow cylindrical shape. The opening and closing member 220 includes a rotation body 221 rotating inside the housing 210 and a sealing members 225 to be combined with the rotation body 221 to close the outlets 212*a*, 212*b*, and 212*c*.

Communicating holes 222 may be formed in a circumferential surface of the rotation body 221. When the communicating holes 222 are positioned to correspond to the outlets 212*a*, 212*b*, and 212*c*, washing water may be smoothly discharged to the outlets 212*a*, 212*b*, and 212*c*.

Also, separation protrusions 224 may be formed in the circumferential surface of the rotation body 221. The protrusions separate a predetermined interval an inner circumferential surface of the housing 210 and an outer circumferential surface of the rotation body 221 such that a friction with the housing 210 is minimized and the opening and closing member 220 may smoothly rotate when the opening and closing member 220 rotates inside the housing 210. The inner circumferential surface of the housing 210 and the outer circumferential surface of the rotation body 221 may always maintain a predetermined interval by the separation protrusions 224.

Also, locking holes 223 with which the sealing members 225 are combined may be formed in a circumferential surface of the rotation body 221. Locking protrusions 227 of the sealing members 225 are combined with the locking holes 223. The locking holes 223 may have different shapes corresponding to shapes of the locking protrusions 227 of the sealing members 225.

As an example, the locking hole 223 at the center may have an approximately cross shape and the locking holes 223 at both sides may have a straight line shape.

Similarly, the locking protrusion 227 of the sealing member 225 at the center may have a cross shape and the locking protrusions 227 at both sides may have a straight line shape.

Different shapes are provided in this manner so that it is possible to easily identify the difference when the sealing member 225 to be combined at the center and the sealing members 225 to be combined at both sides have different shapes during assembly.

Between both end portions of the rotation body 221 in the axis direction, one end portion corresponding to the inlet 211 of the housing 210 is opened. In the other end portion between end portions of the rotation body 221 in the axis direction, a cam shaft combining portion 229 with which a cam shaft 241 of the cam member 240 is combined is provided.

The sealing members 225 are combined with the circumferential surface of the rotation body 221 to close the outlets 212*a*, 212*b*, and 212*c*. The sealing members 225 are combined with the locking holes 223 of the rotation body 221. The sealing members 225 are slightly movable and combined with the locking holes 223 of the rotation body 221 in a radial direction. This is because the sealing members 225 come in close contact with the outlets 212*a*, 212*b*, and 212*c* to reinforce sealing of the outlets 212*a*, 212*b*, and 212*c*.

That is, the sealing members 225 move between an open position in close contact with the rotation body 221 and a close position in close contact with the outlets 212*a*, 212*b*, and 212*c*. When washing water is introduced into the housing 210, the sealing members 225 may naturally move from the open position to the close position due to a hydraulic pressure of washing water. Therefore, a sealing force of the outlets 212*a*, 212*b*, and 212*c* increases and reliability of the distribution device 200 may be improved.

The sealing member 225 includes a sealing portion 226 (FIG. 8) having a curved surface shape to come in close contact with the outlets 212*a*, 212*b*, and 212*c* and the locking protrusion 227 that protrudes from the sealing portion 226 to be inserted into the locking hole 223 of the rotation body 221.

The locking protrusion 227 and the locking hole 223 may have a slight gap such that the sealing member 225 is movable in the radial direction. Alternatively, a stopper portion 228 having a greater diameter than the locking hole 223 may be formed in an end portion of the locking protrusion 227 to prevent the sealing member 225 from being completely separating from the locking hole 223.

The sealing member 225 may be integrally made of a resin material. The sealing member 225 may be easily assembled to the rotation body 221 using a method in which the locking protrusion 227 is strongly pressed to be inserted into the locking hole 223. After the assembly, the stopper portion 228 is locked by the locking hole 223 and not separated from the rotation body 221 unless a force is manually applied.

Figure 11:
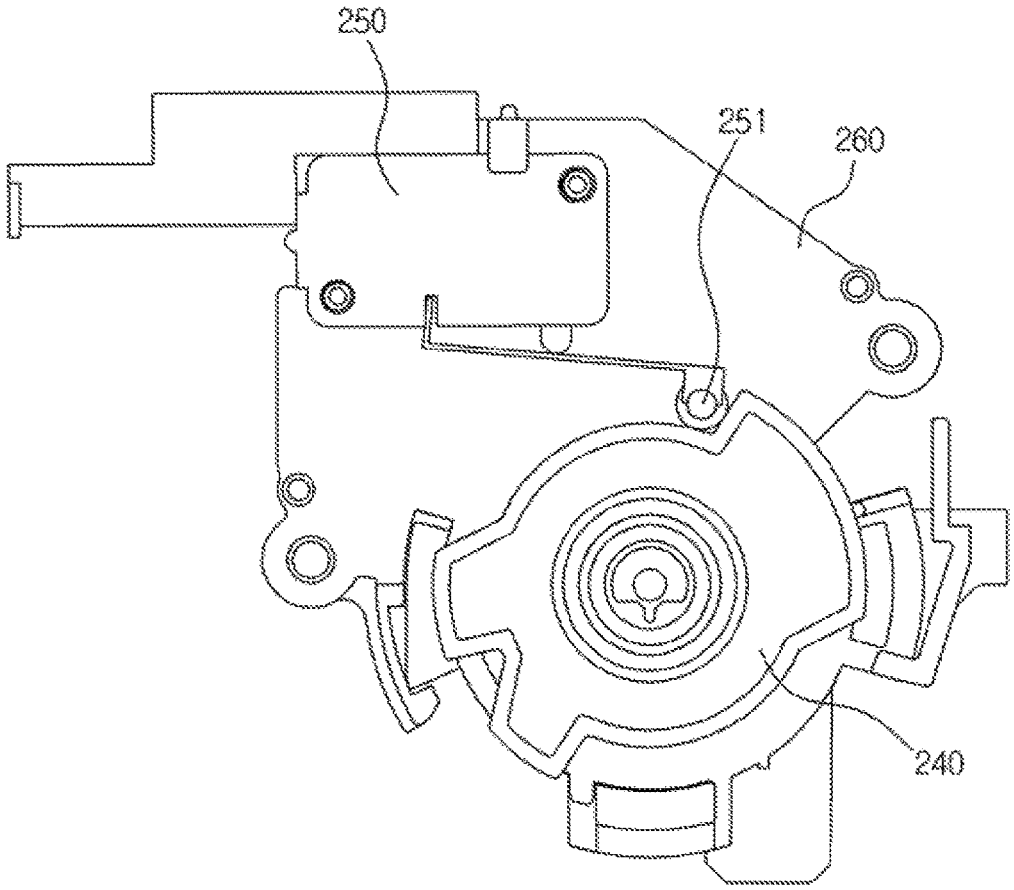
FIG. 11 is a side view of the distribution device of the dish washing machine in FIG. 1 (a motor is not provided)
Figure 12:
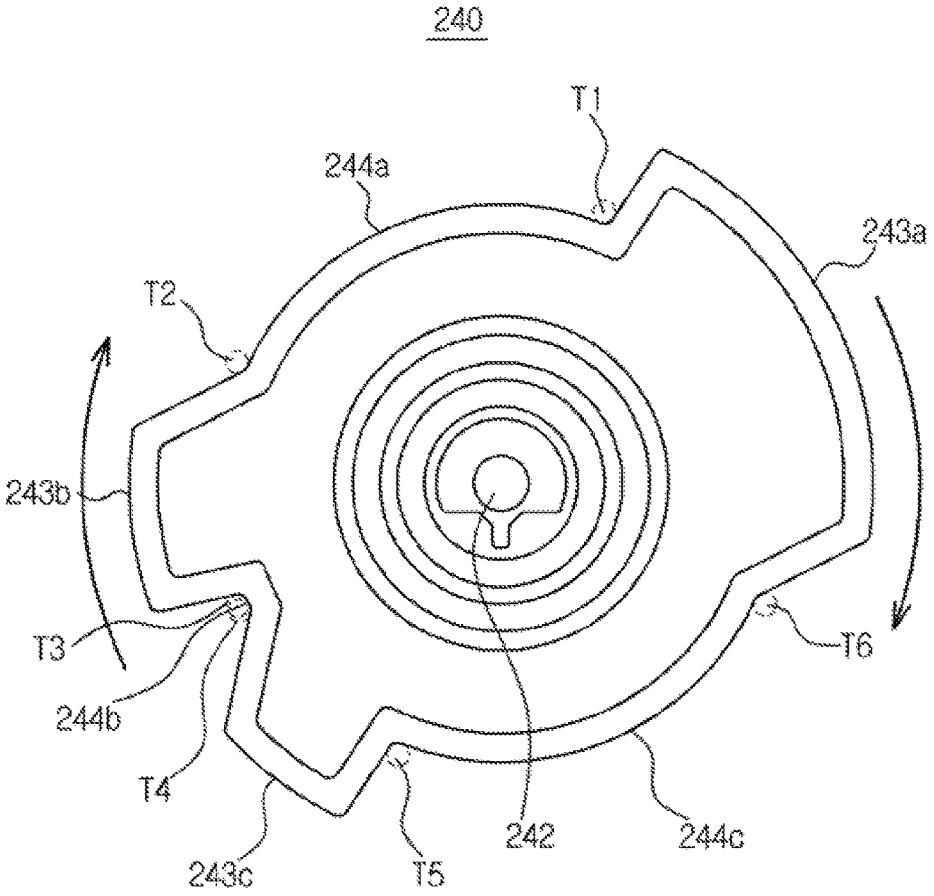
FIG. 12 is an enlarged view of a cam member of the distribution device of the dish washing machine in FIG. 1.
Figure 13:
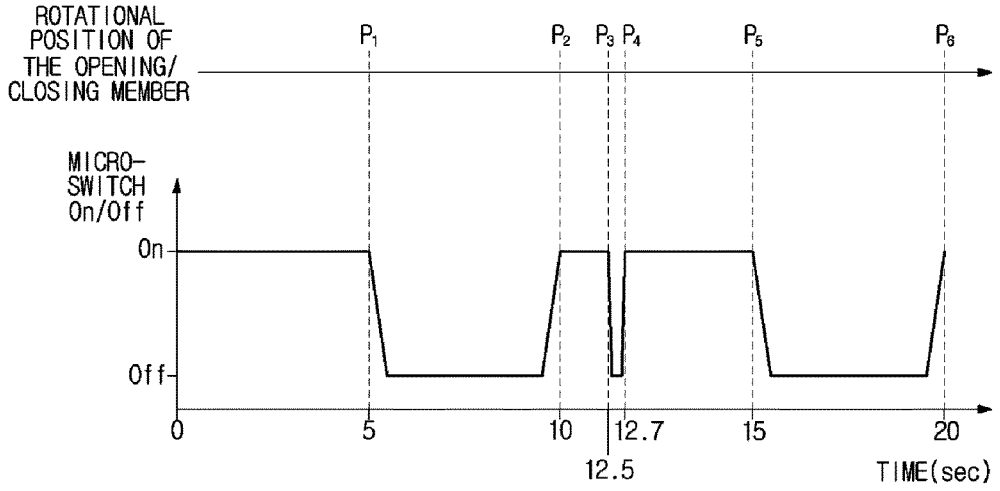
FIG. 13 is a diagram illustrating a relation between an on or off time of a micro switch of the distribution device of the dish washing machine in FIG. 1 and a rotation position of an opening and closing member.
Figure 14:
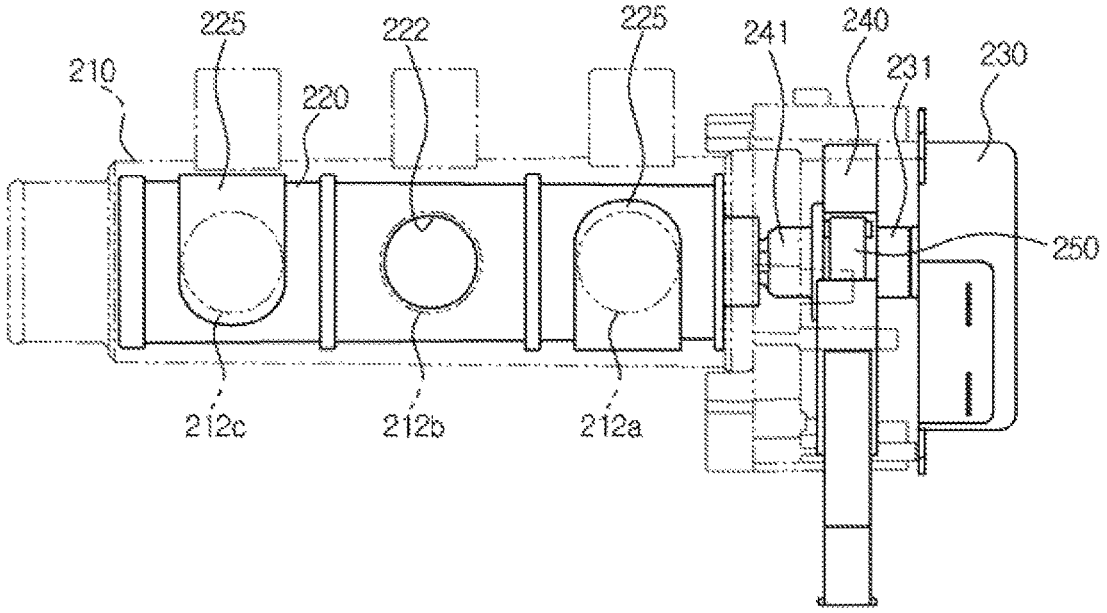
FIG. 14 is a diagram illustrating an operation of the distribution device of the dish washing machine in FIG. 1 and is a diagram illustrating an operation in which only a second outlet is opened and washing water is distributed to only rotation nozzles.
Figure 15:
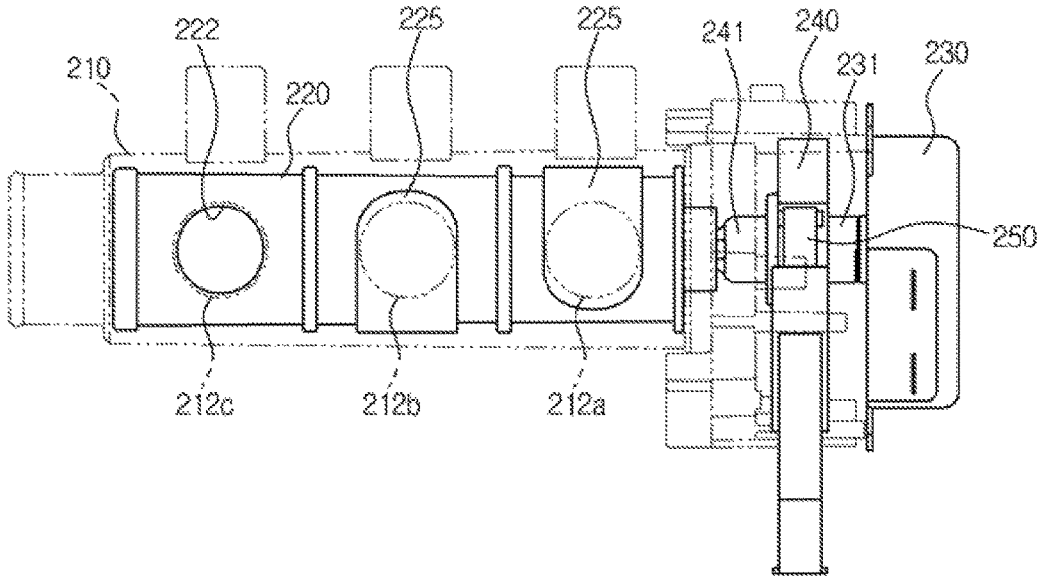
FIG. 15 is a diagram illustrating an operation of the distribution device of the dish washing machine in FIG. 1 and is a diagram illustrating an operation in which only a third outlet is opened and washing water is distributed to only a right fixed nozzle assembly.
Figure 16:
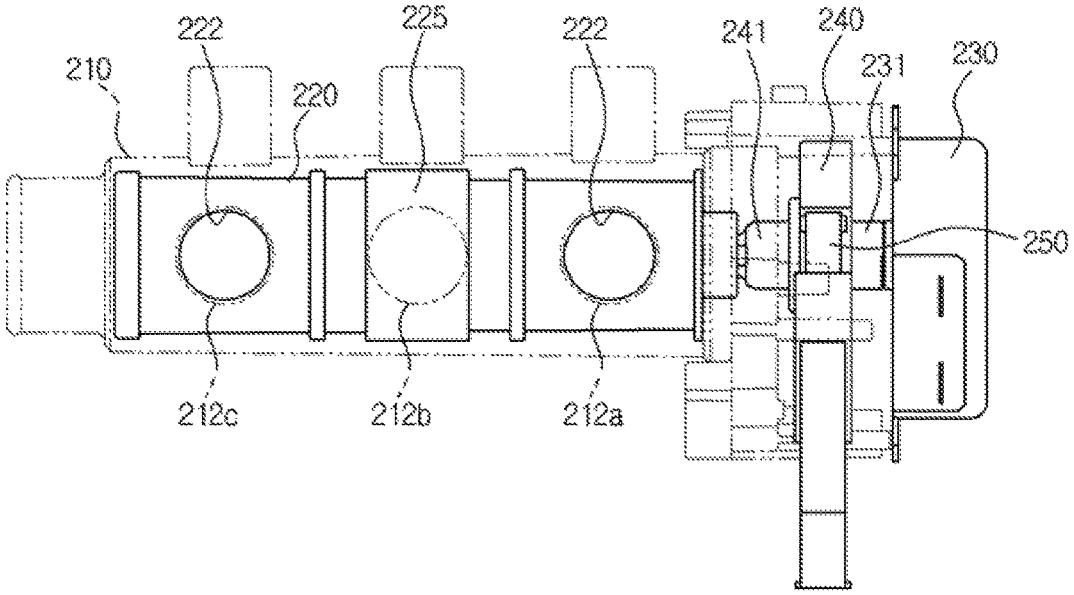
FIG. 16 is a diagram illustrating an operation of the distribution device of the dish washing machine in FIG. 1 and is a diagram illustrating an operation in which only a first outlet and the third outlet are opened and washing water is distributed to only a left fixed nozzle assembly and the right fixed nozzle assembly.
Figure 17:
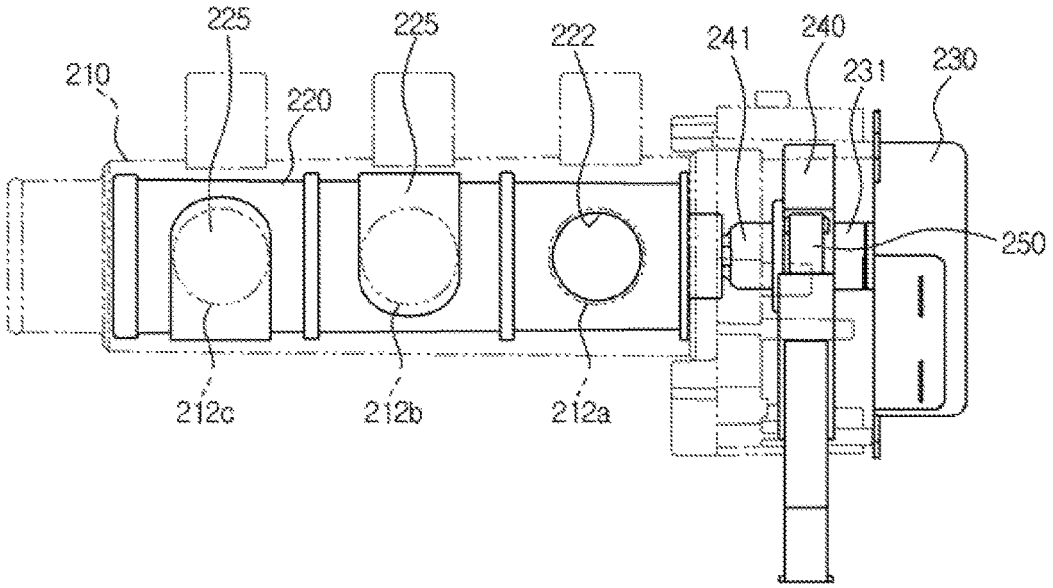
FIG. 17 is a diagram illustrating an operation of the distribution device of the dish washing machine in FIG. 1 and is a diagram illustrating an operation in which only the first outlet is opened and washing water is distributed to only the left fixed nozzle assembly.

FIG. 11 is a side view of the distribution device of the dish washing machine in FIG. 1 (a motor is not provided). FIG. 12 is an enlarged view of a cam member of the distribution device of the dish washing machine in FIG. 1. FIG. 13 is a diagram illustrating a relation between an on or off time of a micro switch of the distribution device of the dish washing machine in FIG. 1 and a rotation position of an opening and closing member. FIG. 14 is a diagram illustrating an operation of the distribution device of the dish washing machine in FIG. 1 and is a diagram illustrating an operation in which only a second outlet is opened and washing water is distributed to only rotation nozzles. FIG. 15 is a diagram illustrating an operation of the distribution device of the dish washing machine in FIG. 1 and is a diagram illustrating an operation in which only a third outlet is opened and washing water is distributed to only a right fixed nozzle assembly. FIG. 16 is a diagram illustrating an operation of the distribution device of the dish washing machine in FIG. 1 and is a diagram illustrating an operation in which only a first outlet and the third outlet are opened and washing water is distributed to only a left fixed nozzle assembly and the right fixed nozzle assembly. FIG. 17 is a diagram illustrating an operation of the distribution device of the dish washing machine in FIG. 1 and is a diagram illustrating an operation in which only the first outlet is opened and washing water is distributed to only the left fixed nozzle assembly.

Operations of the distribution device according to the embodiment of the present invention will be described with reference to FIGS. 11 to 17.

When the motor 230 is operated, a rotational force is delivered to the cam member 240 through a motor shaft 231 and the cam member 240 rotates. The motor 230 may be a one directional motor that rotates in only one direction.

For convenience of description, it is assumed that the cam member 240 rotates in a clockwise direction with respect to a rotation center 242, based on FIG. 12. When the cam member 240 rotates, a rotational force is delivered to the opening and closing member 220 through the cam shaft 241 and the opening and closing member 220 rotates along therewith.

A contact terminal 251 of the micro switch 250 adheres to the cam member 240. The cam member 240 includes convex portions 243*a*, 243*b*, and 243*c* that protrude in the radial direction to turn the micro switch 250 on or off and concave portions 244*a*, 244*b*, and 244*c* that are depressed in the radial direction.

The convex portions 243*a*, 243*b*, and 243*c* may include the first convex portion 243*a*, the second convex portion 243*b*, and the third convex portion 243*c* which are sequentially arranged in a counterclockwise direction. The concave portions 244*a*, 244*b*, and 244*c* may include the first concave portion 244*a*, the second concave portion 244*b*, and the third concave portion 244*c* which are sequentially arranged in a counterclockwise direction.

It is assumed that the micro switch 250 is turned on when the contact terminal 251 comes in contact with the convex portions 243*a*, 243*b*, and 243*c* of the cam member 240 and is turned off when the contact terminal 251 comes in contact with the concave portions 244*a*, 244*b*, and 244*c* of the cam member 240. Therefore, when the motor 230 is driven, the micro switch 250 may be alternately turned on or off.

Meanwhile, the distribution device 200 further includes a control unit that designates rotation positions of the opening and closing member 220 according to an on or off time of the micro switch 250 and rotates or stops the motor 230 such that the opening and closing member 220 rotates to a specific necessary rotation position among the designated rotation positions. The control unit may be configured as an electronic circuit.

As an example, as illustrated in FIG. 13, the control unit may designate six rotation positions P1, P2, P3, P4, P5, and P6 of the opening and closing member 220.

The control unit may designate a rotation position of the opening and closing member 220 at a time point at which the micro switch 250 is turned on for 5 seconds and turned off as the first rotation position P1 among the six rotation positions P1, P2, P3, P4, P5, and P6 of the opening and closing member 220.

Since a time point at which the micro switch 250 is turned on for 5 seconds and turned off is only one in this embodiment, an interval in which the micro switch 250 is turned on for 5 seconds may be a reference reset interval.

Also, a rotation position of the opening and closing member 220 at a time point at which the micro switch 250 is turned on for 5 seconds, turned off for 5 seconds, and turned on again may be designated as the second rotation position P2.

In this manner, the first rotation position P1 to the sixth rotation position P6 may be designated.

In the six rotation positions P1, P2, P3, P4, P5, and P6 of the opening and closing member 220, the contact terminal 251 of the micro switch 250 is positioned in each contact terminal position T1, T2, T3, T4, T5, or T6 illustrated in FIG. 12.

Information on the rotation position of the opening and closing member 220 according to an on or off time of the micro switch 250 may be stored in the form of ROM in advance in the control unit.

Also, opening and closing information of the outlets 212*a*, 212*b*, and 212*c* of the distribution device 200 according to each rotation position of the opening and closing member 220 and jet information of the jet nozzles 311, 313, 330, and 340 according to opening and closing of the outlets 212*a*, 212*b*, and 212*c* may be stored in the form of ROM in advance in the control unit.

Therefore, when a user inputs the specific jet nozzles 311, 313, 330, and 340 to be used, the control unit determines the outlets 212*a*, 212*b*, and 212*c* to be opened or closed according to the input, and a specific rotation position of the opening and closing member 220 may be determined accordingly.

The control unit drives the motor 230 to rotate the opening and closing member 220 to the determined specific rotation position. When rotation of the opening and closing member 220 to the determined specific rotation position is completed, driving of the motor 230 may be stopped.

In this embodiment, when the opening and closing member 220 is in the first rotation position P1, as illustrated in FIG. 14, only the second outlet 212*b* is opened and therefore washing water may be distributed to only the rotation nozzles 311 and 313.

When the opening and closing member 220 is in the second rotation position P2, as illustrated in FIG. 15, only the third outlet 212*c* is opened and therefore washing water may be distributed to only the right fixed nozzle 360.

The third rotation position P3 and the fourth rotation position P4 of the opening and closing member 220 are not used.

When the opening and closing member 220 is in the fifth rotation position P5, as illustrated in FIG. 16, only the first outlet 212*a* and the third outlet 212*c* are opened and therefore washing water may be distributed to only the left fixed nozzle 330 and the right fixed nozzle 360.

When the opening and closing member 220 is in the sixth rotation position P6, as illustrated in FIG. 17, only the first outlet 212*a* is opened and therefore washing water may be distributed to only the left fixed nozzle 330.

Figure 18A:
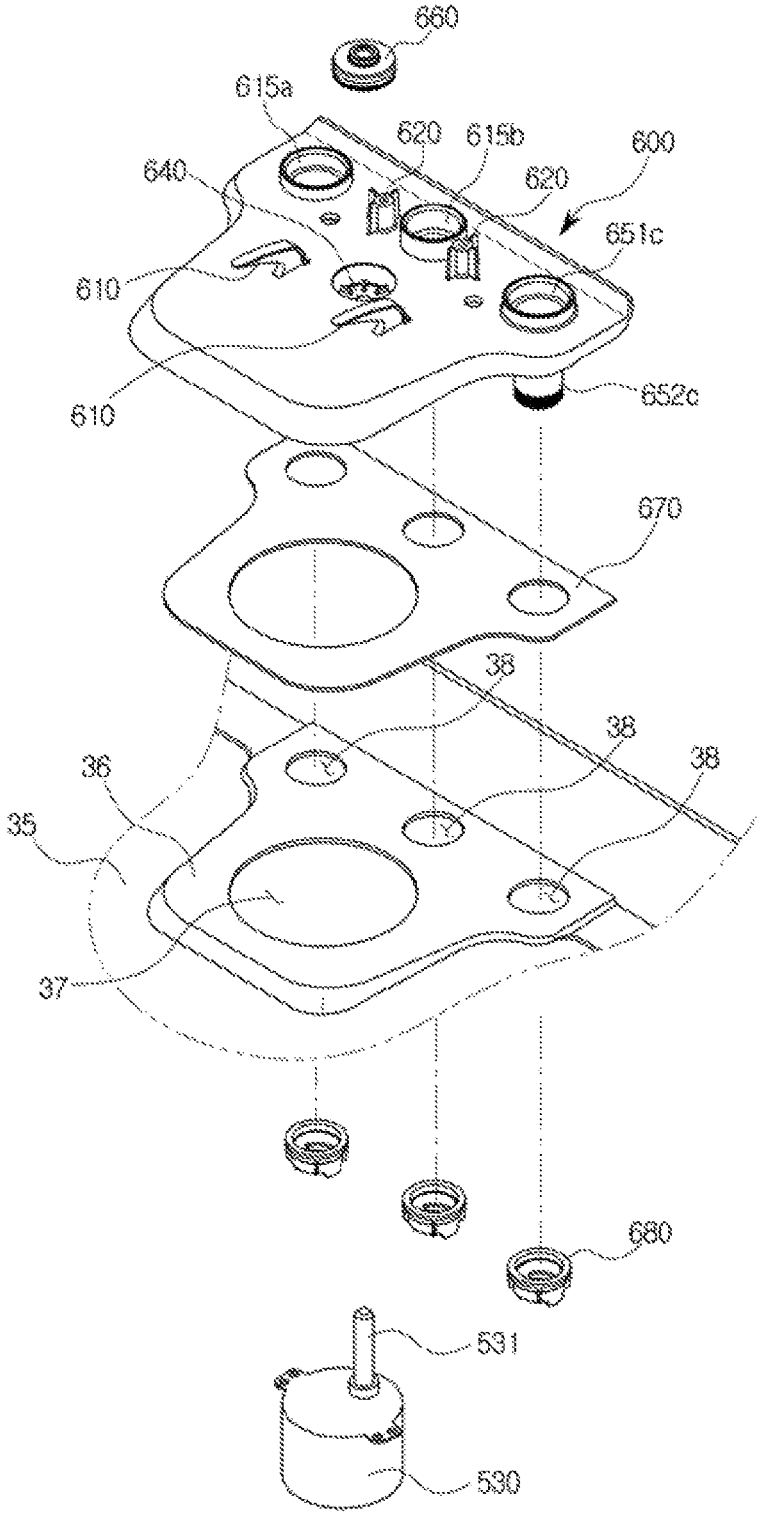
FIG. 18A is an exploded diagram illustrating a bottom plate, a bottom plate cover, and a motor of a washing tank of the dish washing machine in FIG. 1.
Figure 18B:
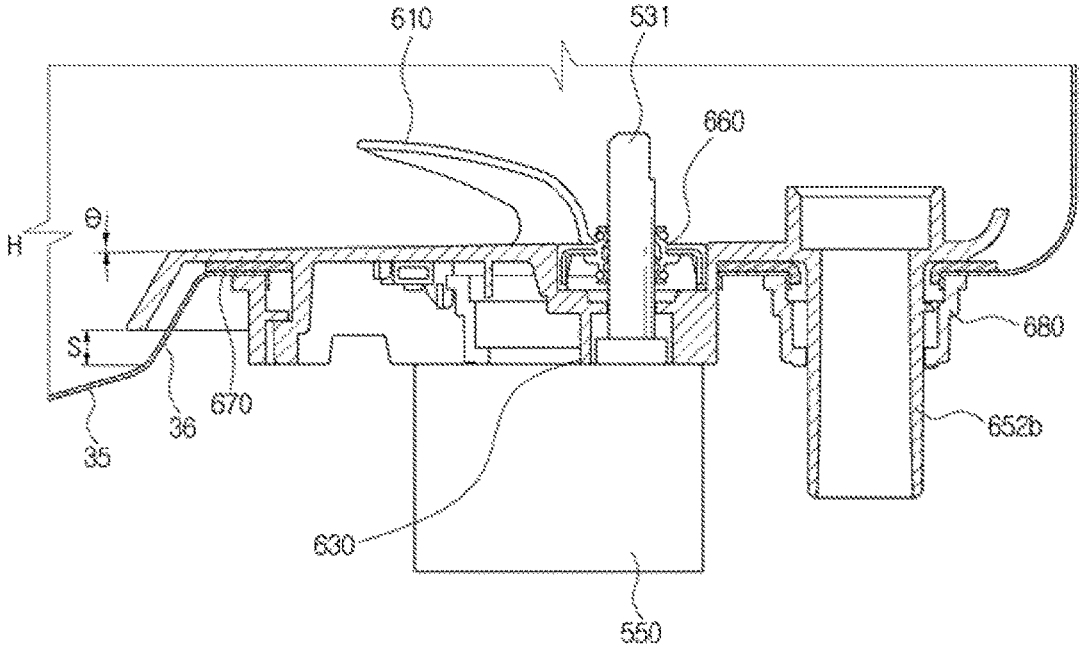
FIG. 18B is a cross sectional view of the bottom plate, the bottom plate cover, and the motor of the dish washing machine in FIG. 1.
Figure 19A:
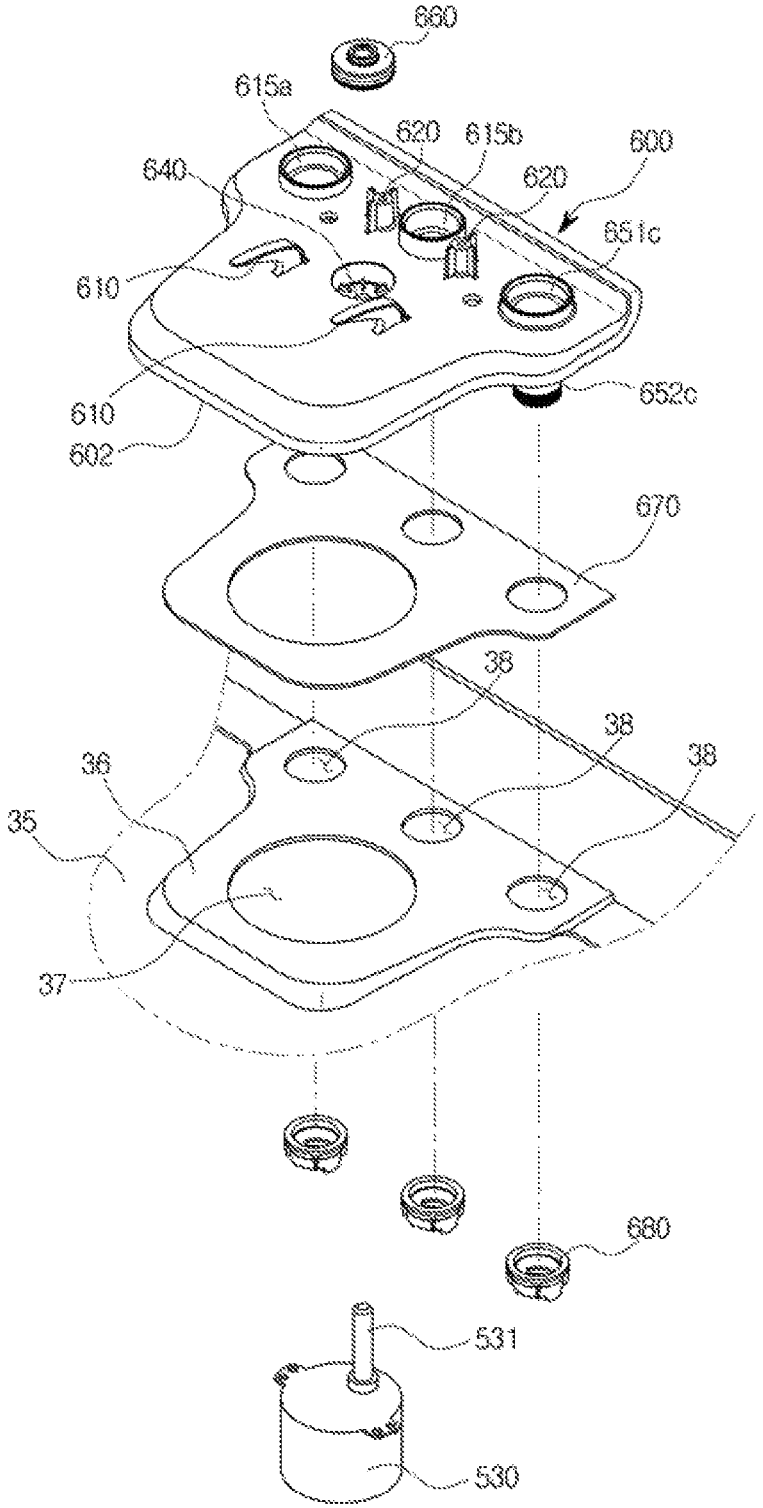
FIG. 19A is a diagram in which a sealing member is added to FIG. 18A.
Figure 19B:
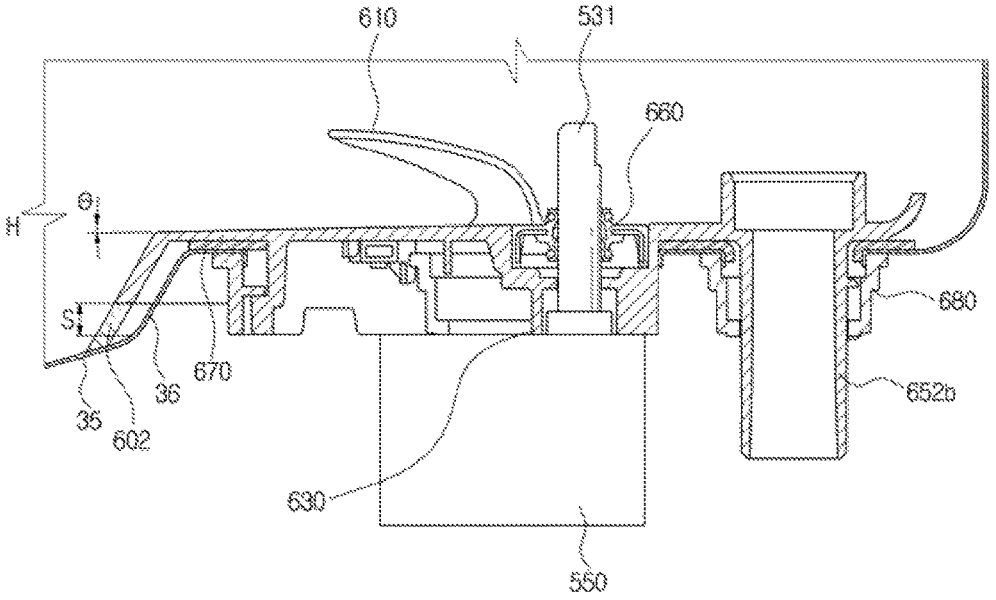
FIG. 19B is a diagram in which the sealing member is added to FIG. 18B.
Figure 20:
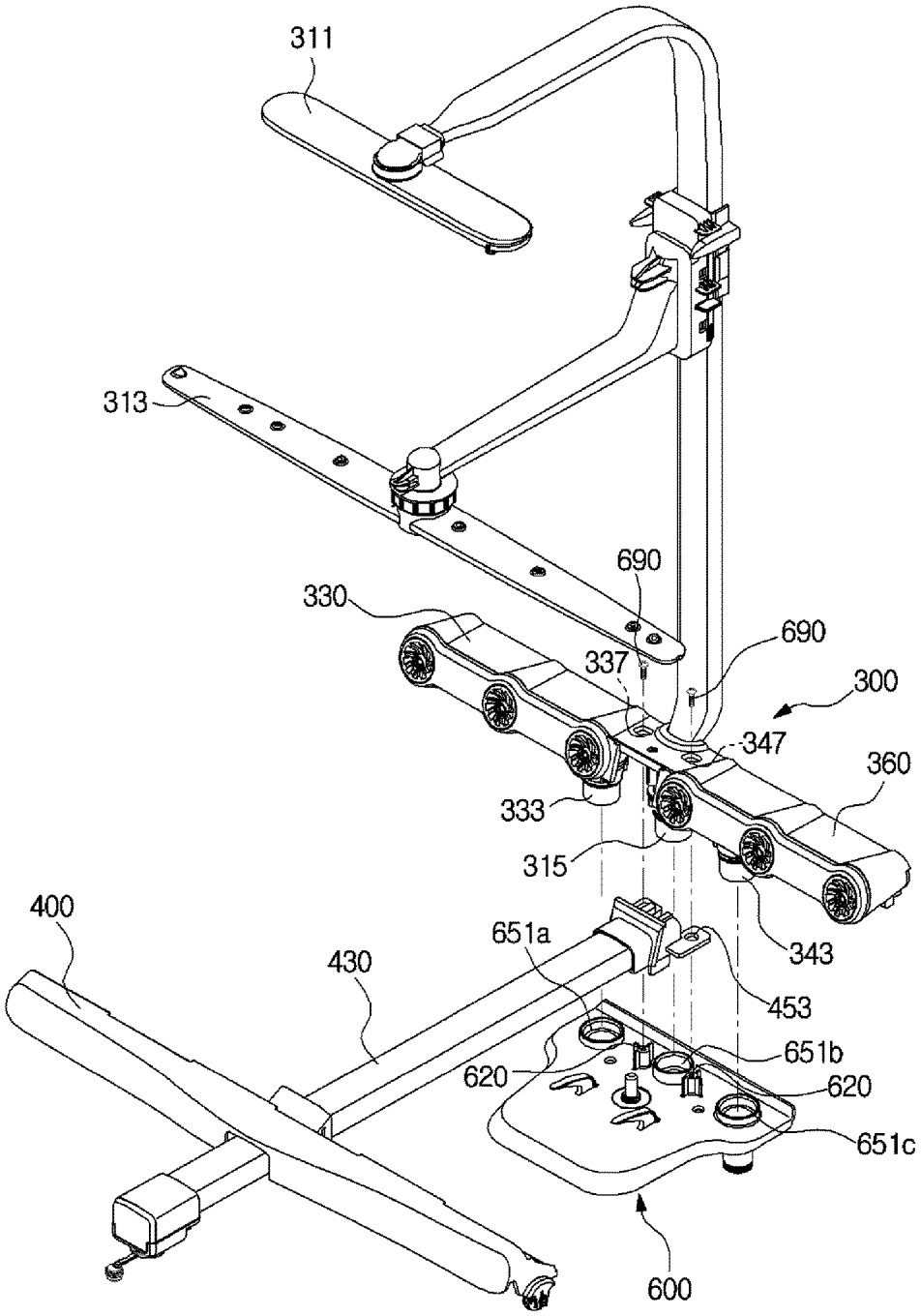
FIG. 20 is an exploded diagram of a vane, a rail assembly, a jet nozzle assembly, and a bottom plate cover of the dish washing machine in FIG. 1.

FIG. 18A is an exploded diagram illustrating a bottom plate, a bottom plate cover, and a motor of a washing tank of the dish washing machine in FIG. 1. FIG. 18B is a cross sectional view of the bottom plate, the bottom plate cover, and the motor of the dish washing machine in FIG. 1. FIG. 19A is a diagram in which a sealing member is added to FIG. 18A. FIG. 19B is a diagram in which the sealing member is added to FIG. 18B. FIG. 20 is an exploded diagram of a vane, a rail assembly, a jet nozzle assembly, and a bottom plate cover of the dish washing machine in FIG. 1.

The bottom plate cover of the dish washing machine according to the embodiment of the present invention will be described with reference to FIGS. 18 to 20.

The dish washing machine 1 includes the bottom plate cover 600 combined with one back side of the bottom plate 35 of the washing tank 30.

The bottom plate cover 600 performs a function of sealing flow path through-holes 38 and a motor through-hole 37 formed in the bottom plate 35, a function of supporting a motor 530 configured to drive the vane 400, and a function of fixing a nozzle assembly 300 and a rail assembly 430 of the dish washing machine 1.

Here, as described above, the nozzle assembly 300 includes the upper rotation nozzle 311, the intermediate rotation nozzle 313, the left fixed nozzle 330, and the right fixed nozzle 360.

The rail assembly 430 guides movement of the vane 400 and a detailed configuration thereof will be described below.

A bottom plate protrusion 36 that protrudes such that the bottom plate cover 600 is combined may be formed behind the bottom plate 35. The motor through-hole 37 through which the motor 530 configured to drive the vane 400 passes and the flow path through-holes 38 through which a flow path connecting the nozzle assembly 300 and the distribution device 200 (FIG. 3) passes may be formed in the bottom plate protrusion 36.

The motor 530 may be mounted on a bottom surface of the bottom plate cover 600. When the bottom plate cover 600 is separated from the bottom plate 35, the motor 530 may be removed along with the bottom plate cover 600 through the motor through-hole 37.

Specifically, hose connecting units 652*a*, 652*b*, and 652*c* of the bottom plate cover 600 may pass through the flow path through-holes 38.

The bottom plate cover 600 includes a shaft through-hole 640 through which a driving shaft 531 of the motor 530 passes, the hose connecting units 652*a*, 652*b*, and 652*c* that protrude downward such that the hoses 271*a*, 271*b*, and 271*c* extending from the distribution device 200 are combined and that are inserted into the flow path through-holes 38 of the bottom plate protrusion 36, nozzle inlet connecting units 651*a*, 651*b*, and 651*c* that protrude upward such that inlets 315, 333, and 343 of the nozzle assembly 300 are combined, fastening holes 620 for fixing the nozzle assembly 300 and the rail assembly 430, and a rotation guide 610 that protrudes to guide rotation of the vane 400.

The bottom plate cover 600 is combined in close contact with a top surface of the bottom plate protrusion 36. Fixing caps 680 are combined with the hose connecting units 652*a*, 652*b*, and 652*c* of the bottom plate cover 600 and the bottom plate cover 600 may be fixed in the bottom plate protrusion 36.

A sealing member 670 may be provided between the bottom plate cover 600 and the bottom plate protrusion 36 such that washing water inside the washing tank 30 does not leak through the motor through-hole 37 of the bottom plate protrusion 36 and the flow path through-holes 38. The sealing member 670 may be made of a rubber material.

A motor mounting portion 630 in which the motor 530 configured to drive the vane 400 is mounted may be provided on a bottom surface of the bottom plate cover 600. The driving shaft 531 of the motor 530 passes through the shaft through-hole 640 of the bottom plate cover 600 to protrude into the washing tank 30. A driving pulley 500 (FIG. 21) to be described below is combined with the driving shaft 531 of the motor 530 and rotates along with the driving shaft 531.

A sealing member 660 may be provided in the shaft through-hole 640 such that washing water inside the washing tank 30 does not leak to the shaft through-hole 640. The sealing member 660 may be a mechanical sealing device for sealing as well as smooth rotation of the driving shaft 531.

A top surface of the bottom plate cover 600 may be provided to be inclined at a predetermined angle (θ) (FIG. 19) with respect to a reference horizontal plane H (FIG. 19).

This is provided to prevent contaminants from accumulating on the bottom plate cover 600 or to prevent contaminants from advancing toward the fixed jet nozzles 320. Unlike the rotation nozzles 311 and 313, since the fixed jet nozzles 320 do not move in the dish washing machine 1 according to the embodiment of the present invention, contaminants may remain and stagnate. According to the above structure, occurrence of such problems may be prevented.

An inclination angle (θ) between the top surface of the bottom plate cover 600 and the reference horizontal plane (H) may preferably be about 3° or more.

Also, an end portion of the bottom plate cover 600 may be separated a predetermined interval S (FIG. 19) from the bottom plate 35. This is to prevent contaminants from being caught in a fine gap formed between the end portion of the bottom plate cover 600 and the bottom plate 35 because errors during manufacture and assembly make it difficult for the bottom plate cover 600 to completely adhere to the bottom plate 35. It is preferable that the interval S between the end portion of the bottom plate cover 600 and the bottom plate 35 be about 5 mm or more.

The rail assembly 430 and the nozzle assembly 300 may be combined with the bottom plate cover 600. The bottom plate cover 600, the rail assembly 430, and the nozzle assembly 300 may be firmly fixed by a fastening member 690. For this purpose, the fastening holes 620, 453, and 347 may be formed in positions corresponding to the bottom plate cover 600, the nozzle assembly 300, and the rail assembly 430, respectively.

According to such a structure, the rail assembly 430 and the nozzle assembly 300 may be mutually fixed and mutually aligned.

In the dish washing machine 1 according to the embodiment of the present invention, since washing water jetted from the fixed jet nozzles 320 of the nozzle assembly 300 is not directly directed toward a dish but is reflected by the vane 400 combined with the rail assembly 430 and is directed toward a dish, positions of the fixed jet nozzles 320 and the rail assembly 430 need to be accurately aligned. This requirement may be satisfied through such a combining structure.

The end portion of the bottom plate cover 600 may be separated a predetermined interval from the bottom plate. As another method, a sealing member 602 may be further included in the end portion of the bottom plate cover 600.

The sealing member 602 may be provided in the end portion of the bottom plate cover 600 and provided to make the bottom plate come in close contact with the bottom plate cover 600. According to such a configuration, it is possible to prevent contaminants from being introduced into a fine gap between the end portion of the bottom plate cover 600 and the bottom plate.

The sealing member 602 may be made of a material having elasticity such as rubber or a gasket and may also be made of a deformable material such as a sponge.

Also, the bottom plate cover 600 may be prepared through a process of corroding an external surface such as oxide film treatment. According to such a process, washing water flowing over a surface of the bottom plate cover 600 may be easily evaporated. The surface corroding process of the bottom plate cover 600 has been exemplified but the process may be applied to other configurations inside the washing tank.

Figure 21:
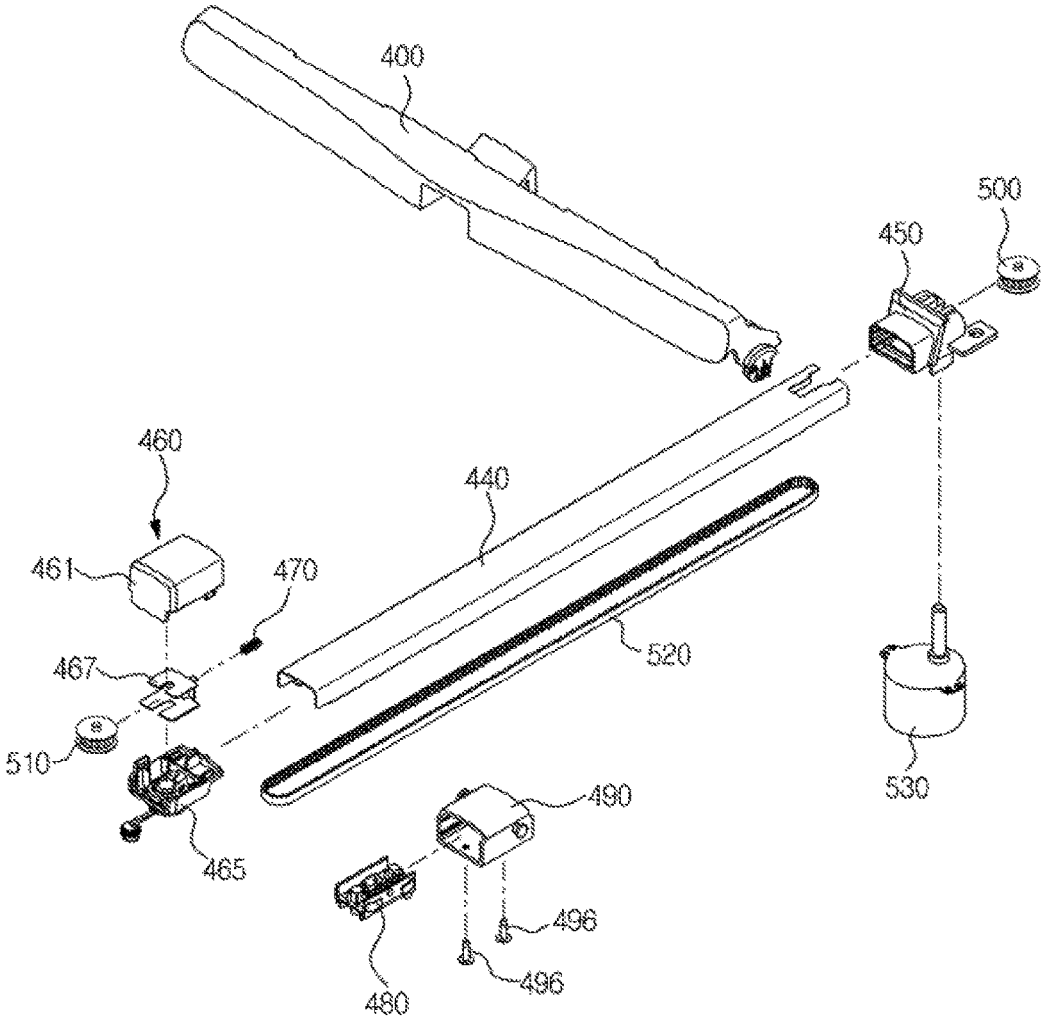
FIG. 21 is a diagram illustrating the vane and a driving device of the dish washing machine in FIG. 1 and is an exploded diagram illustrating a configuration of the driving device.
Figure 22:
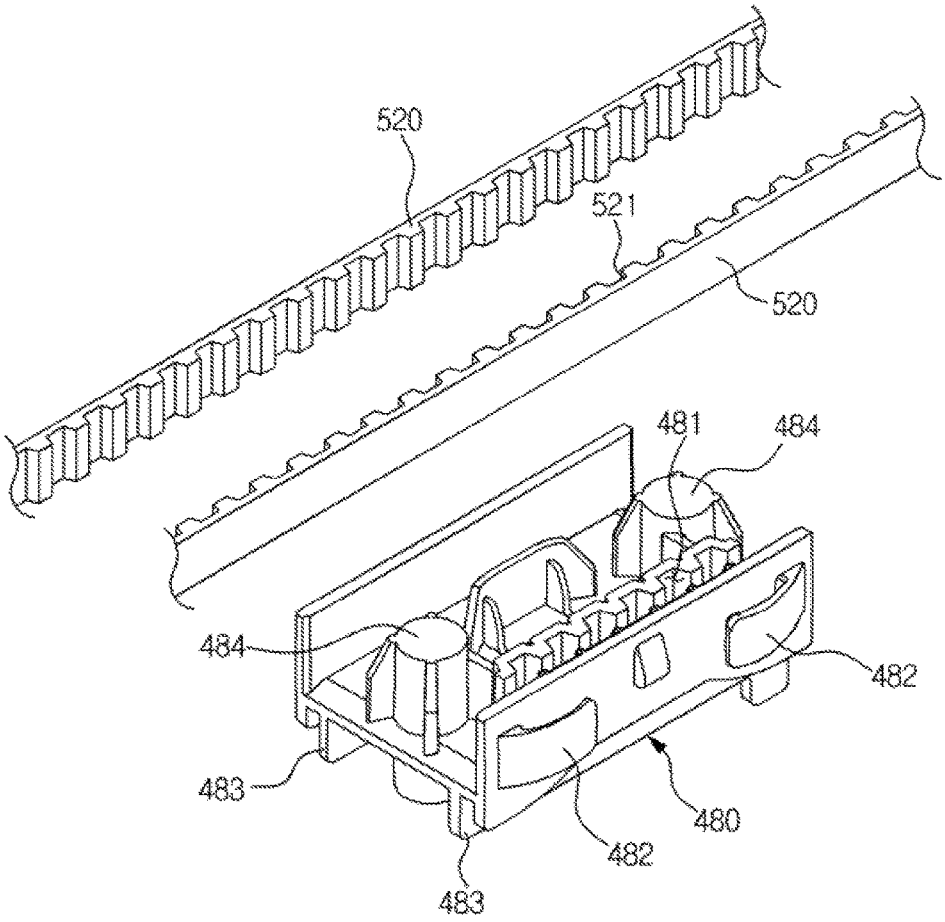
FIG. 22 is a diagram illustrating a belt and a belt holder of the dish washing machine in FIG. 1.
Figure 23:
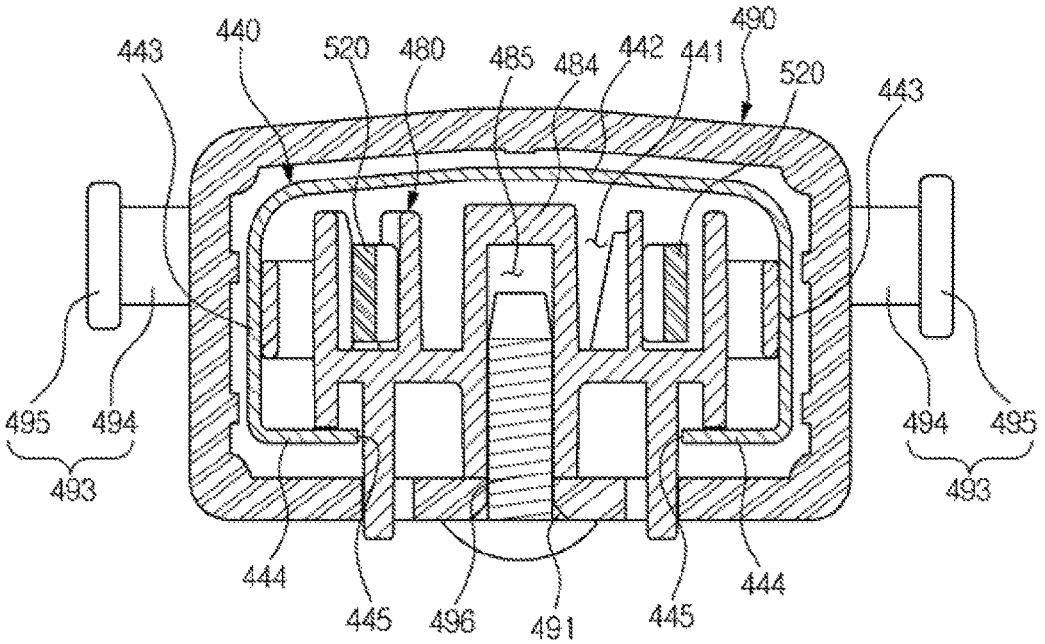
FIG. 23 is a cross sectional view of a rail, a belt, a belt holder, and a vane holder of the dish washing machine in FIG. 1.
Figure 24:
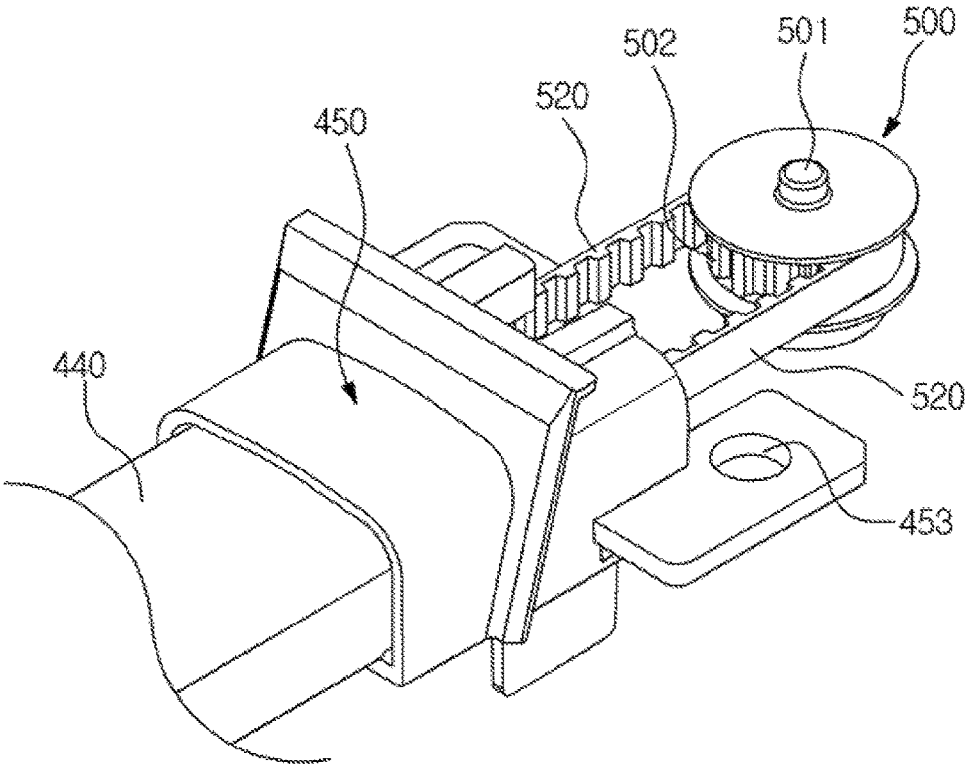
FIG. 24 is a diagram illustrating a rail, a belt, a driving pulley, and a rear holder of the dish washing machine in FIG. 1.
Figure 25:
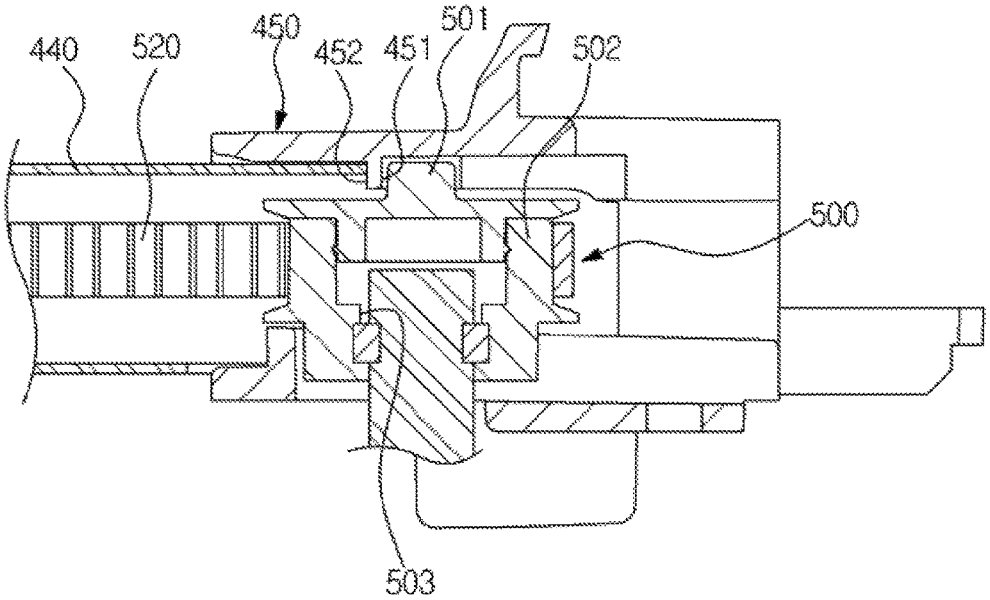
FIG. 25 is a cross sectional view of a rail, a belt, a driving pulley, and a rear holder of the dish washing machine in FIG. 1.
Figure 26:
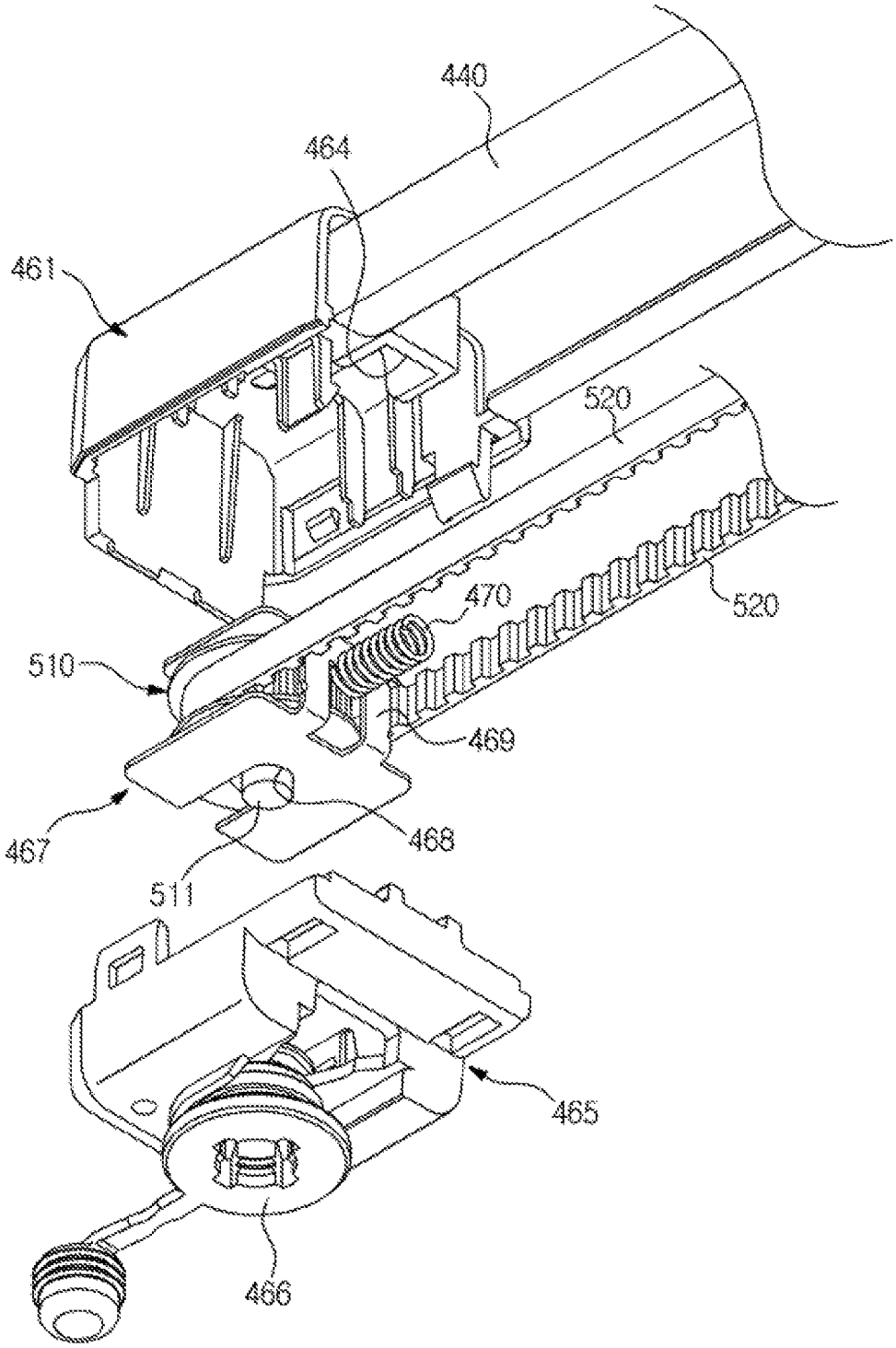
FIG. 26 is a diagram illustrating a rail, a belt, an idle pulley, and a front holder of the dish washing machine in FIG. 1.
Figure 27:
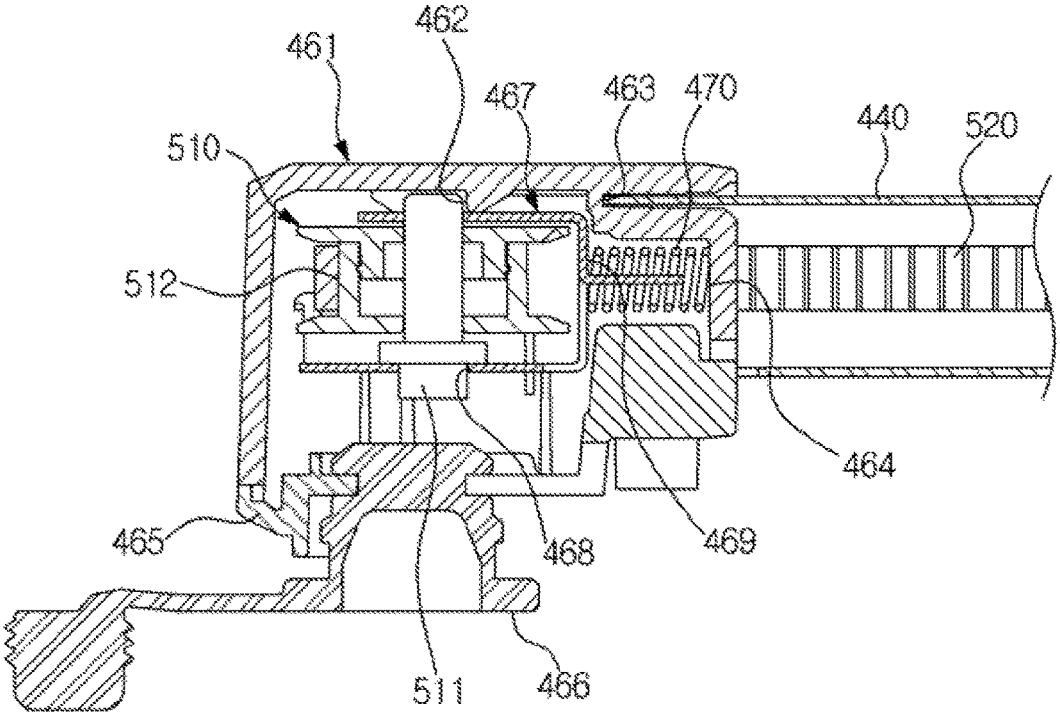
FIG. 27 is a cross sectional view of a rail, a belt, an idle pulley, and a front holder of the dish washing machine in FIG. 1.

FIG. 21 is a diagram illustrating the vane and a driving device of the dish washing machine in FIG. 1 and is an exploded diagram illustrating a configuration of the driving device. FIG. 22 is a diagram illustrating a belt and a belt holder of the dish washing machine in FIG. 1. FIG. 23 is a cross sectional view of a rail, a belt, a belt holder, and a vane holder of the dish washing machine in FIG. 1. FIG. 24 is a diagram illustrating a rail, a belt, a driving pulley, and a rear holder of the dish washing machine in FIG. 1. FIG. 25 is a cross sectional view of a rail, a belt, a driving pulley, and a rear holder of the dish washing machine in FIG. 1. FIG. 26 is a diagram illustrating a rail, a belt, an idle pulley, and a front holder of the dish washing machine in FIG. 1. FIG. 27 is a cross sectional view of a rail, a belt, an idle pulley, and a front holder of the dish washing machine in FIG. 1.

The vane and the driving device of the dish washing machine according to the embodiment of the present invention will be described with reference to FIGS. 21 to 27.

The dish washing machine 1 according to the embodiment of the present invention includes the vane 400 configured to reflect washing water jetted from the fixed nozzle assembly 320. The vane 400 may linearly reciprocate in a jet direction of washing water jetted from the fixed jet nozzles 320.

The dish washing machine 1 according to the embodiment of the present invention includes the driving device 420 configured to linearly reciprocate the vane 400.

The driving device 420 includes the motor 530 configured to generate a driving force and the rail assembly 430 configured to guide movement of the vane 400.

The rail assembly 430 includes a rail 440 configured to guide movement of the vane 400 and having an internal space 441, the driving pulley 500 that is connected to the motor 530 and rotates, a belt 520 that is connected to the driving pulley 500 and rotates and is disposed in the internal space 441 of the rail 440, an idle pulley 510 connected to the belt 520 to rotatably support the belt 520, a belt holder 480 that is combined with the belt 520, linearly reciprocate, and is disposed in the internal space 441 of the rail 440, a vane holder 490 that is combined with the belt holder 480, linearly reciprocate, is disposed outside the rail 440, and with which the vane 400 is combined, a rear holder 450 that is rotatably support the driving pulley 500 and combined with a rear end portion of the rail 440, and a front holder 460 that rotatably supports the idle pulley 510 and is combined with a front end portion of the rail 440.

The rail 440 may be made of a metal material. The rail 440 may extend in a forward and backward direction at the center with respect to the left side wall 33 and the right side wall 34 of the washing tank 30.

The rail 440 may have an approximately tubular shape having an opening 445 in an lower part. That is, the rail 440 may include the internal space 441, an upper wall 442, a lower wall 444, both side walls 443, and the lower opening 445 formed in the lower wall 444. The lower opening 445 may extend from one end portion to the other end portion of the rail 440 in a lengthwise direction.

The rail 440 is provided in a tubular shape in this manner so that the belt 520 is disposed in the internal space 441 of the rail 440, and thus interference of driving by the belt 520 coming in contact with a dish of the washing tank 30 is prevented or corrosion of the belt 520 coming in contact with washing water of the washing tank 30 is prevented.

Also, the opening 445 is formed in the lower wall 444 of the rail 440 so that the belt 520 disposed in the internal space 441 of the rail 440 and the vane 400 provided outside the rail 440 are connected to deliver a driving force of the belt 520 to the vane 400.

The belt 520 is wound on the driving pulley 500 and the idle pulley 510 to form a closed curve, and when the motor 530 is driven, may rotate in a rotation direction of the motor 530. The belt 520 may be made of a resin material including an aramid fiber in consideration of a tensile strength, costs, and the like.

A tooth shape 521 configured to deliver a driving force of the belt 520 to the belt holder 480 may be formed in an inside surface of the belt 520.

Similar to the belt 520, the belt holder 480 may be disposed in the internal space 441 of the rail 440, combined with the tooth shape 521 of the belt 520, and move along with the belt 520. For this purpose, the belt holder 480 may include a tooth shape combining portion 481 combined with the tooth shape 521 of the belt 520.

Also, the belt holder 480 may include legs 482 and 483 supported by the rail 440. The legs 482 and 483 may include at least one lateral leg 482 that protrudes laterally and is supported by the side walls 443 of the rail 440 and at least one lower leg 483 that protrudes downward and is supported by the lower wall 444 of the rail 440.

The lateral legs 482 may be elastically deformable such that noise and vibration due to collision and friction with the rail 440 while the belt holder 480 moves may decrease and the belt holder 480 may smoothly move.

The lateral legs 482 may be an elastic body that is one kind of plate spring. That is, the lateral legs 482 may include a curved surface plate that is elastically deformed between a decompressed shape and a compressed shape.

Also, the belt holder 480 may include a fastening portion 484 for combining with the vane holder 490. The fastening portion 484 may include a fastening hole 485 into which a fastening member 496 is inserted.

The vane holder 490 is combined with the belt holder 480, moves along the belt holder 480, and delivers a driving force of the belt holder 480 to the vane 400. The vane holder 490 is provided to cover an outer surface of the rail 440.

The vane holder 490 is combined with the belt holder 480 through the lower opening 445 of the rail 440. For this purpose, the vane holder 490 may include a fastening hole 491 for combining with the belt holder 480. Therefore, when the fastening member 496 is fastened to the fastening hole 491 of the vane holder 490 and the fastening hole 485 of the belt holder 480, the vane holder 490 may be combined with the belt holder 480.

The fastening member 496 may advance from the bottom to the top, and be sequentially fastened to the fastening hole 491 of the vane holder 490 and the fastening hole 485 of the belt holder 480.

A combining protrusion 493 with which the vane 400 is detachably combined may be formed in the vane holder 490. The combining protrusion 493 may include a combining shaft 494 that protrudes laterally and a departure preventing portion 495 formed in an end portion of the combining shaft 494 for preventing the vane 400 from separating.

The driving pulley 500 includes a rotation axis 501, a shaft connecting unit 503 connected to the driving shaft 531 of the motor 530 and configured to receive a driving force, and a belt combining portion 502 with which the belt 520 is combined.

The rear holder 450 rotatably supports the driving pulley 500 and is combined with a rear end portion of the rail 440. The rear holder 450 includes a pulley support surface 451 configured to support the rotation axis 501 of the driving pulley 500, a rail support surface 452 configured to support the rear end portion of the rail 440, and the fastening hole 453 to be combined with the bottom plate cover 600.

The idle pulley 510 includes a rotation axis 511 and a belt combining portion 512 with which the belt 520 is combined.

The front holder 460 includes a front top holder 461, a front bottom holder 465 combined with a lower part of the front top holder 461, and a pulley bracket 467 that is movably provided between the front top holder 461 and the front bottom holder 465 in a lengthwise direction of the rail 440 and rotatably supports the idle pulley 510.

The front top holder 461 includes a pulley support surface 462 configured to support the rotation axis 511 of the idle pulley 510 and a rail support surface 463 configured to support the front end portion of the rail 440.

The front bottom holder 465 may be combined with the lower part of the front top holder 461 by a locking structure. The front bottom holder 465 may include a combining protrusion 466 to be combined with the bottom plate 35 of the washing tank 30.

The pulley bracket 467 includes a pulley support surface 468 configured to support the rotation axis 511 of the idle pulley 510.

Meanwhile, the rail 440, the belt 520, the driving pulley 500, the rear holder 450, the idle pulley 510, and the front holder 460 may be assembled to each other by tension of the belt 520.

That is, due to tension of the belt 520, the driving pulley 500 is pressed closer to the rail 440. This force is delivered to the rear holder 450 through the pulley support surface 451 of the rear holder 450. As a result, the rear holder 450 is combined in close contact with the rear end portion of the rail 440.

Also, due to tension of the belt 520, the idle pulley 510 is pressed closer to the rail 440. This force is delivered to the front holder 460 through the pulley support surface 462 of the front holder 460. As a result, the front holder 460 is combined in close contact with the front end portion of the rail 440.

Meanwhile, the front holder 460 may further include an elastic member 470 for maintaining tension of the belt 520. This is because, when the belt 520 thermally expands due to heat inside the washing tank 30, the belt 520 loosens and tension of the belt 520 decreases, and when tension of the belt 520 decreases, the vane 400 may not be driven smoothly.

One end portion of the elastic member 470 may be supported by the front holder 460 and the other end portion of the elastic member 470 may be supported by the pulley bracket 467. For this purpose, elastic member support surfaces 464 and 469 may be formed in the front holder 460 and the pulley bracket 467, respectively.

The elastic member 470 may be a compression spring. Since the front holder 460 is supported in the rail 440 by the rail support surface 463, an elastic force of the elastic member 470 may be applied to the pulley bracket 467. That is, due to the elastic force of the elastic member 470, the pulley bracket 467 may be pressed away from the rail 440.

In this case, since the pulley bracket 467 is pressed closer to the rail 440 due to tension of the belt 520, the pulley bracket 467 may move to a position at which tension of the belt 520 and the elastic force of the elastic member 470 are balanced.

That is, when the belt 520 looses, tension decreases, and the elastic force of the elastic member 470 is greater than the tension of the belt 520, the pulley bracket 467 moves away from the rail 440 due to the elastic force of the elastic member 470. When the pulley bracket 467 moves away from the rail 440 in this manner, the belt 520 is fastened tautly again and the tension of the belt 520 is recovered.

According to such a configuration, even when the belt 520 loosens due to thermal expansion, the pulley bracket 467 is moved to fasten the belt 520. Therefore, the tension of the belt 520 may be constantly maintained and reliability of the driving device 420 may be improved.

An assembly sequence of the rail assembly 430 of the dish washing machine according to the embodiment of the present invention will be described.

As illustrated in FIG. 22, the belt holder 480 is combined with the belt 520.

As illustrated in FIG. 23, an assembly of the belt 520 and the belt holder 480 is disposed in the internal space 441 of the rail 440. Next, the vane holder 490 is combined with the assembly of the belt 520 and the belt holder 480 through the fastening member 496.

As illustrated in FIG. 24, the rear holder 450 is assembled in the rear end portion of the rail 440 in a lengthwise direction. Next, the driving pulley 500 is combined with the belt 520.

As illustrated in FIG. 26, the front top holder 461 is combined with the front end portion of the rail 440 in a lengthwise direction. Next, the belt 520, the idle pulley 510, the pulley bracket 467, and the elastic member 470 are combined. Next, the assembly of the belt 520, the idle pulley 510, the pulley bracket 467, and the elastic member 470 is pushed into the front top holder 461. Next, the front bottom holder 465 is combined with the front top holder 461.

Figure 28:
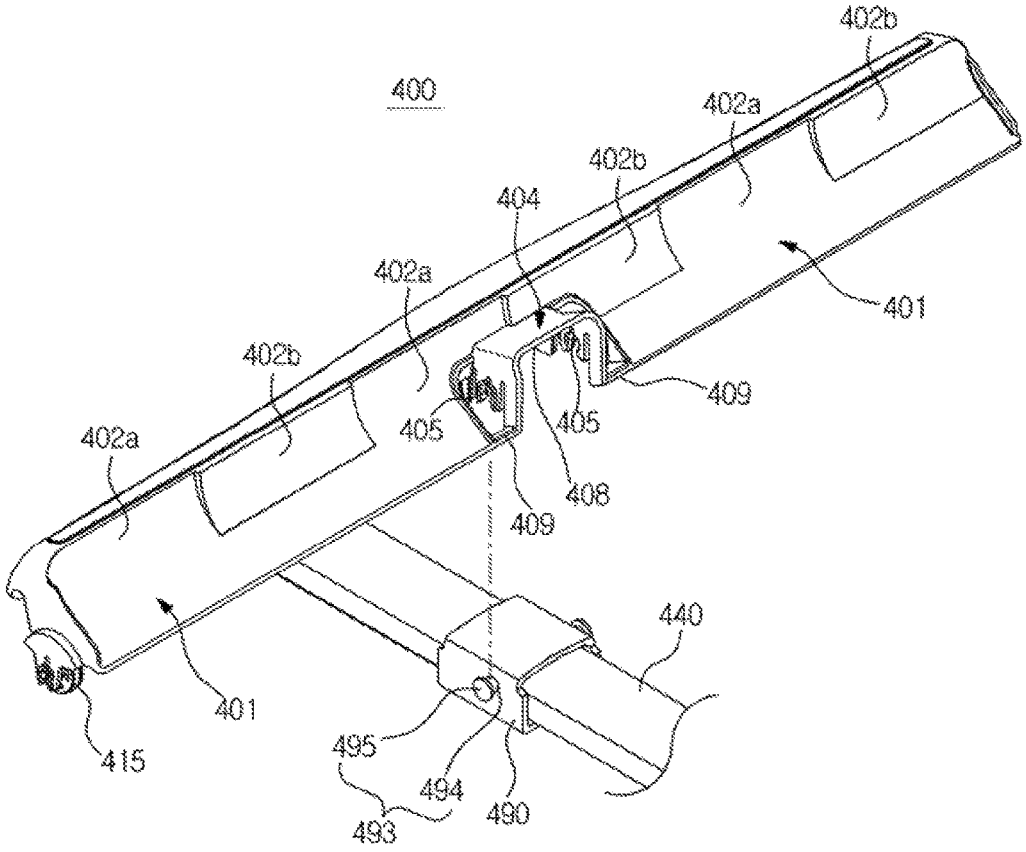
FIG. 28 is a diagram illustrating the vane and the vane holder of the dish washing machine in FIG. 1.
Figure 29:
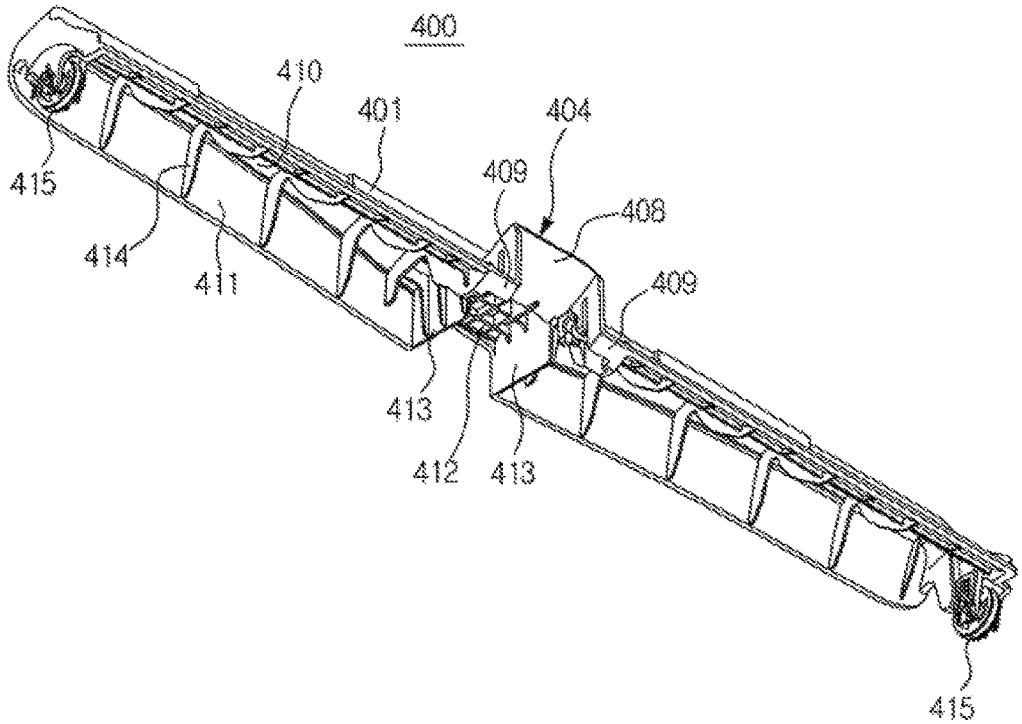
FIG. 29 is a perspective view of the vane of the dish washing machine in FIG. 1.
Figure 30:
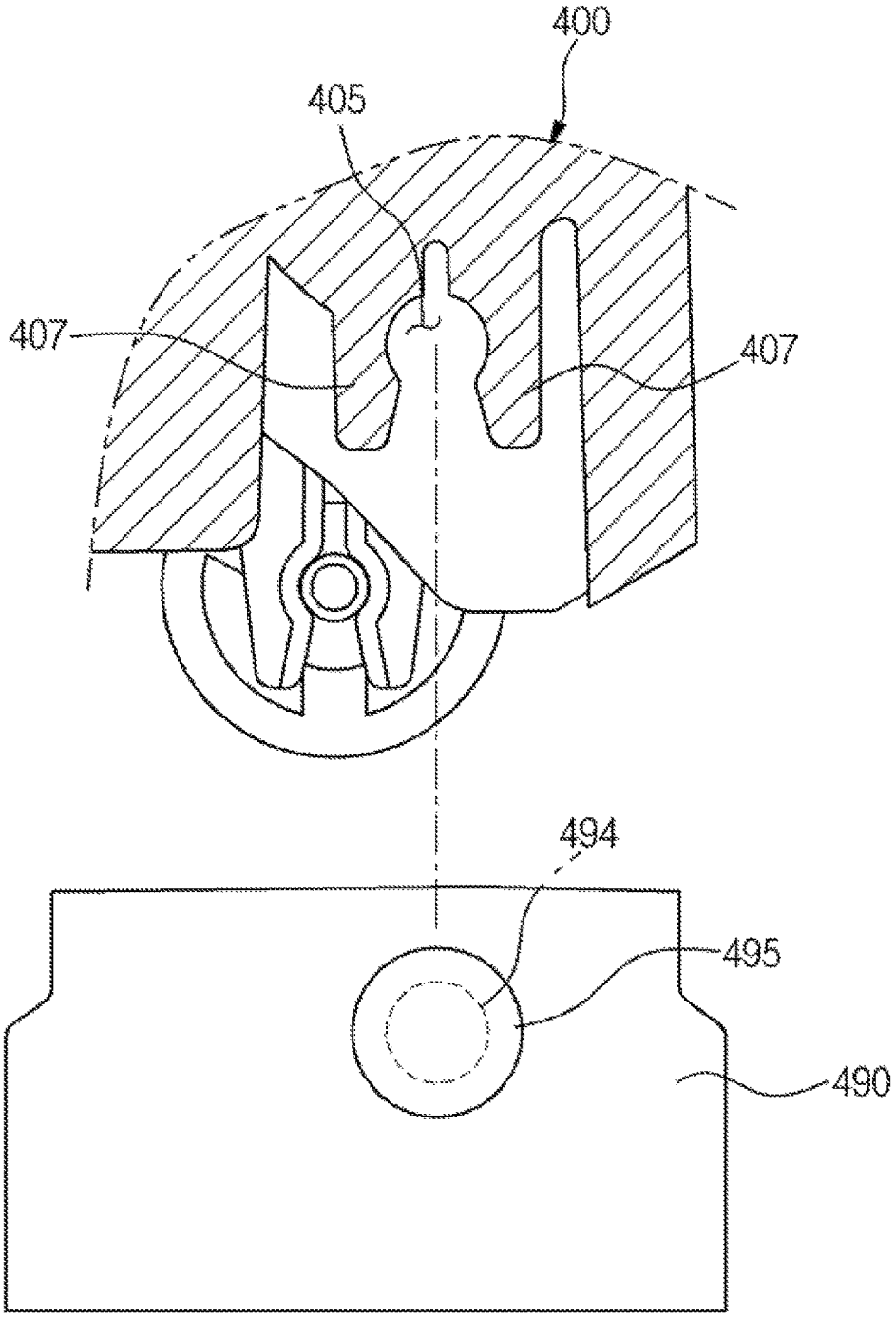
FIG. 30 is an enlarged view of the vane and a part of the vane holder of the dish washing machine in FIG. 1.

FIG. 28 is a diagram illustrating the vane and the vane holder of the dish washing machine in FIG. 1. FIG. 29 is a perspective view of the vane of the dish washing machine in FIG. 1. FIG. 30 is an enlarged view of the vane and a part of the vane holder of the dish washing machine in FIG. 1.

The vane according to the embodiment of the present invention will be described with reference to FIGS. 28 to 30.

The vane 400 may be provided to extend in a direction perpendicular to the rail 440.

The vane 400 may include a reflection portion 401 configured to reflect washing water jetted from the fixed nozzle assembly 320, an upper support portion 410 bent at the reflection portion 401, a back support portion 411 bent at the upper support portion 410, a cap portion 404 provided at a center portion of the reflection portion 401 in a lengthwise direction, a rotation locking portion 409 provided to be interfered with by the rotation guide 610 (FIG. 31) of the bottom plate cover 600, a reinforcing rib 414 provided to reinforce strengths of the reflection portion 401, the upper support portion 410, and the back support portion 411, a horizontal support portion 412 supported by a top surface of the vane holder 490, and a vertical support portion 413 supported by a side surface of the vane holder 490.

The reflection portion 401 includes reflection surfaces 402*a* and 402*b* provided to be inclined to reflect washing water. The reflection surfaces 402*a* and 402*b* may include the reflection surface 402*a* and the reflection surface 402*b* that have different inclinations to reflect washing water at different angles and are alternately arranged in a lengthwise direction.

The cap portion 404 may include a combining groove 405 for combining with the vane holder 490 and a rotation stopper portion 408 configured to restrict a rotation range of the vane 400 when the vane 400 rotates by the rotation guide 610 of the bottom plate cover 600.

The combining protrusion 493 of the vane holder 490 may be combined with the combining groove 405 of the vane 400. Specifically, the combining shaft 494 of the combining protrusion 493 may be inserted into the combining groove 405 of the vane 400. The combining shaft 494 may rotatably support the vane 400.

As illustrated in FIG. 30, the combining groove 405 of the vane 400 may be formed by elastic hooks 407. The elastic hooks 407 may be elastically deformed in a separation direction again in a process of pushing or removing the combining shaft 494 of the vane holder 490 into or from the combining groove 405 of the vane 400, and when insertion or separation is completed, may be restored to its original state. According to such a configuration, the vane 400 may be mounted in or detached from the vane holder 490.

Rollers 415 configured to smoothly move the vane 400 may be provided in both end portions of the vane 400 in a lengthwise direction. A roller support portion 39 (FIG. 47) configured to support the rollers 415 may be provided in the bottom plate 35 of the washing tank 30.

Figure 31:
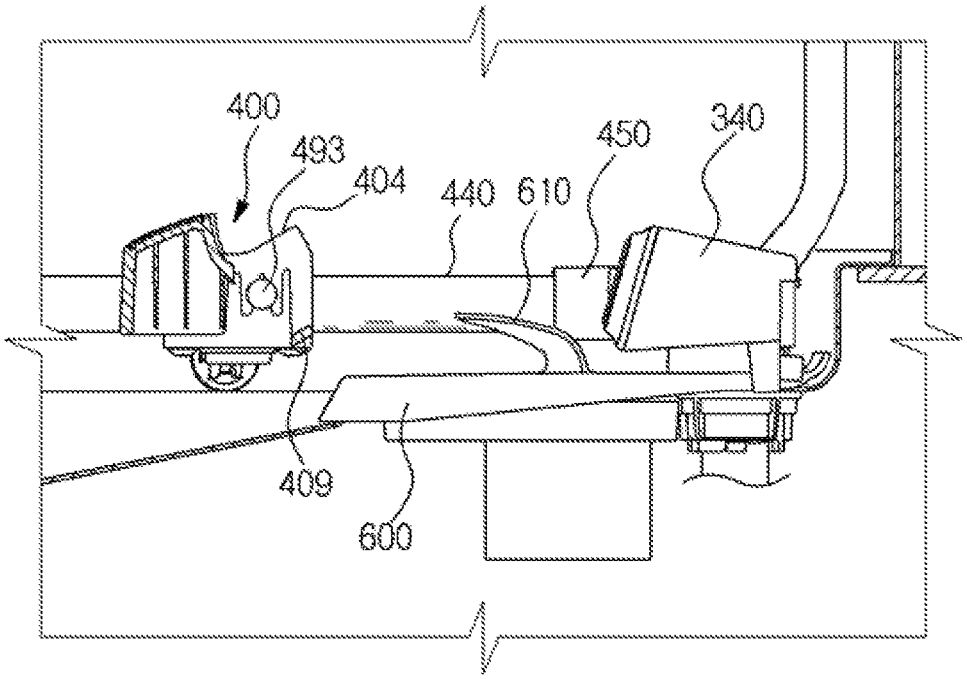
FIGS. 31 to 33 are diagrams illustrating an operation in which the vane of the dish washing machine in FIG. 1 rotates.
Figure 32:
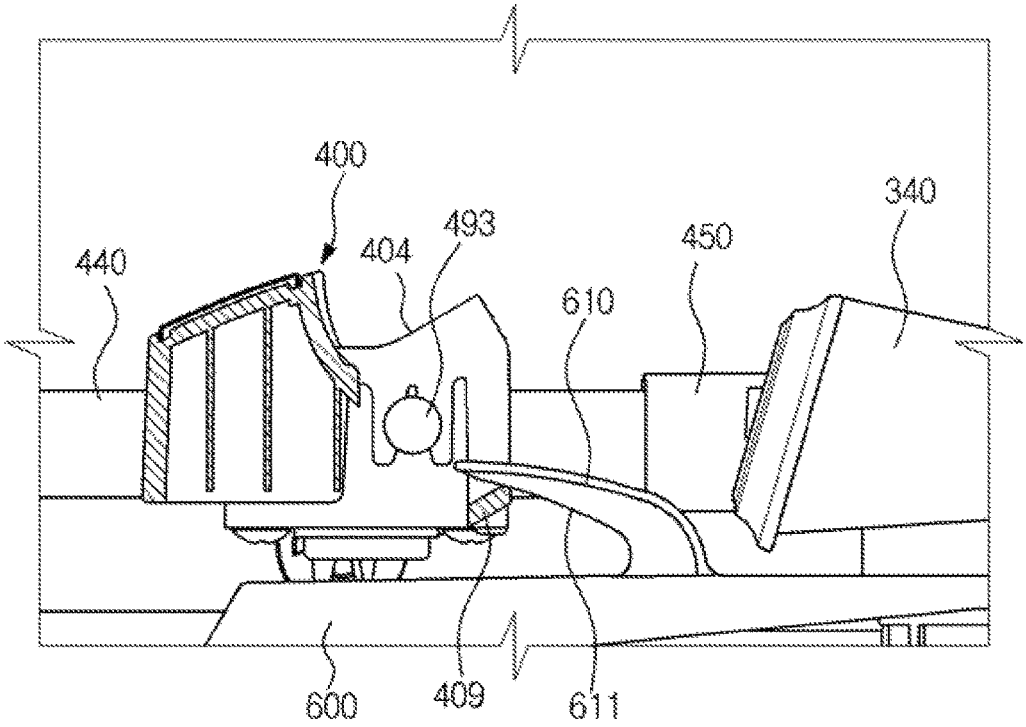
Figure 33:
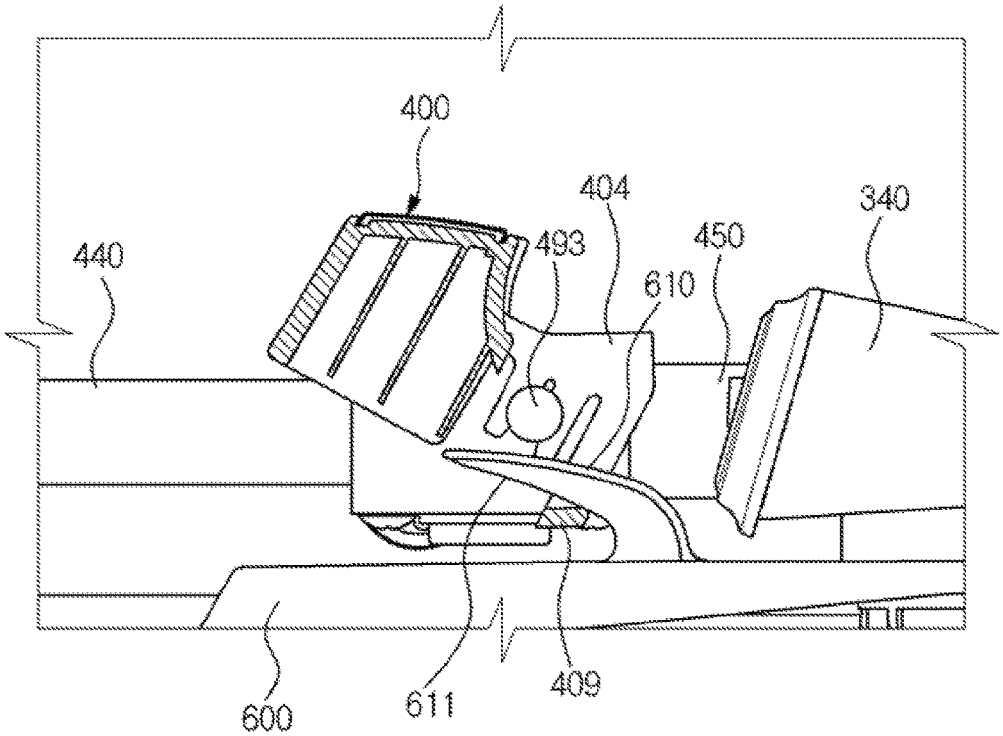
Figure 34:
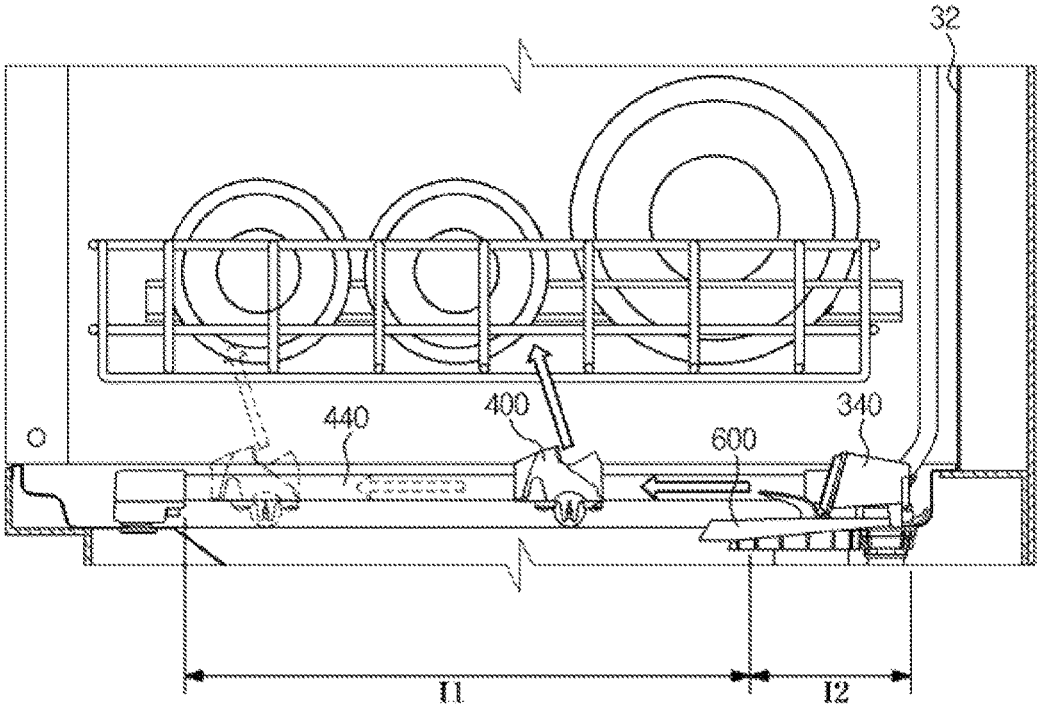
FIG. 34 is a diagram illustrating an operation in which the vane reflects washing water in a vane movement section of the dish washing machine in FIG. 1.
Figure 35:
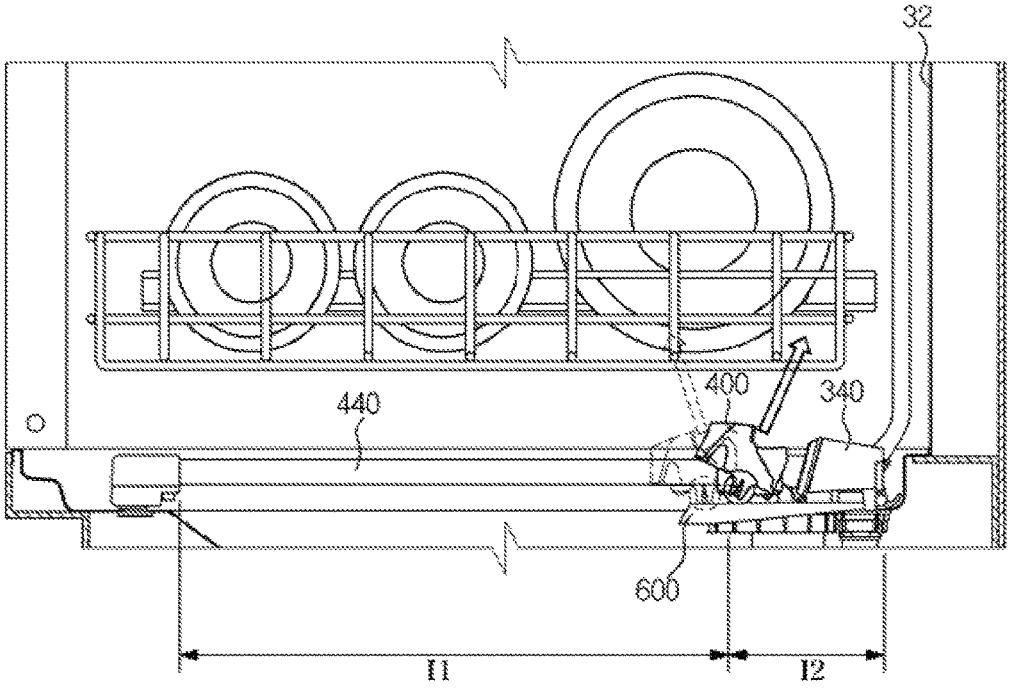
FIG. 35 is a diagram illustrating an operation in which the vane reflects washing water in a vane non-movement section of the dish washing machine in FIG. 1.

FIGS. 31 to 33 are diagrams illustrating an operation in which the vane of the dish washing machine in FIG. 1 rotates. FIG. 34 is a diagram illustrating an operation in which the vane reflects washing water in a vane movement section of the dish washing machine in FIG. 1. FIG. 35 is a diagram illustrating an operation in which the vane reflects washing water in a vane non-movement section of the dish washing machine in FIG. 1.

A movement section, a non-movement section, and a rotating operation of the vane according to the embodiment of the present invention will be described with reference to FIGS. 31 to 35.

In the dish washing machine 1 according to the embodiment of the present invention, the vane 400 reflects washing water jetted from the fixed jet nozzles 320 toward a dish. Since the fixed jet nozzles 320 jet washing water in an approximately horizontal direction, the fixed jet nozzles 320 and the vane 400 may be approximately horizontally positioned to each other. Therefore, the vane 400 may not move in an area in which the fixed jet nozzles 320 are disposed.

That is, the dish washing machine 1 includes a vane movement section I1 in which the vane 400 may move and a vane non-movement section I2 in which the vane 400 may not move.

The vane 400 of the dish washing machine 1 according to the embodiment of the present invention may be rotatably provided to wash a dish accommodated in the vane non-movement section I2.

As described above, the rotation guide 610 protruding to guide movement of the vane 400 is formed in the bottom plate cover 600, and the rotation locking portion 409 to be interfered with by the rotation guide 610 is formed in the vane 400. The rotation locking portion 409 is formed in a portion higher than the combining protrusion 493 of the vane holder 490 that forms a rotation axis of the vane 400 and delivers a driving force to the vane 400.

The rotation guide 610 includes a guide surface 611 with which the rotation locking portion 409 comes in contact and that is formed in a curved surface such that the vane 400 smoothly rotates.

When the vane 400 reaches the vane non-movement section I2 from the vane movement section I1 to, if the rotation locking portion 409 of the vane 400 is interfered with by the guide surface 611 of the rotation guide 610 of the bottom plate cover 600, the vane 400 rotates around the combining protrusion 493 of the vane holder 490. Therefore, washing water may be reflected toward a dish in the non-movement section I2.

Figure 36:
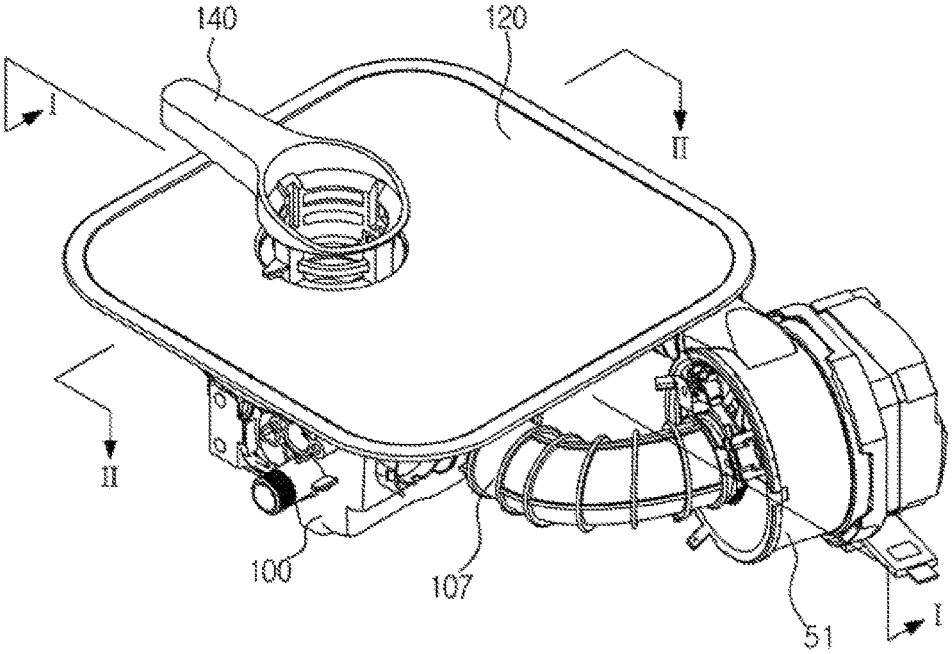
FIG. 36 is a diagram illustrating a sump, a coarse filter, and a fine filter of the dish washing machine in FIG. 1.
Figure 37:
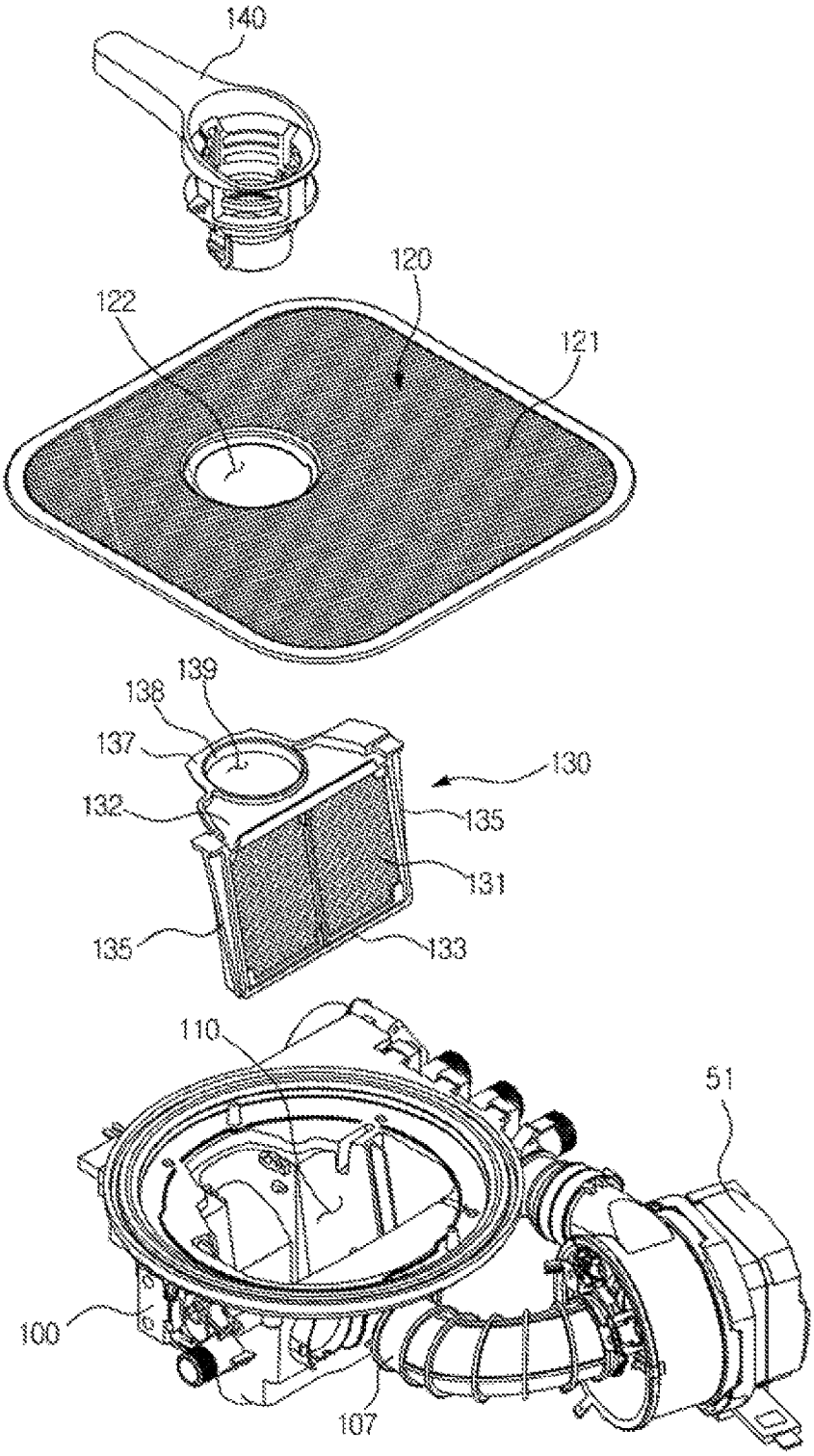
FIG. 37 is an exploded diagram illustrating the sump, the coarse filter, the fine filter, and a micro filter of the dish washing machine in FIG. 1.
Figure 38:
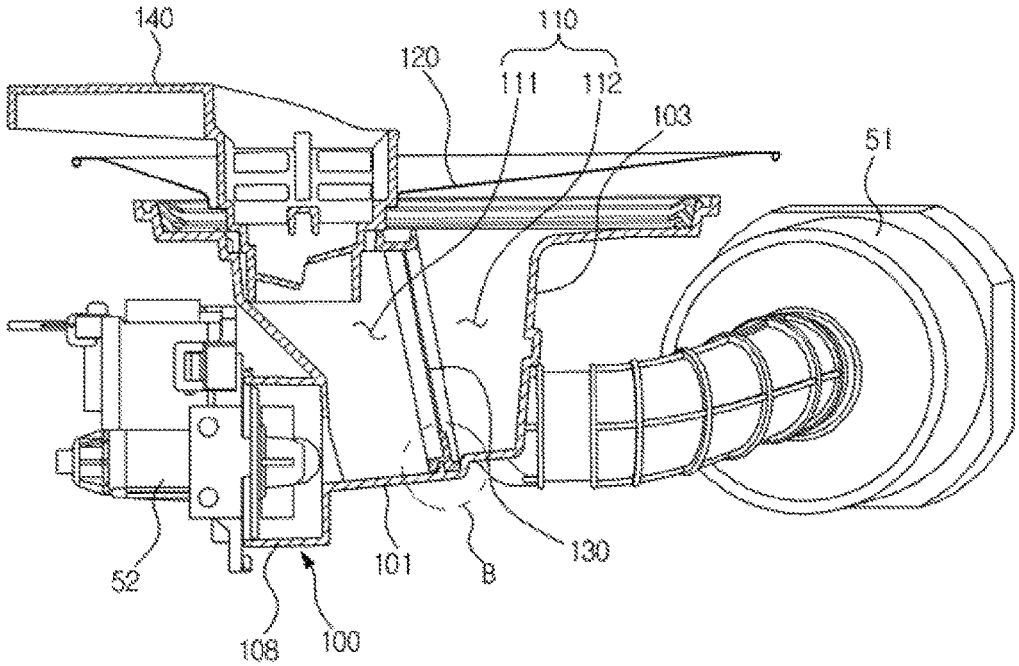
FIG. 38 is a cross sectional view taken along the line I-I in FIG. 36.
Figure 39:
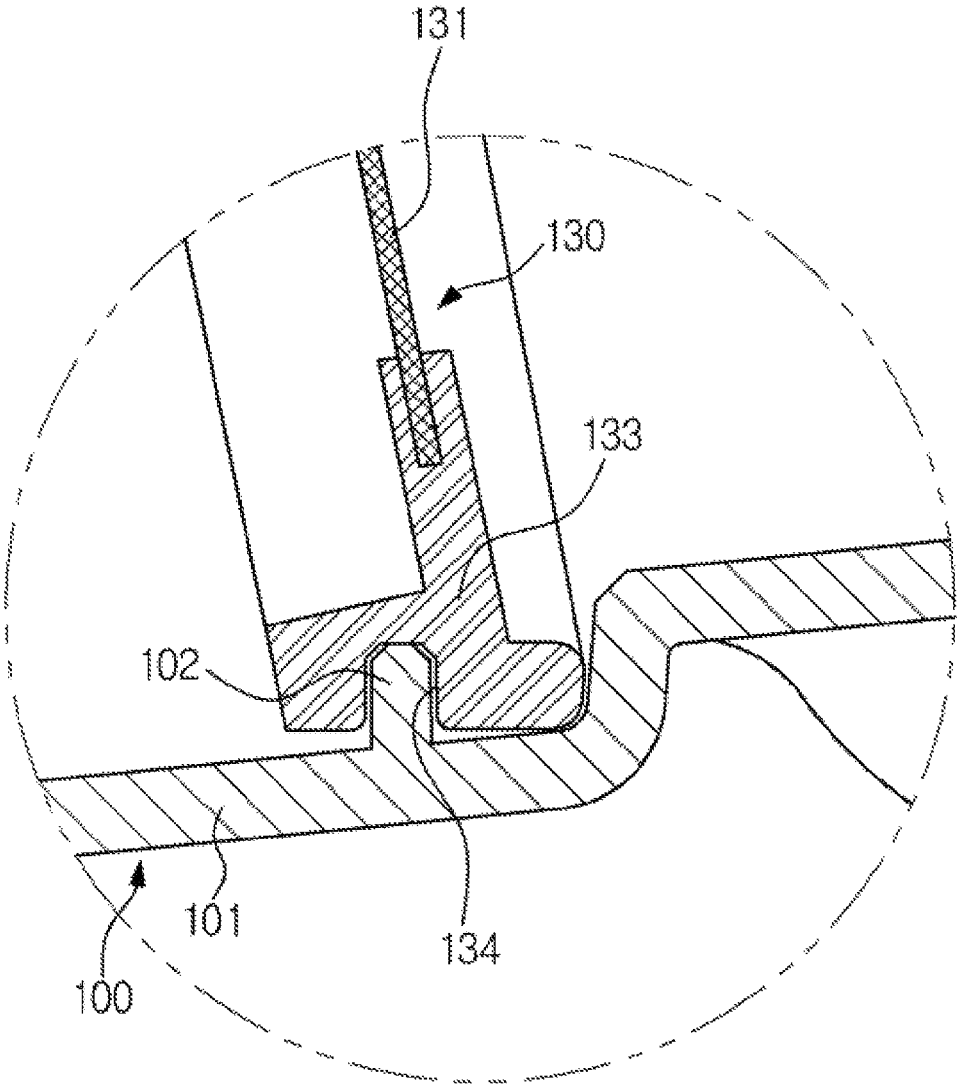
FIG. 39 is an enlarged view of the part B in FIG. 38.
Figure 40:
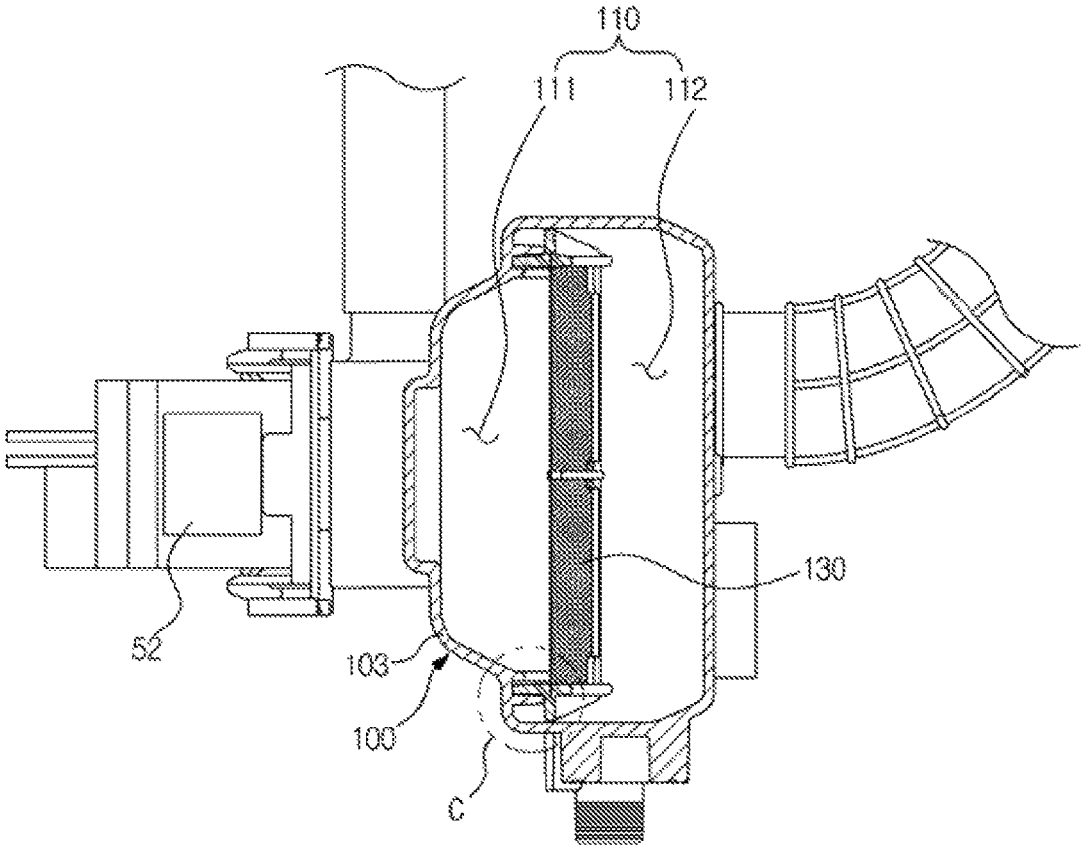
FIG. 40 is a cross sectional view taken along the line II-II in FIG. 38.
Figure 41:
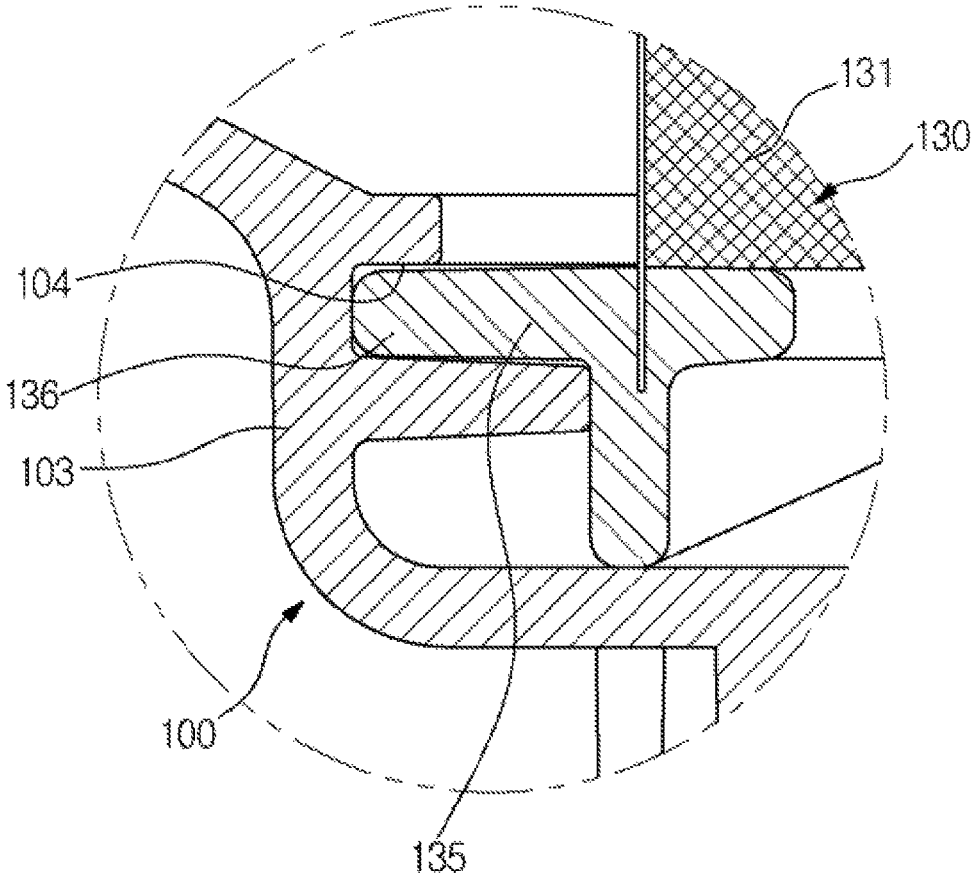
FIG. 41 is an enlarged view of the part C in FIG. 40.
Figure 42:
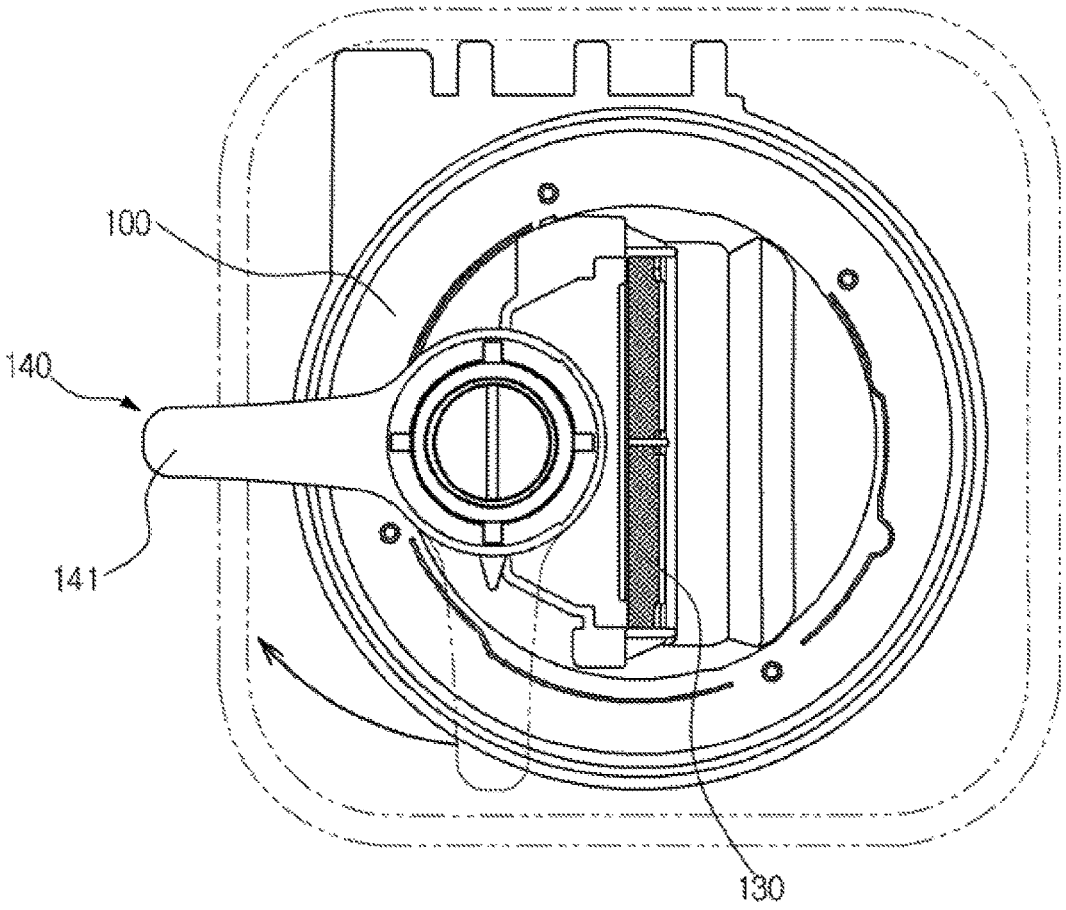
FIG. 42 is a plan view of the sump and the coarse filter of the dish washing machine in FIG. 1 and is a diagram illustrating a locking operation of the coarse filter.
Figure 43:
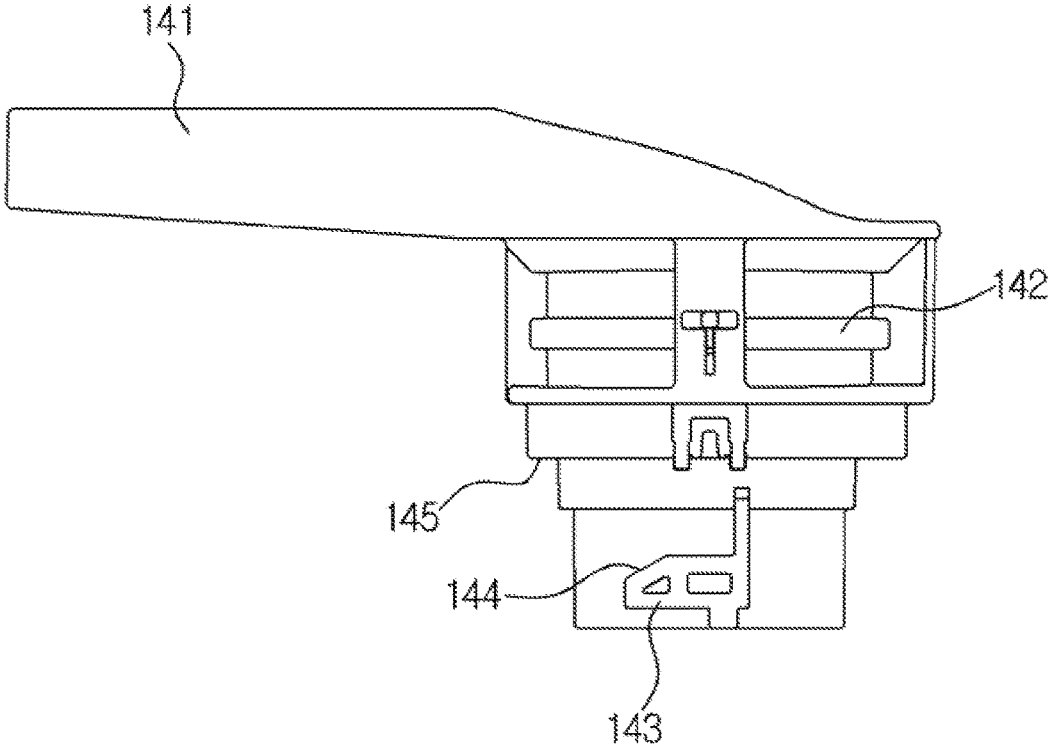
FIG. 43 is a side view of the coarse filter of the dish washing machine in FIG. 1.
Figure 44:
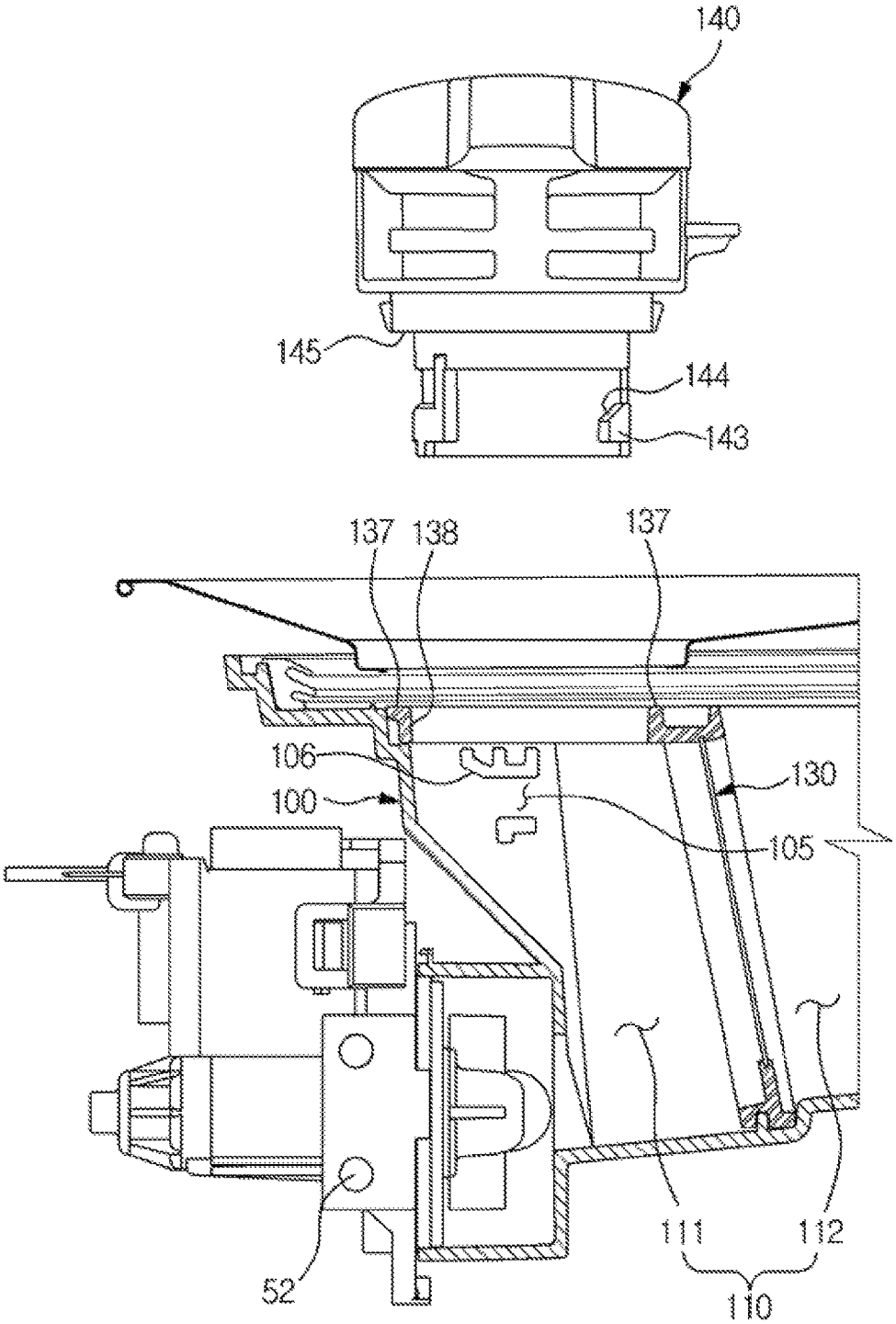
FIG. 44 is a diagram illustrating the sump and the coarse filter of the dish washing machine in FIG. 1 and is a diagram illustrating a locking operation of the coarse filter.
Figure 45:
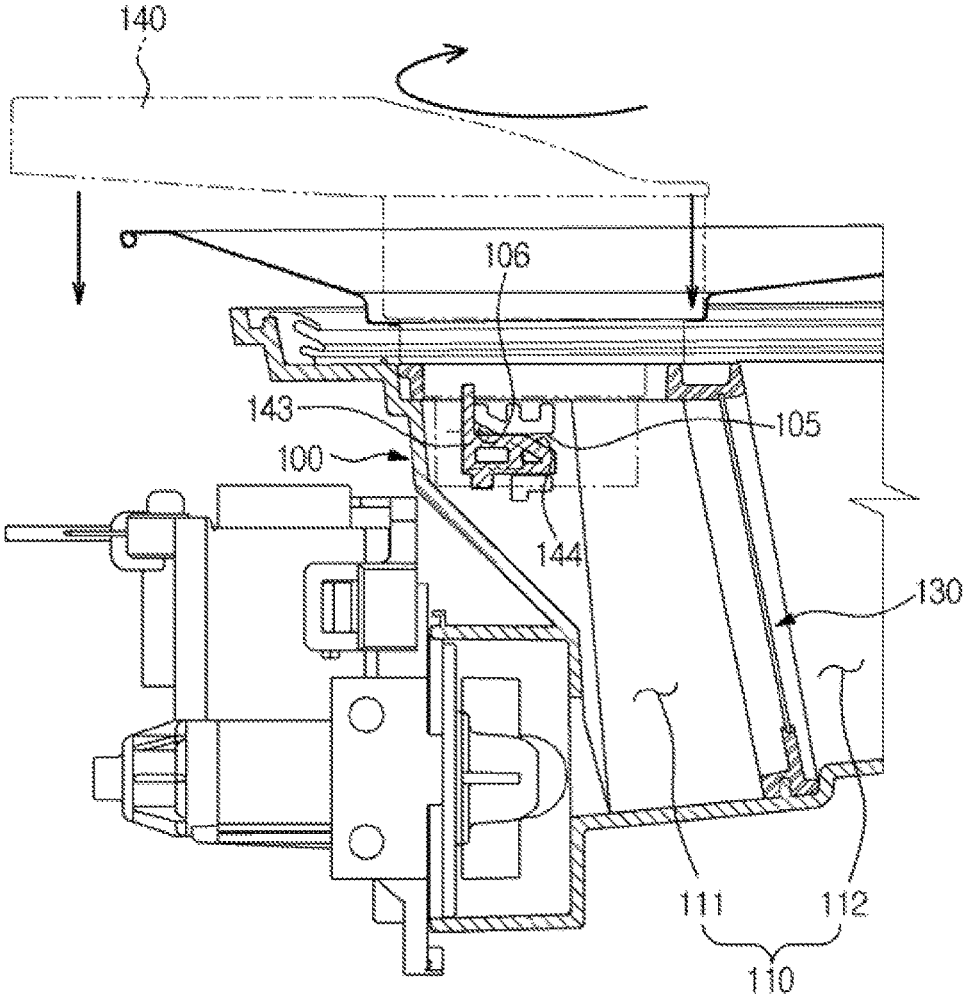
FIG. 45 is a cross sectional view of the sump, the coarse filter, and the micro filter of the dish washing machine in FIG. 1.
Figure 46:
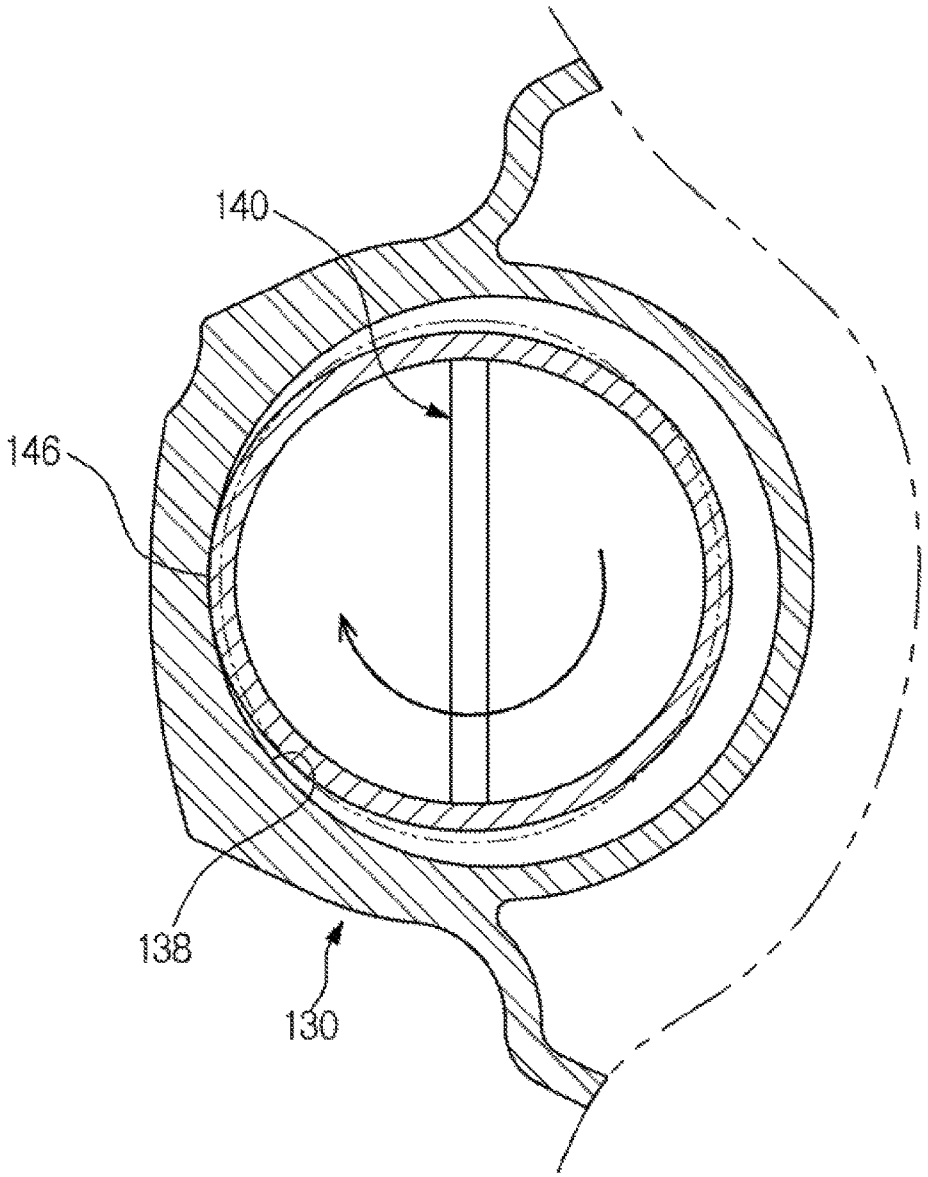
FIG. 46 is a plan view of an enlarged part of the micro filter and the coarse filter of the dish washing machine in FIG. 1.
Figure 47:
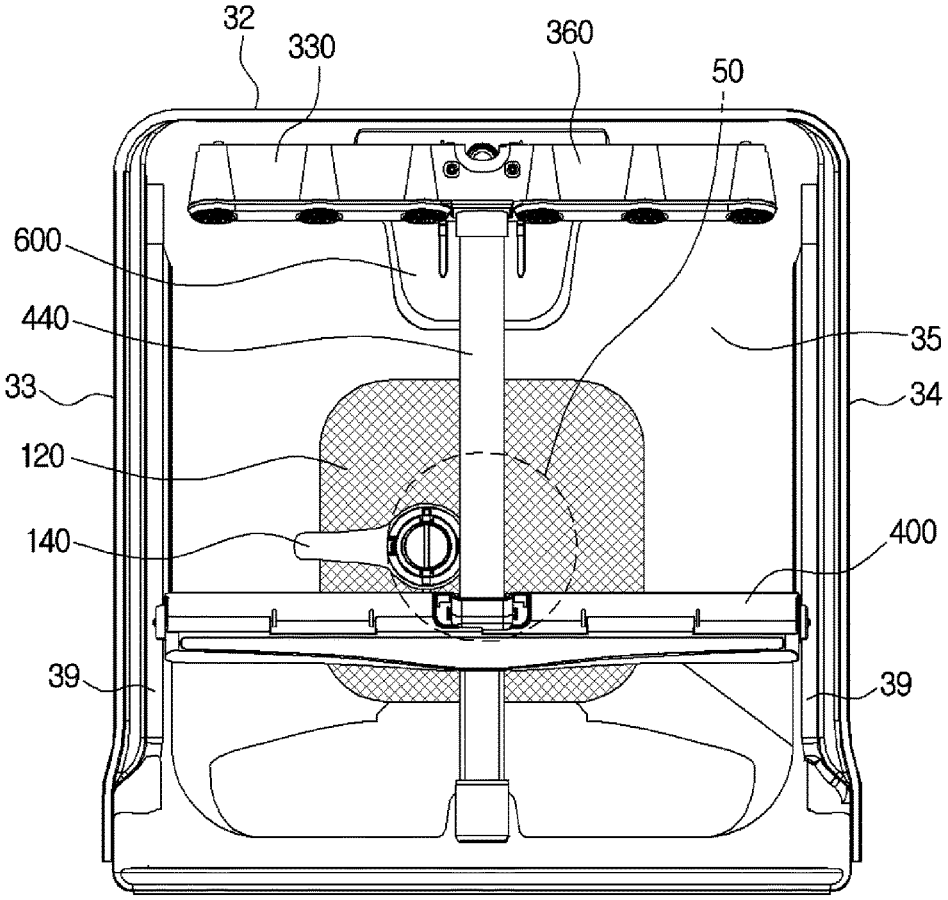
FIG. 47 is a plan view of a lower part of the washing tank of the dish washing machine in FIG. 1.

FIG. 36 is a diagram illustrating a sump, a coarse filter, and a fine filter of the dish washing machine in FIG. 1. FIG. 37 is an exploded diagram illustrating the sump, the coarse filter, the fine filter, and a micro filter of the dish washing machine in FIG. 1. FIG. 38 is a cross sectional view taken along the line I-I in FIG. 36. FIG. 39 is an enlarged view of the part B in FIG. 38. FIG. 40 is a cross sectional view taken along the line II-II in FIG. 38. FIG. 41 is an enlarged view of the part C in FIG. 40. FIG. 42 is a plan view of the sump and the coarse filter of the dish washing machine in FIG. 1 and is a diagram illustrating a locking operation of the coarse filter. FIG. 43 is a side view of the coarse filter of the dish washing machine in FIG. 1. FIG. 44 is a diagram illustrating the sump and the coarse filter of the dish washing machine in FIG. 1 and is a diagram illustrating a locking operation of the coarse filter. FIG. 45 is a cross sectional view of the sump, the coarse filter, and the micro filter of the dish washing machine in FIG. 1. FIG. 46 is a plan view of an enlarged part of the micro filter and the coarse filter of the dish washing machine in FIG. 1. FIG. 47 is a plan view of a lower part of the washing tank of the dish washing machine in FIG. 1.

The dish washing machine 1 according to the embodiment of the present invention includes the sump 100 configured to store washing water, the circulation pump 51 configured to circulate washing water of the sump 100 to the jet nozzles 311, 313, and 320, the drainage pump 52 configured to discharge washing water of the sump 100 to the outside of the main body 10 along with contaminants, and filters 120, 130, and 140 configured to filter contaminants included in washing water.

A drain hole 50 (FIG. 47) configured to drain washing water to the sump 100 is formed in the bottom plate 35 of the washing tank 30. The bottom plate 35 of the washing tank 30 may be inclined toward the drain hole 50 such that washing water is guided toward the drain hole 50 due to its own weight.

The sump 100 may have an approximately hemispherical shape whose top surface is opened. The sump 100 includes a bottom portion 101, a side wall portion 103, a reservoir chamber 110 that is formed in the bottom portion 101 and the side wall portion 103 and in which washing water is stored, a circulation port 107 to which the circulation pump 51 is connected, and a drain port 108 to which the drainage pump 52 is connected.

The filters 120, 130, and 140 include the fine filter 120 mounted in the drain hole 50 of the bottom plate 35 and the coarse filter 140, and the micro filter 130 mounted in the sump 100.

The coarse filter 140 may have an approximately cylindrical shape. The coarse filter 140 may be mounted in an inside surface of the side wall portion 103 of the sump 100.

The coarse filter 140 may include a filter unit 142 configured to filter a relatively large-sized contaminant and a knob 141 configured to mount the coarse filter 140. The filter unit 142 of the coarse filter 140 may be formed in a circumferential surface of the coarse filter 140.

The coarse filter 140 passes through a through-hole 139 of the micro filter 130 and a through-hole 122 of the fine filter, and is mounted in the sump 100. An upper part of the coarse filter 140 protrudes into the washing tank 30 and a lower part thereof protrudes toward a contaminant collecting chamber 111 of the sump 100. The contaminant collecting chamber 111 will be described below.

The fine filter 120 may include a filter unit 121 configured to filter a relatively medium-sized contaminant and the through-hole 122 through which the coarse filter 140 passes. The fine filter 120 may be approximately horizontally mounted above the drain hole 50 of the bottom plate 35 of the washing tank 30. The fine filter 120 may be inclined such that washing water is guided toward the through-hole 122 due to its own weight.

Washing water of the washing tank 30 may flow toward the coarse filter 140 according to the inclination of the fine filter 120. However, some washing water and contaminant may pass through the filter unit 121 of the fine filter 120 and directly flow to the reservoir chamber 110 of the sump 100.

The micro filter 130 may include a filter unit 131 configured to filer a relatively small-sized contaminant and having a flat shape, frames 132, 133, and 135 configured to support the filter unit 131, and the through-hole 139 through which the coarse filter 140 passes.

The frames 132, 133, and 135 include the upper frame 132, the lower frame 133, and the side frames 135. The micro filter 130 is mounted in the sump 100 such that the lower frame 133 comes in close contact with the bottom portion 101 of the sump 100 and the side frames 135 come in close contact with the side wall portion 103 of the sump 100.

The micro filter 130 may divide the reservoir chamber 110 of the sump 100 into the contaminant collecting chamber 111 and a circulation chamber 112. The drainage pump 52 is connected to the contaminant collecting chamber 111, and the circulation pump 51 is connected to the circulation chamber 112.

As described above, since the coarse filter 140 has a lower part that protrudes toward the contaminant collecting chamber 111, washing water that has passed through the coarse filter 140 and contaminants included in washing water are introduced into the contaminant collecting chamber 111.

Washing water introduced into the contaminant collecting chamber 111 may pass through the micro filter 130 and flow to the circulation chamber 112. However, contaminants included in washing water introduced into the contaminant collecting chamber 111 are difficult to pass through the micro filter 130, do not flow to the circulation chamber 112, and remain directly in the contaminant collecting chamber 111.

When the drainage pump 52 is operated, contaminants collected in the contaminant collecting chamber 111 may be discharged to the outside the main body 10 along with washing water.

Meanwhile, the micro filter 130 should be come in close contact with the bottom portion 101 and the side wall portion 103 of the sump 100 to prevent contaminants of the contaminant collecting chamber 111 from flowing to the circulation chamber 112 through a gap between the micro filter 130 and the sump 100.

For this purpose, a lower sealing groove 134 may be formed in the lower frame 133 of the micro filter 130, and a side sealing protrusion 136 may be formed in the side frame 135. To correspond thereto, a lower sealing protrusion 102 to be inserted into the lower sealing groove 134 may be formed in the bottom portion 101 of the sump 100, and a side sealing groove 104 into which the side sealing protrusion 136 is inserted may be formed in the side wall portion 103 of the sump 100.

According to the lower and side protrusions and the groove structure in this manner, sealing of the micro filter 130 and the sump 100 may be reinforced.

Meanwhile, the coarse filter 140 may be vertically inserted downward into the sump 100, rotate from an unlocking position to a locking position, and be mounted in the sump 100.

For this purpose, a mounting protrusion 143 is formed in an outer circumferential surface of the coarse filter 140. A mounting groove 105 into which the mounting protrusion 143 is horizontally inserted when the coarse filter 140 rotates from the unlocking position to the locking position may be formed in an inside surface of the side wall portion 103 of the sump 100.

The mounting protrusion 143 may include an upward inclined surface 144 that moves upward in a direction in which the coarse filter 140 rotates from the unlocking position to the locking position. The mounting groove 105 may include a downward inclined surface 106 that moves downward in the direction in which the coarse filter 140 rotates from the unlocking position to the locking position.

According to such a structure, when the coarse filter 140 rotates from the unlocking position to the locking position, the upward inclined surface 144 of the mounting protrusion 143 may slide the downward inclined surface 106 of the mounting groove 105 and therefore the coarse filter 140 may move downward.

The coarse filter 140 may move downward and press the micro filter 130 downward while rotating from the unlocking position to the locking position. For this purpose, the coarse filter 140 may include a lower pressing surface 145 that is horizontally formed to press the micro filter 130 downward. The micro filter 130 may include a lower corresponding surface 137 that is horizontally formed to be pressed by the lower pressing surface 145.

In this manner, by pressing the micro filter 130 downward when the coarse filter 140 rotates from the unlocking position to the locking position, sealing of the lower frame 133 of the micro filter 130 and the bottom portion 101 of the sump 100 may be further reinforced and a deviation of the micro filter 130 may be prevented.

Also, the coarse filter 140 may include a lateral pressing surface 146 that is formed by some of the outer circumferential surface that expands outward in the radial direction such that the micro filter 130 is laterally pressed when the coarse filter 140 rotates from the unlocking position to the locking position. That is, the coarse filter 140 may have a bulging shape or an elliptic shape.

The micro filter 130 may include a lateral corresponding surface 138 that is laterally pressed by the lateral pressing surface 146.

According to such a configuration, when the coarse filter 140 rotates from the unlocking position to the locking position, the micro filter 130 is laterally pressed and sealing of the side frame 135 of the micro filter 130 and the side wall portion 103 of the sump 100 may be further reinforced.

Meanwhile, as illustrated in FIG. 47, the coarse filter 140 may be disposed to be biased to one side wall between the both side walls 33 and 34 of the washing tank 30. That is, the coarse filter 140 may be disposed closer to the left side wall 33 than the right side wall 34. According to such disposition of the coarse filter 140, the coarse filter 140 may be easily separated without inference by the rail 440 when the coarse filter 140 is separated.

Figure 48:
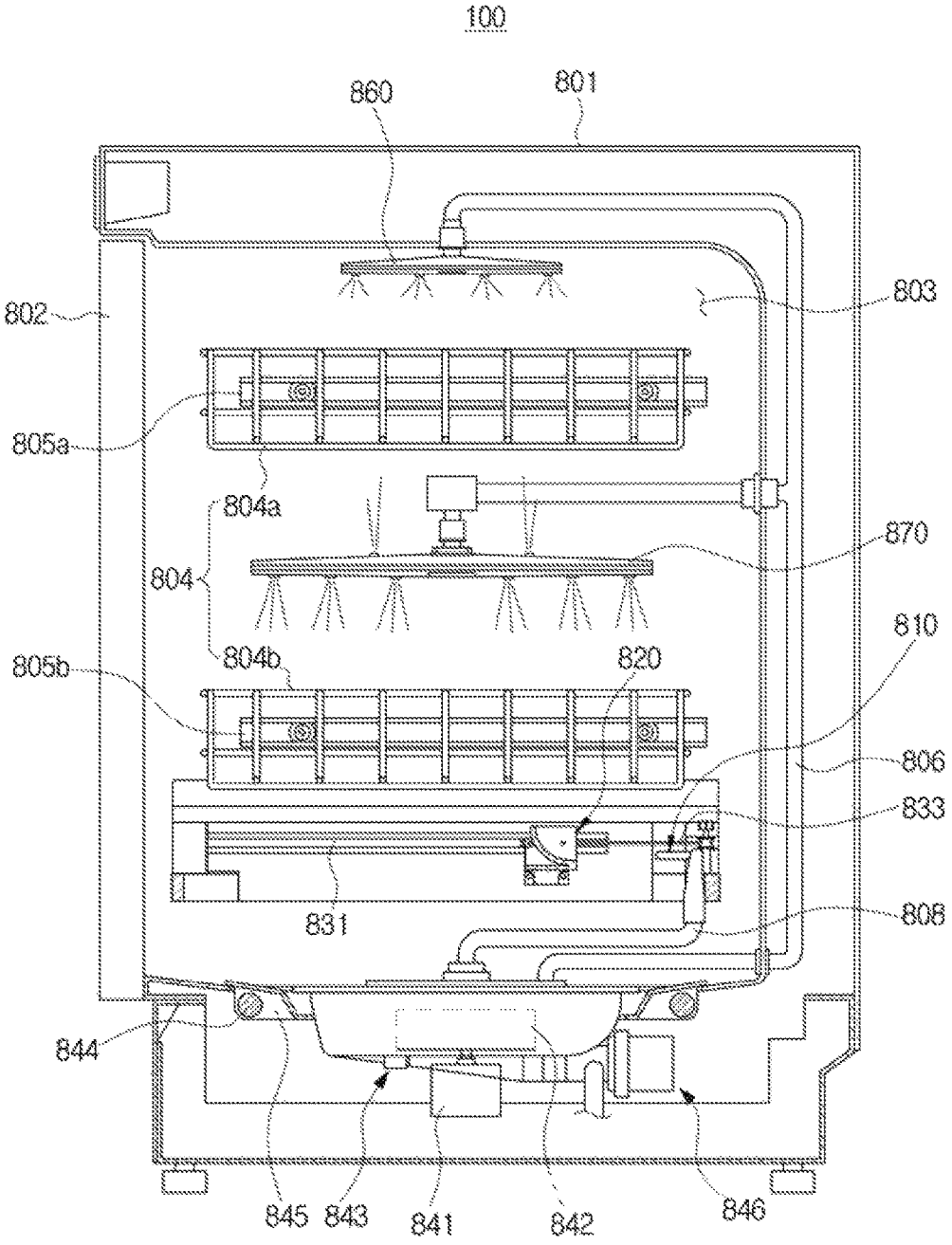
FIG. 48 is a cross sectional view of a dish washing machine according to a second embodiment of the present invention.
Figure 49:
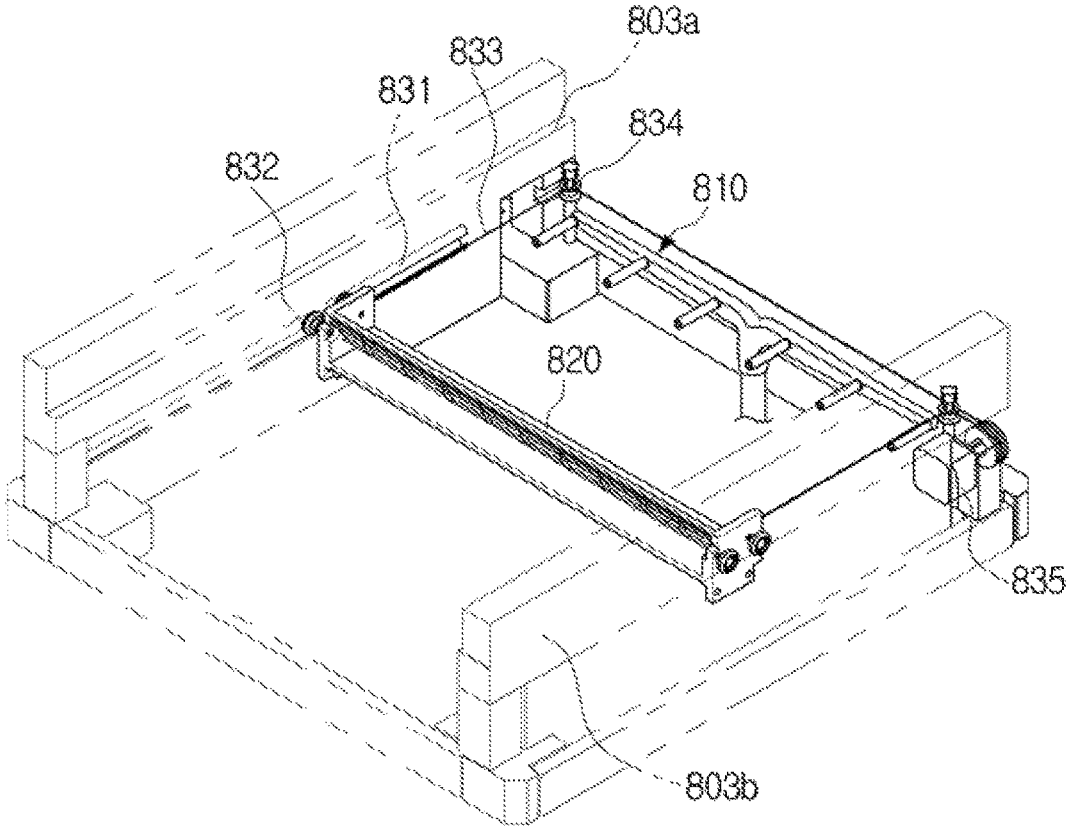
FIG. 49 is a perspective view of a jet unit and a switching unit according to the second embodiment of the present invention.
Figure 50:
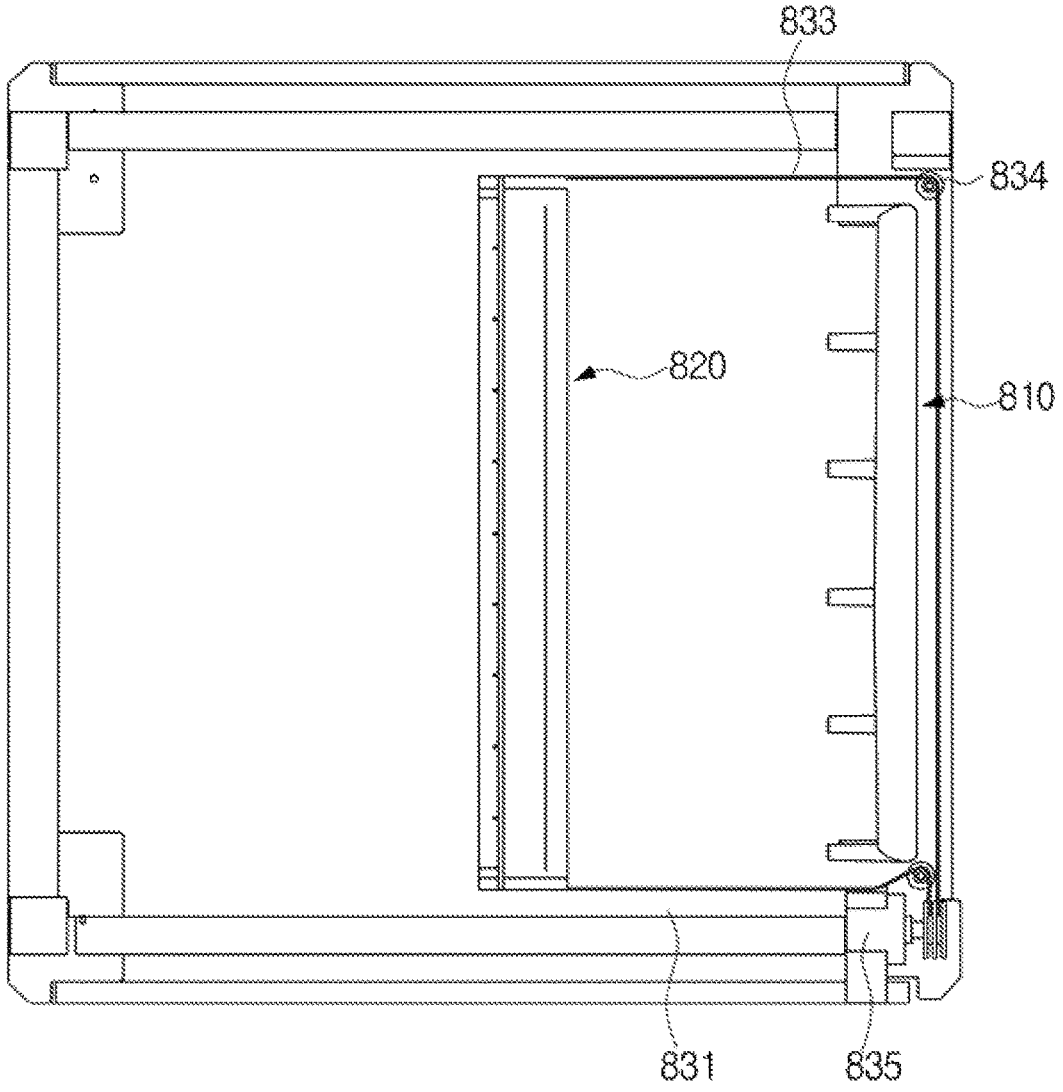
FIG. 50 is a top view of the jet unit and the switching unit according to the second embodiment of the present invention.
Figure 51:
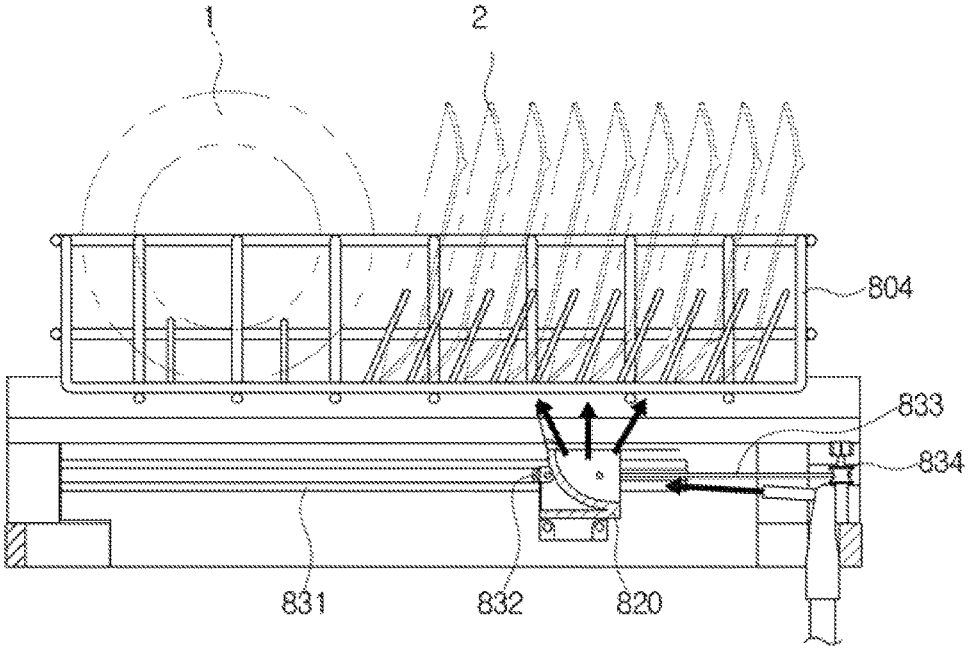
FIG. 51 is a side view of the jet unit and the switching unit according to the second embodiment of the present invention.

FIG. 48 is a cross sectional view of a dish washing machine according to a second embodiment of the present invention. FIG. 49 is a perspective view of a jet unit and a switching unit according to the second embodiment of the present invention. FIG. 50 is a top view of the jet unit and the switching unit according to the second embodiment of the present invention. FIG. 51 is a side view of the jet unit and the switching unit according to the second embodiment of the present invention.

As illustrated in FIG. 48, a dish washing machine 800 includes a cabinet 801 forming an appearance and a washing tank 803 provided inside the cabinet 801 and in which a dish is washed. A sump 843 configured to store washing water is provided below the washing tank 803.

A front surface of the cabinet 801 is opened to accommodate a dish in the washing tank 803 or remove a dish from the washing tank 803, and a door 802 is installed to open or close the washing tank 803. The door 802 is hinged to a lower part of the front surface of the cabinet 801 and rotates to open and close the washing tank 803.

In the washing tank 803, a pair of dish baskets 804 having an opened upper part and including an accommodating portion in which a dish is accommodated are installed at upper and lower portions of the washing tank 803 to be reciprocated. The dish basket 804 is removed and accommodated through the front surface of the cabinet 801 that is opened by racks 805*a* and 805*b* configured to slidably movably support the dish basket 804.

The dish basket 804 is formed by a wire disposed in a grid shape such that a dish accommodated therein is exposed to the outside of the dish basket 804 and is washed.

Jet units 810, 860, and 870 configured to jet washing water to the dish basket 804 are mounted in at least one surface of the washing tank 803.

The jet units 810, 860, and 870 are provided to jet washing water into the washing tank 803. The jet units 810, 860 and 870 are provided in at least one surface of the washing tank 803 and may be provided to jet water in at least one direction among the lower part, the upper part, and a side surface of the dish basket 804. The jet units 810, 860 and 870 may be fixed in at least one surface of the washing tank 803. Water may be jetted in a direction opposite to positions of the jet units 810, 860 and 870.

The jet units 810, 860, and 870 may be provided such that only the first jet unit 810 that is at least one among jet units forms a primary water jet and a secondary water jet. The first jet unit 810 and a switching unit 820 are positioned below a lower dish basket 804*b*. The primary water jet and the secondary water jet are formed by the first jet unit 810 and the switching unit 820 to wash a dish. The second jet units 860 and 870 configured to jet washing water by rotation may be provided below and above an upper dish basket 804*a*. That is, the jet units 810, 860 and 870 may use a linear jetting method in which washing water is linearly jetted or a hybrid jetting method that may use a rotational jetting method together in which washing water is jetted by rotation.

The jet units 810, 860, and 870 may include the first jet unit 810 configured to linearly jet washing water and the second jet units 860 and 870 configured to jet washing water by rotation. In a front surface of the first jet unit 810, the switching unit 820 is provided to switch a jet direction of washing water. The first jet unit 810 may be positioned below the lower dish basket 804*b*. The second jet units 860 and 870 may be positioned between the lower dish basket 804*b* and the upper dish basket 804*a*. The second jet unit 860 may be additionally positioned above the upper dish basket 804*a*.

The first jet unit 810 may jet water such that at least one primary water jet is formed in a direction almost parallel with the lower part of the dish basket 804.

The switching unit 820 configured to switch a direction of washing water jetted from the jet units 810, 860, and 870 is provided inside the washing tank 803. The switching unit 820 is provided inside a path of jetted washing water and switches a direction of washing water. A direction of washing water jetted from the first jet unit 810 is defined as a first direction, and a direction of washing water switched by the switching unit 820 is defined as a second direction. As an example, the switching unit 820 may be provided to face the first jet unit 810. When the first jet unit 810 is provided to jet water to the lower part of the dish basket 804, the switching unit 820 may be positioned below the dish basket 804. The switching unit 820 may be positioned outside the dish basket 804 and linearly move away from the first jet unit 810 or closer to the first jet unit 810. The primary water jet jetted from the first jet unit 810 is jetted toward the switching unit 820, a direction thereof is switched by the switching unit 820, the secondary water jet is formed toward a dish positioned inside the dish basket 804, and therefore the dish may be washed substantially using the secondary water jet. For example, the first jet unit 810 is mounted in a back surface of the washing tank, and the switching unit 820 may be positioned in a direction parallel with the first jet unit 810. The switching unit 820 may linearly reciprocate away from the first jet unit 810 or in a direction opposite thereto.

Also, the dish washing machine 800 may include a driving unit configured to drive the switching unit 820 to be movable in the washing tank 803. The driving unit may include a guide member 831 combined with the switching unit 820, a power generation device 835 configured to drive the switching unit 820, and a pulley 834. Also, the driving unit may include a connecting member 833 connecting the pulley 834 and the switching unit 820. The switching unit 820 may move in this method but the method is not limited thereto as long as the switching unit 820 is movably provided.

The switching unit 820 includes a roller 832 at both sides to allow easy movement in the washing tank. The switching unit 820 may be made of a steel or plastic material.

The switching unit 820 may be combined with the driving unit configured to drive the switching unit 820 to be movable in the washing tank 803. The driving unit may include at least one guide member 831 combined with one side of the switching unit 820 to guide movement of the switching unit 820. According to the second embodiment of the present invention, the guide member 831 may be provided as a rail, but the present invention is not limited thereto. As an example, the guide member may be formed in at least a part of the dish basket 804 without an additional component, and the guide member may also be formed in at least a part of an inside surface of the washing tank 803 without an additional component. The roller 832 of the switching unit 820 is combined with the guide member 831 of the driving unit and is movable between a front surface and a back surface of the washing tank 803 along the guide member 831. The guide member 831 of the driving unit is combined with both side walls 803*a* and 803*b* of the washing tank 803. The power generation device 835 configured to drive the switching unit 820 is combined with the pulley 834. The pulley 834 is connected to the switching unit 820 through the connecting member 833. As the connecting member 833, a wire rope or an elongated strap made of a carbon material may be used. In addition, a belt or a ball screw may be used as the connecting member. Through the switching unit 820, a dish horizontally (8) or vertically (9) disposed inside the dish basket 804 may be washed in various directions.

The washing tank 803 may include a heater 844 configured to heat washing water and a heater installation groove 845. The heater installation groove 845 is provided at the bottom of the washing tank 803, and the heater 844 is installed in the heater installation groove 845.

The sump 843 is provided at the center of the bottom of the washing tank 803 and is configured to collect and pump washing water. The sump 843 includes a washing pump 842 configured to pump washing water at a high pressure and a pump motor 841 configured to drive the washing pump 842. Also, a drainage pump 846 configured to drain washing water is provided at the bottom of the washing tank 803.

The washing pump 842 pumps washing water to the second jet units 860 and 870 through a first supply pipe 806 and pumps washing water to the first jet unit 810 through a second supply pipe 808. While the drawing illustrates that the first supply pipe 806 and the second supply pipe 808 are separately combined with a sump 843, the present invention is not limited thereto. That is, the first supply pipe 806 and the second supply pipe 808 may be branched from one pipe. The first supply pipe 806 may be connected to a connecting unit (not illustrated) and the connecting unit (not illustrated) may be connected to the jet units 810, 860, and 870.

The sump 843 may include a turbidity sensor (not illustrated) configured to detect a contamination level of washing water. The control unit (not illustrated) of the dish washing machine 800 may detect a contamination level of washing water using the turbidity sensor (not illustrated) and control the number of washing operations or rinsing operations. That is, when the contamination level is high, the number of washing or rinsing operations may be increased, or when the contamination level is low, the number of washing or rinsing operations may be decreased.

Figure 52:
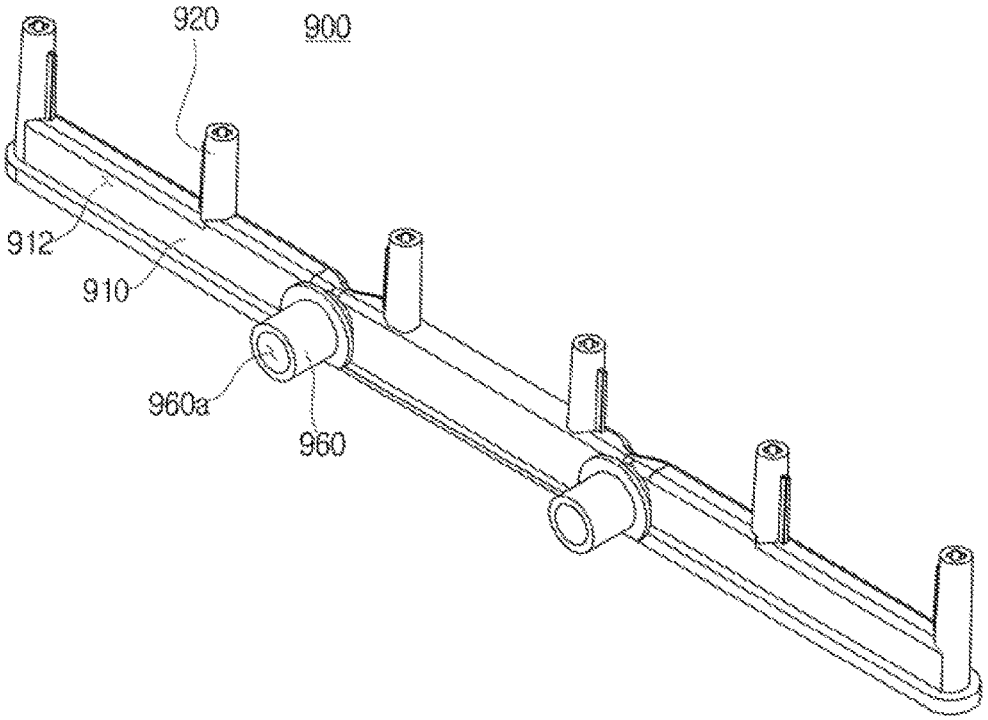
FIG. 52 is a perspective view of the jet unit according to the second embodiment of the present invention.

FIG. 52 is a perspective view of the jet unit according to the second embodiment of the present invention.

A first jet unit 900 is provided to generate the primary water jet to correspond to the switching unit 820.

The first jet unit 900 may include a jet body 910 combined with the washing tank 803 and a jet nozzle 920 in which a jet flow path 924 configured to jet washing water is provided.

In the jet body 910, a distribution flow path 912 that is combined with the washing tank 803 and enables washing water introduced from an inlet pipe 960 to be distributed into the plurality of jet nozzles 920 is formed therein.

The inlet pipe 960 is configured to introduce washing water pumped by the washing pump into the first jet unit 900 through the supply pipe 808. The inlet pipe 960 includes an inlet hole 960*a* and guides washing water supplied from the supply pipe 808 to the jet body 910. The inlet pipe 960 is combined with the supply pipe 808 to introduce washing water into the first jet unit 900.

The distribution flow path 912 communicates with the inlet hole 960*a* of the inlet pipe 960 and the jet flow path 924 of the jet nozzle 920 to be described below, and is provided to distribute washing water introduced through the inlet hole 960*a* into the plurality of jet nozzles 920.

The jet nozzle 920 is provided in the jet body 910 and configured to jet washing water supplied to the jet body 910 through the inlet pipe 960 toward the switching unit 820.

Figure 53:
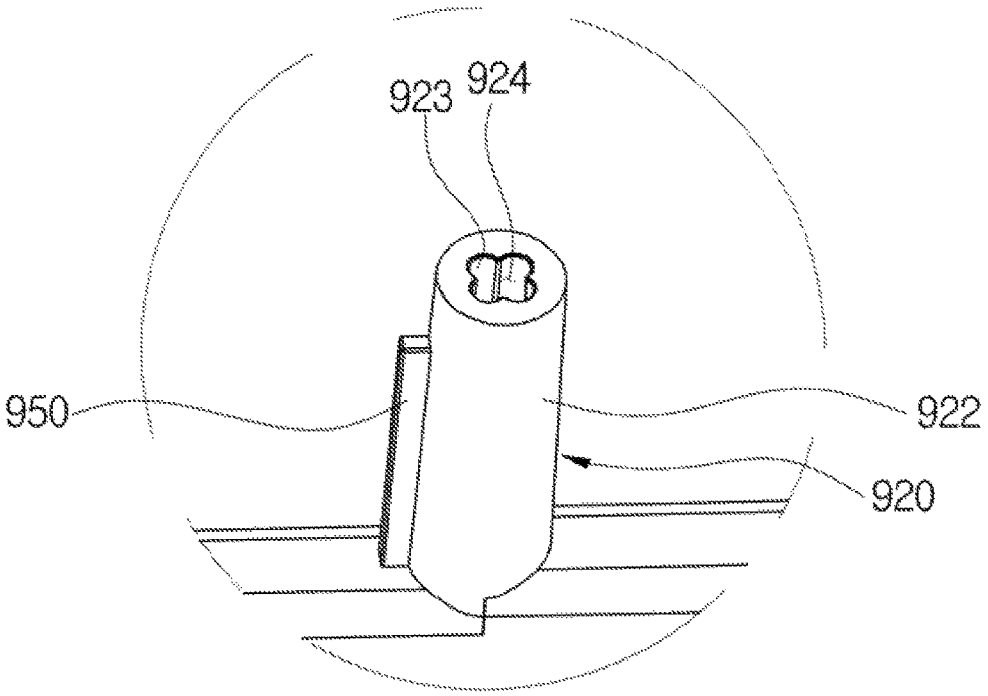
FIG. 53 is an enlarged view of a jet nozzle according to the second embodiment of the present invention.
Figure 54:
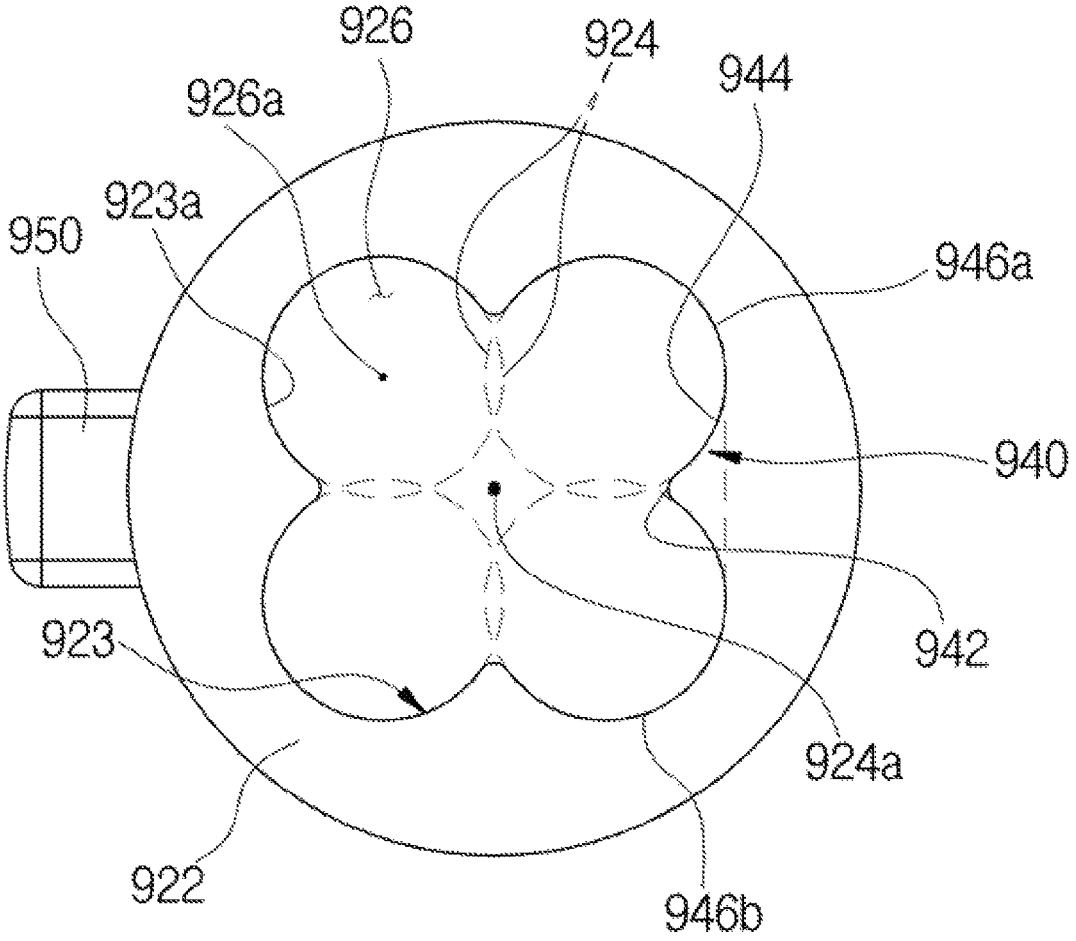
FIG. 54 is a top view of the jet nozzle according to the second embodiment of the present invention.
Figure 55:
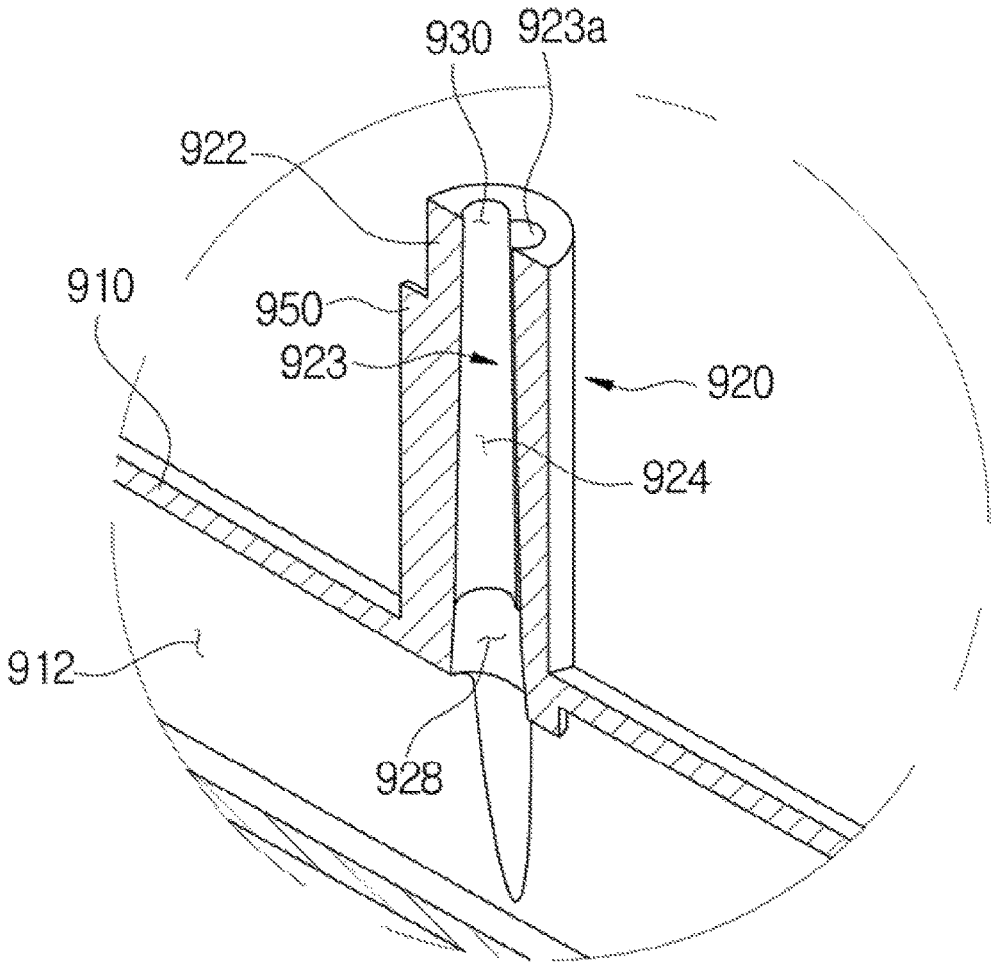
FIG. 55 is a cross sectional perspective view of the jet nozzle according to the second embodiment of the present invention.
Figure 56:
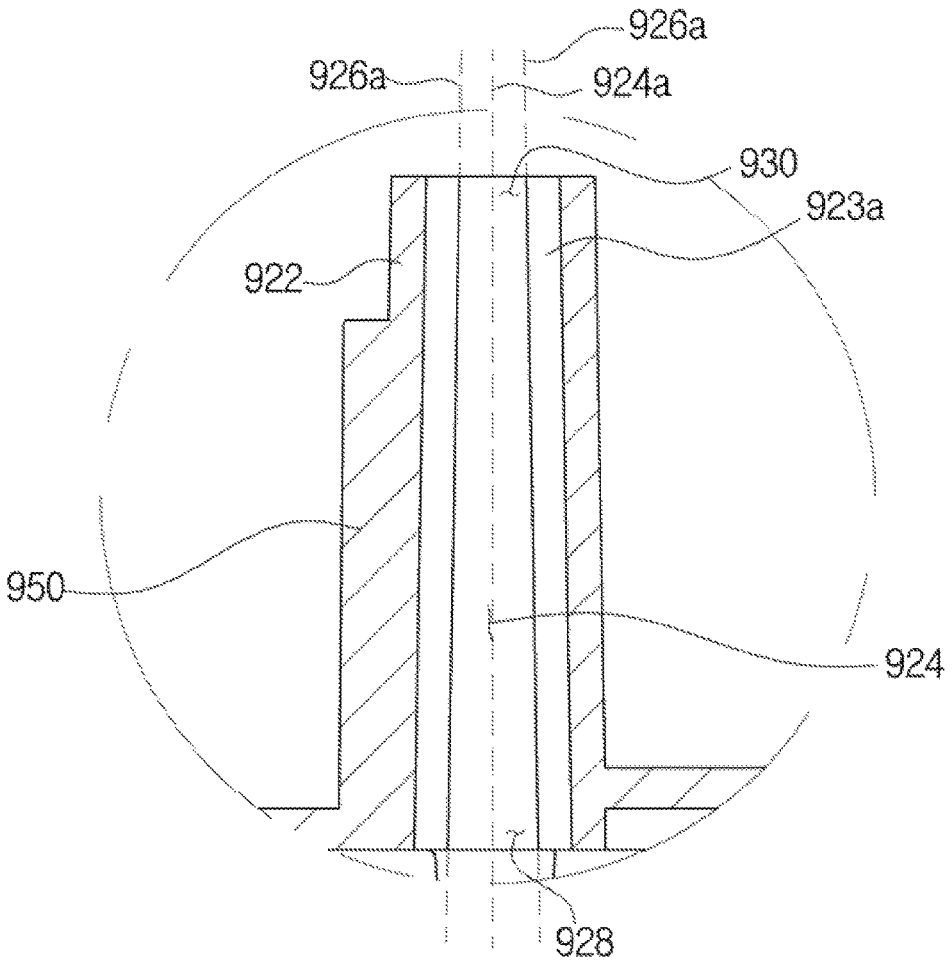
FIG. 56 is a cross sectional view of the jet nozzle according to the second embodiment of the present invention.
Figure 57:
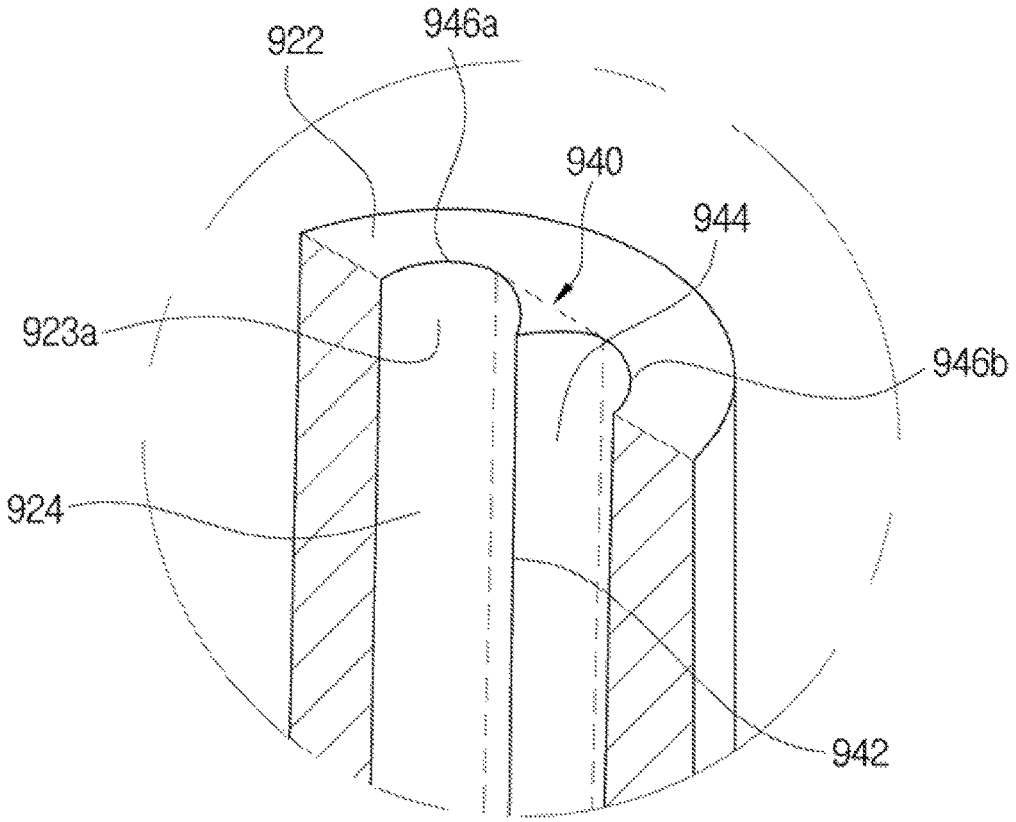
FIG. 57 is a partial enlarged view of the jet nozzle according to the second embodiment of the present invention.

FIG. 53 is an enlarged view of a jet nozzle according to the second embodiment of the present invention. FIG. 54 is a top view of the jet nozzle according to the second embodiment of the present invention. FIG. 55 is a cross sectional perspective view of the jet nozzle according to the second embodiment of the present invention. FIG. 56 is a cross sectional view of the jet nozzle according to the second embodiment of the present invention. FIG. 57 is a partial enlarged view of the jet nozzle according to the second embodiment of the present invention.

The jet nozzle 920 is provided to jet washing water into the washing tank.

The jet nozzle 920 may include a nozzle inner wall 923 forming the jet flow path 924 that allows washing water to flow. The nozzle inner wall 923 is provided inside the jet nozzle 920 and forms the jet flow path 924 configured to guide washing water to the washing tank.

The jet flow path 924 formed by the nozzle inner wall 923 may be formed such that a cross-sectional area decreases in a traveling direction of washing water. That is, a cross-sectional area of the jet flow path 924 at a first point may be formed larger than a cross-sectional area of the jet flow path 924 at a second point provided downstream from the first point in the traveling direction of washing water.

In other words, when a cross-sectional area of the jet flow path 924 at a cross section perpendicular to the traveling direction of washing water at the first point is denoted as a first area, and a cross-sectional area of the jet flow path 924 at a cross section perpendicular to the traveling direction of washing water at the second point provided downstream from the first point is denoted as a second area, the first area may be formed to be greater than the second area.

The nozzle inner wall 923 may include a plurality of flow path inner walls 923*a*.

The plurality of flow path inner walls 923*a* include an arc-shaped cross section perpendicular to the traveling direction of washing water. The plurality of flow path inner walls 923*a* may have different curvature radii, but have the same curvature radius in the embodiment of the present invention.

Also, centers 926*a* of the curvature radii of the plurality of flow path inner walls 923*a* may be different and separated from each other.

Four flow path inner walls 923*a* are radially provided in this embodiment. However, ten flow path inner walls 923*a* may be provided as in a third embodiment to be described below, and the number thereof is not limited thereto.

The plurality of flow path inner walls 923*a* are provided such that the centers 926*a* of curvature radii are separated from each other and therefore the plurality of flow path inner walls 923*a* may abut each other at a constant angle. Specifically, when the centers 926*a* of curvature radii of the plurality of flow path inner walls 923*a* are separated to each other, one end portion of any flow path inner wall 923*a* among the plurality of flow path inner walls 923*a* may be formed such that a contact with the other end portion of the adjacent flow path inner wall 923*a* has a shape that protrudes toward the nozzle inner wall 923.

That is, the nozzle inner wall 923 may include a plurality of protrusions 940 that are in contact with the plurality of flow path inner walls 923*a* and protrude toward the jet flow path 924.

The plurality of protrusions 940 are formed to protrude toward the jet flow path 924 relative to the adjacent nozzle inner wall 923. The plurality of protrusions 940 are formed to protrude in the same direction as the traveling direction of washing water and are separately disposed in a circumferential direction along the nozzle inner wall 923.

The plurality of protrusions 940 may be provided such that a protrusion degree increases in the traveling direction of washing water. Specifically, when the plurality of protrusions 940 protrude by a first height from the nozzle inner wall 923 at the first point and protrude by a second height from the nozzle inner wall 923 at the second point provided downstream from the first point in the traveling direction of washing water, the second height may be greater than the first height.

Protruding shapes of the plurality of protrusions 940 are not limited thereto, but a shape of a curved surface that is convex and faces the jet flow path 924 is provided in the embodiment of the present invention.

The plurality of protrusions 940 may include a thread portion 942 and a side surface portion 944.

The thread portion 942 is formed to protrude from the nozzle inner wall 923 toward the jet flow path 924. The thread portion 942 refers to a portion that protrudes toward the jet flow path 924 among the protrusion 940. The thread portion 942 may be formed to be pointed by the both side surface portions 944 and have a shape of a curved surface that is convex and faces the jet flow path 924 in the embodiment of the present invention.

The side surface portion 944 is provided in both side surfaces of the thread portion 942 and connects the nozzle inner wall 923 and the thread portion 942.

The side surface portion 944 connects the nozzle inner wall 923 and the thread portion 942 and may have a curved shape. Also, the side surface portion 944 may be formed to have the same curvature as the adjacent flow path inner wall 923*a* among the plurality of flow path inner walls 923*a*.

Hereinafter, the second embodiment of the present invention will be described from a different perspective.

Configurations the same as in the above description may not be described or may be supplemented in detail.

The jet nozzle 920 may include a nozzle body 922 and the jet flow path 924 formed inside the nozzle body 922.

The jet flow path 924 is provided such that washing water flows in the jet nozzle 920 and washing water is jetted to the washing tank 803. The jet flow path 924 may include a plurality of sub-flow paths 926.

The plurality of sub-flow paths 926 may be formed to at least partially overlap. That is, an area of a cross-sectional area of the jet flow path 924 may be formed to be smaller than a total area of cross-sectional areas when the plurality of sub-flow paths 926 are independently formed. Specifically, the plurality of sub-flow paths 926 each are formed around a plurality of sub-flow path axes 926*a* formed to be parallel to a lengthwise direction of the jet nozzle 920, and a distance between the plurality of sub-flow path axes 926*a* may be formed to be smaller than any diameter of the plurality of sub-flow paths 926. The sub-flow path axis 926*a* has the same configuration as the center 926*a* of the curvature radius described above.

According to such a configuration, compared to when a cross section of the jet flow path 924 is formed in a circle, a ratio of a cross-sectional area of the jet flow path 924 with respect to a circumference of the jet flow path 924 that is an outline of the jet flow path 924 decreases, and a hydraulic diameter decreases.

Sizes of cross-sectional areas of the plurality of sub-flow paths 926 may be formed to be different, but the plurality of sub-flow paths 926 each have the same cross-sectional area size in the second embodiment of the present invention.

The jet flow path 924 includes a jet nozzle axis 924*a* formed in a lengthwise direction of the jet nozzle 920. The plurality of sub-flow paths 926 include the sub-flow path axis 926*a* serving as a center of each sub-flow path 926. The plurality of sub-flow path axes 926*a* may be separately disposed a predetermined interval with respect to the jet nozzle axis 924*a*. In the second embodiment of the present invention, four sub-flow paths 926 are formed such that the plurality of sub-flow path axes 926*a* form a rectangle at the same interval. In other words, the sub-flow path axis 926*a* serving as a center of the plurality of sub-flow paths 926 may be radially disposed with respect to the jet nozzle axis 924*a*. However, disposition and the number of the plurality of sub-flow paths 926 are not limited thereto.

The sub-flow path axis 926*a* of the plurality of sub-flow paths 926 may be formed such that a separation distance from the jet nozzle axis 924*a* decreases in the traveling direction of washing water. That is, washing water is introduced from the distribution flow path 912 and jetted to the washing tank 803 through the jet flow path 924. The plurality of sub-flow path axes 926*a* serving as centers of the plurality of sub-flow paths 926 may be formed such that a separation distance from the jet nozzle axis 924*a* serving as a center of the jet flow path 924 decreases in the traveling direction. When viewed from a perspective of the cross-sectional area, an overlapping area of cross sections of the plurality of sub-flow paths 926 may be provided to increase in the traveling direction of washing water.

According to such a configuration, washing water flowing in each flow path is converged toward the jet nozzle axis 924*a* at a constant angle, and linearity of washing water may be improved.

The jet flow path 924 may be configured to communicate with the distribution flow path 912.

The jet flow path 924 may be formed to include an inlet 928 communicating with the distribution flow path 912 and an outlet 930 communicating with the washing tank 803 as end portions. The plurality of sub-flow paths 926 may use the inlet 928 and the outlet 930 through which washing water is introduced and discharged in common.

The inlet 928 may be formed to have a circular shape and the outlet 930 may be formed to have a shape in which a plurality of circles overlap. From the inlet 928 to the outlet 930, the jet flow path 924 is provided such that a shape of a cross section is deformed without a step. Therefore, a flow resistance may be minimized.

The jet nozzle 920 may include the protrusion 940.

The protrusion 940 is provided to protrude toward the axis of the jet flow path 924 of the jet flow path 924 from the jet nozzle 920. A protrusion shape and a protrusion size of the protrusion 940 are not limited thereto. The plurality of protrusions 940 may be separately disposed along an inner wall of the nozzle body 922 around the axis of the jet flow path 924. Through the protrusion 940, the jet flow path 924 may have a smaller cross-sectional area than a length of a circumference thereof.

When there are a first curved surface 946*a* formed by any sub-flow path 926 among the plurality of sub-flow paths 926 and a second curved surface 946*b* formed by another adjacent sub-flow path 926, the protrusion 940 may be formed in a portion in which the first curved surface 946*a* and the second curved surface 946*b* meet. The protrusion 940 may divide at least parts of the plurality of sub-flow paths 926.

The protrusion 940 may be provided to protrude toward the jet nozzle axis 924*a* in the traveling direction of washing water. Specifically, the protrusion 940 may be formed to have a shape that protrudes from the inlet 928 to the outlet 930 of the jet flow path 924. A protrusion degree of the protrusion 940 is provided such that a protrusion degree becomes greater in the outlet 930 than the inlet 928, and a length of a circumference of the jet flow path 924 may become greater in the outlet 930 than the inlet 928.

The protrusion 940 may include the thread portion 942 protruding toward the jet nozzle axis 924*a* and the side surface portion 944 ranging from the thread portion 942 to the nozzle body 922.

The thread portion 942 may protrude from the nozzle body 922 in the traveling direction of washing water to be closer to the jet nozzle axis 924*a*. The thread portion 942 may be formed in a curved surface through a rounding process in order to decrease a flow resistance.

The side surface portion 944 is a portion that ranges from the thread portion 942 to the nozzle body 922 and may be formed in a curved surface in order to decrease a flow resistance of the jet flow path 924. The curved surface may have a concave shape, and a curvature of the curved surface may correspond to an internal cross section of the adjacent jet nozzle 920. That is, the side surface portion 944 may be formed in the same curvature as an inner wall of the adjacent nozzle body 922.

A guide rib 950 may be provided in a side surface of the jet nozzle 920.

The guide rib 950 guides the jet nozzle 920 in order to prevent the jet nozzle 920 from twisting or bending due to a hydraulic pressure at the jet nozzle 920. The guide rib 950 connects the jet body 910 and the jet nozzle 920, and may be disposed in a lengthwise direction of the jet nozzle 920.

A length of the jet nozzle is not limited. However, for linearity of washing water of a jet nozzle having a circular cross section of a jet flow path in the related art, a length ten times the hydraulic diameter was necessary. When the plurality of flow path inner walls are formed as in the embodiment of the present invention, if only a length approximately five times the hydraulic diameter is provided, the same effect as the jet nozzle in the related art may be obtained. Further, when the number of plurality of flow path inner walls is increased or additional shapes are provided, it is possible to implement a jet nozzle of a length twice the hydraulic diameter. Therefore, the jet nozzle of a length twice the hydraulic diameter is included in the scope of the jet nozzle corresponding to the embodiment of the present invention.

Hereinafter, a jet unit and a dish washing machine having the same according to the third embodiment of the present invention will be described. In the embodiment of the present invention, the same configuration as the above configuration will not be described.

Figure 58:
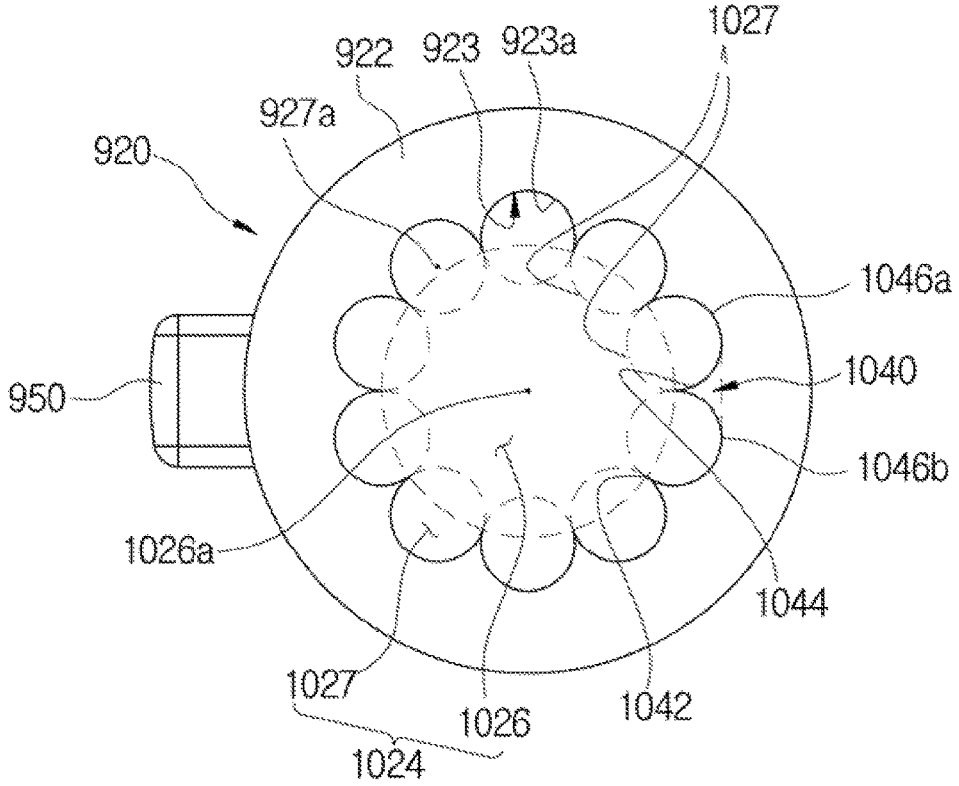
FIG. 58 is a top view of a jet nozzle according to a third embodiment of the present invention.
Figure 59:
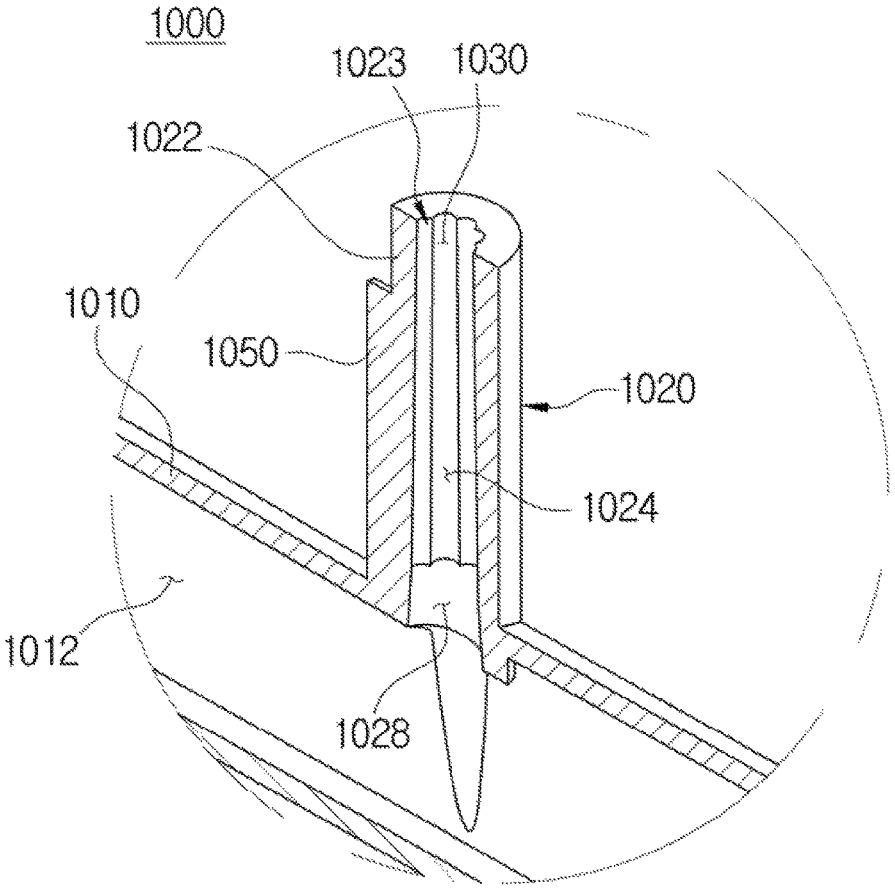
FIG. 59 is a cross sectional perspective view of the jet nozzle according to the third embodiment of the present invention.
Figure 60:
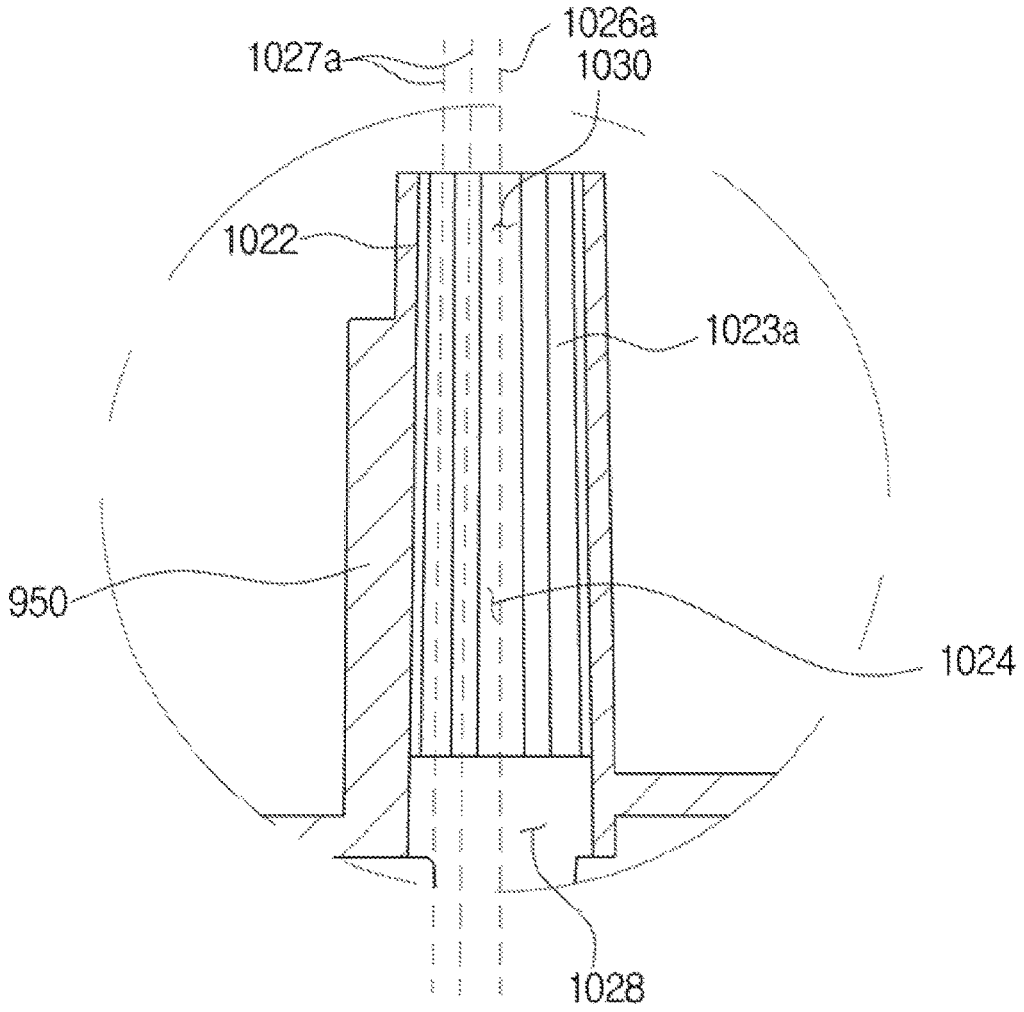
FIG. 60 is a cross sectional view of the jet nozzle according to the third embodiment of the present invention.

FIG. 58 is a top view of a jet nozzle according to a third embodiment of the present invention. FIG. 59 is a cross sectional perspective view of the jet nozzle according to the third embodiment of the present invention. FIG. 60 is a cross sectional view of the jet nozzle according to the third embodiment of the present invention.

A jet nozzle 1020 is provided to jet washing water into the washing tank.

The jet nozzle 1020 may include a nozzle inner wall 1023 forming a jet flow path 1024 that allows washing water to flow. The nozzle inner wall 1023 is provided inside the jet nozzle 1020 and forms the jet flow path 1024 configured to guide washing water to the washing tank.

The jet flow path 1024 formed by the nozzle inner wall 1023 may be formed such that a cross-sectional area decreases in the traveling direction of washing water. That is, a cross-sectional area of the jet flow path 1024 at the first point may be formed to be larger than a cross-sectional area of the jet flow path 1024 at the second point provided downstream from the first point in the traveling direction of washing water.

In other words, when a cross-sectional area of the jet flow path 1024 at a cross section perpendicular to the traveling direction of washing water at the first point is denoted as a first area, and a cross-sectional area of the jet flow path 1024 at a cross section perpendicular to the traveling direction of washing water at the second point provided downstream from the first point is denoted as a second area, the first area may be formed to be greater than the second area.

The nozzle inner wall 1023 may include a plurality of flow path inner walls 1023*a*.

The plurality of flow path inner walls 1023*a* include an arc-shaped cross section perpendicular to the traveling direction of washing water. The plurality of flow path inner walls 1023*a* may have different curvature radii, but have the same curvature radius in the embodiment of the present invention.

Also, centers 1027*a* of curvature radii of the plurality of flow path inner walls 1023*a* may be different and separated from each other.

Ten flow path inner walls 1023*a* may be provided as in this embodiment, and the number thereof is not limited thereto.

The plurality of flow path inner walls 1023*a* are provided such that the centers 1027*a* of curvature radii are separated from each other and therefore the plurality of flow path inner walls 1023*a* may abut each other at a constant angle. Specifically, when the centers 1027*a* of curvature radii of the plurality of flow path inner walls 1023*a* are separated to each other, one end portion of any flow path inner wall 1023*a* among the plurality of flow path inner walls 1023*a* may be formed such that a contact with the other end portion of the adjacent flow path inner wall 1023*a* has a shape that protrudes toward the nozzle inner wall 1023.

That is, the nozzle inner wall 1023 may include a plurality of protrusions 1040 that are in contact with the plurality of flow path inner walls 1023*a* and protrude toward the jet flow path 1024.

The plurality of protrusions 1040 are formed to protrude toward the jet flow path 1024 relative to the adjacent nozzle inner wall 1023. The plurality of protrusions 1040 are formed to protrude in the same direction as the traveling direction of washing water and separately disposed in a circumferential direction along the nozzle inner wall 1023.

The plurality of protrusions 1040 may be provided such that a protrusion degree increases in the traveling direction of washing water. Specifically, when the plurality of protrusions 1040 protrude by the first height from the nozzle inner wall 1023 at the first point and protrude by the second height from the nozzle inner wall 1023 at the second point provided downstream from the first point in the traveling direction of washing water, the second height may be greater than the first height.

Protruding shapes of the plurality of protrusions 1040 are not limited thereto, but a shape of a curved surface that is convex and faces the jet flow path 1024 is provided in the embodiment of the present invention.

The plurality of protrusions 1040 may include a thread portion 1042 and a side surface portion 1044.

The thread portion 1042 is formed to protrude from the nozzle inner wall 1023 toward the jet flow path 1024. The thread portion 1042 refers to a portion that protrudes toward the jet flow path 1024 among the protrusion 1040. The thread portion 1042 may be formed to be pointed by the both side surface portions 1044 and have a shape of a curved surface that is convex and faces the jet flow path 1024 in the embodiment of the present invention.

The side surface portion 1044 is provided in both side surfaces of the thread portion 1042 and connects the nozzle inner wall 1023 and the thread portion 1042.

The side surface portion 1044 connects the nozzle inner wall 1023 and the thread portion 1042 and may have a curved shape. Also, the side surface portion 1044 may be formed to have the same curvature as the adjacent flow path inner wall 1023*a* among the plurality of flow path inner walls 1023*a*.

Hereinafter, the third embodiment of the present invention will be described from a different perspective.

A first jet unit 1000 may include a jet body 1010 combined with the washing tank 803 and the jet nozzle 1020 in which the jet flow path 1024 configured to jet washing water is provided.

The jet nozzle 1020 may include a nozzle body 1022 and the jet flow path 1024 formed inside the nozzle body 1022.

The jet flow path 1024 is provided such that washing water flows in the jet nozzle 1020 and washing water is jetted to the washing tank 803. The jet flow path 1024 may include a main flow path 1026 and a plurality of sub-flow paths 1027.

The main flow path 1026 is a flow path around the axis of the main flow path 1026 formed in a lengthwise direction of the jet nozzle 1020. The main flow path 1026 may have various cross section shapes, but a circular shape is provided in the embodiment of the present invention.

The plurality of sub-flow paths 1027 may have a center axis adjacent to a virtual outline of the main flow path 1026. That is, the sub-flow path axis 1027*a* crossing centers of the plurality of sub-flow paths 1027 is provided to be adjacent a virtual outline of the main flow path 1026, and some of the cross sections of the plurality of sub-flow paths 1027 may overlap a cross section of the main flow path 1026. That is, the plurality of sub-flow paths 1027 may be disposed such that some of the cross-sectional areas thereof overlap in the vicinity of the main flow path 1026. The sub-flow path axis 1027*a* has the same configuration as the center 1027*a* of the curvature radius described above.

The number or disposition of plurality of sub-flow paths 1027 is not limited, but the plurality of sub-flow paths 1027 may be evenly disposed along an outline of the main flow path 1026 in the embodiment of the present invention.

The sub-flow path axis 1027*a* of the plurality of sub-flow paths 1027 may be formed such that a separation distance from the axis of the main flow path 1026 decreases in the traveling direction of washing water. That is, washing water is introduced from a distribution flow path 1012 and jetted to the washing tank 803 through the jet flow path 1024. The plurality of sub-flow path axes 1027*a* serving as centers of the plurality of sub-flow paths 1027 may be formed such that a separation distance from the axis of the main flow path 1026 decreases in the traveling direction. When viewed from a perspective of the cross-sectional area, an area in which cross sections of the plurality of sub-flow paths 1027 and a cross section of the main flow path 1026 overlap may increase in the traveling direction of washing water.

According to such a configuration, washing water flowing in each flow path is converged toward the axis of the jet nozzle 1020 at a constant angle, and linearity of washing water may be improved.

The jet flow path 1024 may be configured to communicate with the distribution flow path 1012.

The jet flow path 1024 may be formed to include an inlet 1028 communicating with the distribution flow path 1012 and an outlet 1030 communicating with the washing tank 803 as end portions. The main flow path 1026 and the plurality of sub-flow paths 1027 may use the inlet 1028 and the outlet 1030 through which washing water is introduced and discharged in common.

The inlet 1028 may be formed to have a circular shape and the outlet 1030 may be formed to have a shape in which a plurality of circles overlap. From the inlet 1028 to the outlet 1030, the jet flow path 1024 is provided such that a shape of a cross section is deformed without a step. Therefore, a flow resistance may be minimized.

The jet nozzle 1020 may include the protrusion 1040.

The protrusion 1040 is provided to protrude toward a main flow path axis 1026*a* of the jet flow path 1024 from the jet nozzle 1020. A protrusion shape and a protrusion size of the protrusion 1040 are not limited thereto. The plurality of protrusions 1040 may be separately disposed along in an inner wall of the nozzle body 1022 around the main flow path axis 1026*a*. Through the protrusion 1040, the jet flow path 1024 may have a smaller cross-sectional area than a length of a circumference thereof.

When there are a first curved surface 1046*a* formed by any sub-flow path 1027 among the plurality of sub-flow paths 1027 and a second curved surface 1046*b* formed by another adjacent sub-flow path 1027, the protrusion 1040 may be formed in a portion in which the first curved surface

1046*a* and the second curved surface 1046*b* meet. The protrusion 1040 may divide at least parts of the plurality of sub-flow paths 1027.

The protrusion 1040 may be provided to protrude toward the main flow path axis 1026*a* in the traveling direction of washing water. Specifically, the protrusion 1040 may be formed to have a shape that protrudes from the inlet 1028 to the outlet 1030 of the jet flow path 1024. A protrusion degree of the protrusion 1040 is provided such that a protrusion degree becomes greater in the outlet 1030 than the inlet 1028, and a length of a circumference of the jet flow path 1024 may become greater in the outlet 1030 than the inlet 1028.

The protrusion 1040 may include the thread portion 1042 protruding toward the main flow path axis 1026*a* and the side surface portion 1044 ranging from the thread portion 1042 to the nozzle body 1022.

The thread portion 1042 may protrude from the nozzle body 1022 in the traveling direction of washing water to be closer to the main flow path axis 1026*a*. The thread portion 1042 may be formed in a curved surface through a rounding process in order to decrease a flow resistance.

The side surface portion 1044 is a portion that ranges from the thread portion 1042 to the nozzle body 1022 and may be formed in a curved surface in order to decrease a flow resistance of the jet flow path 1024. The curved surface may have a concave shape, and a curvature of the curved surface may correspond to an internal cross section of the adjacent jet nozzle 1020. That is, the side surface portion 1044 may be formed in the same curvature as an inner wall of the adjacent nozzle body 1022.

Hereinafter, a jet unit and a dish washing machine having the same according to a fourth embodiment of the present invention will be described. In the embodiment of the present invention, the same configuration as the above configuration will not be described.

Figure 61:
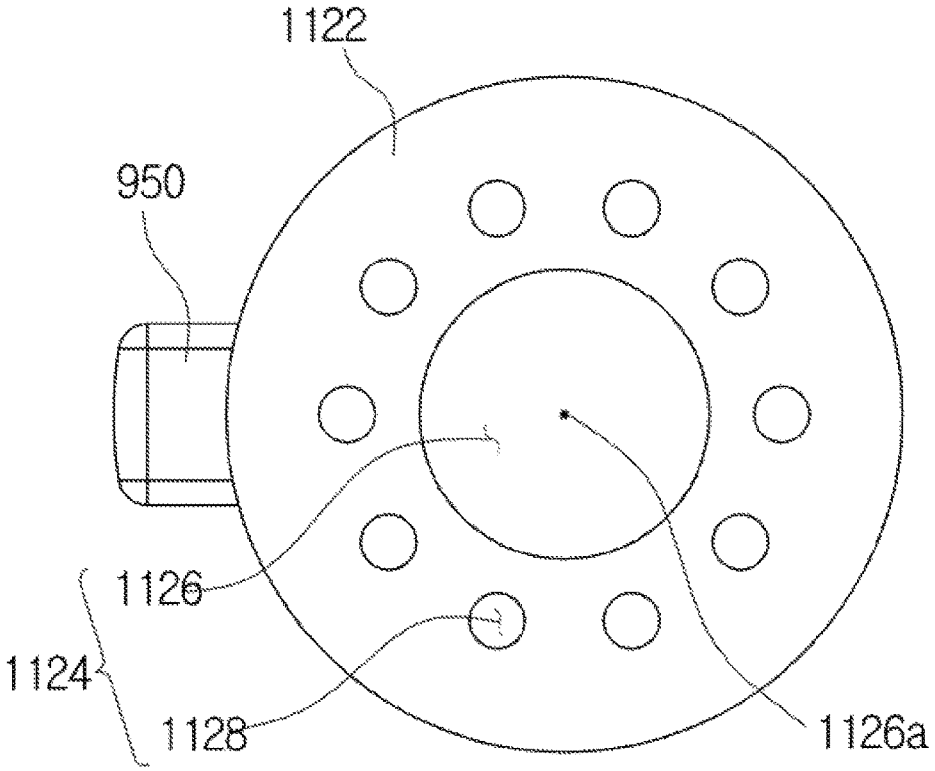
FIG. 61 is a top view of a jet nozzle according to a fourth embodiment of the present invention.
Figure 62:
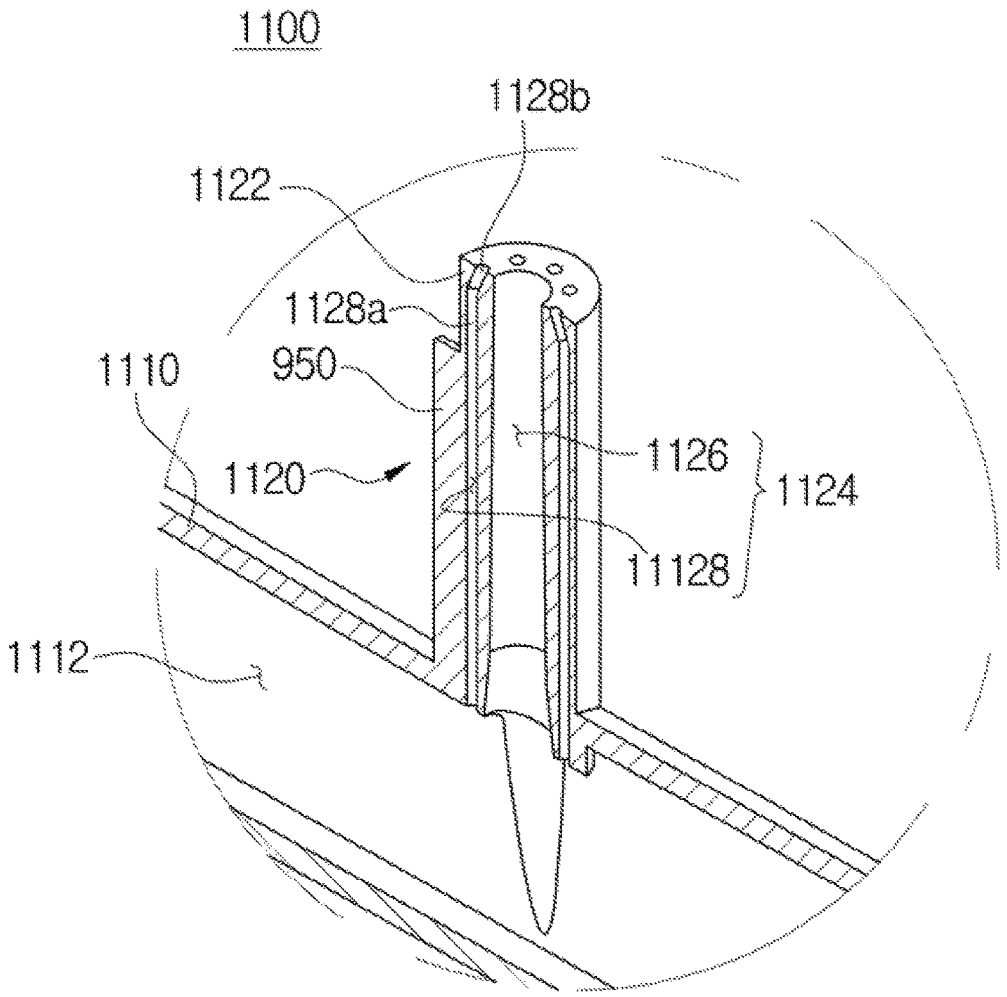
FIG. 62 is a cross sectional perspective view of the jet nozzle according to the fourth embodiment of the present invention.
Figure 63:
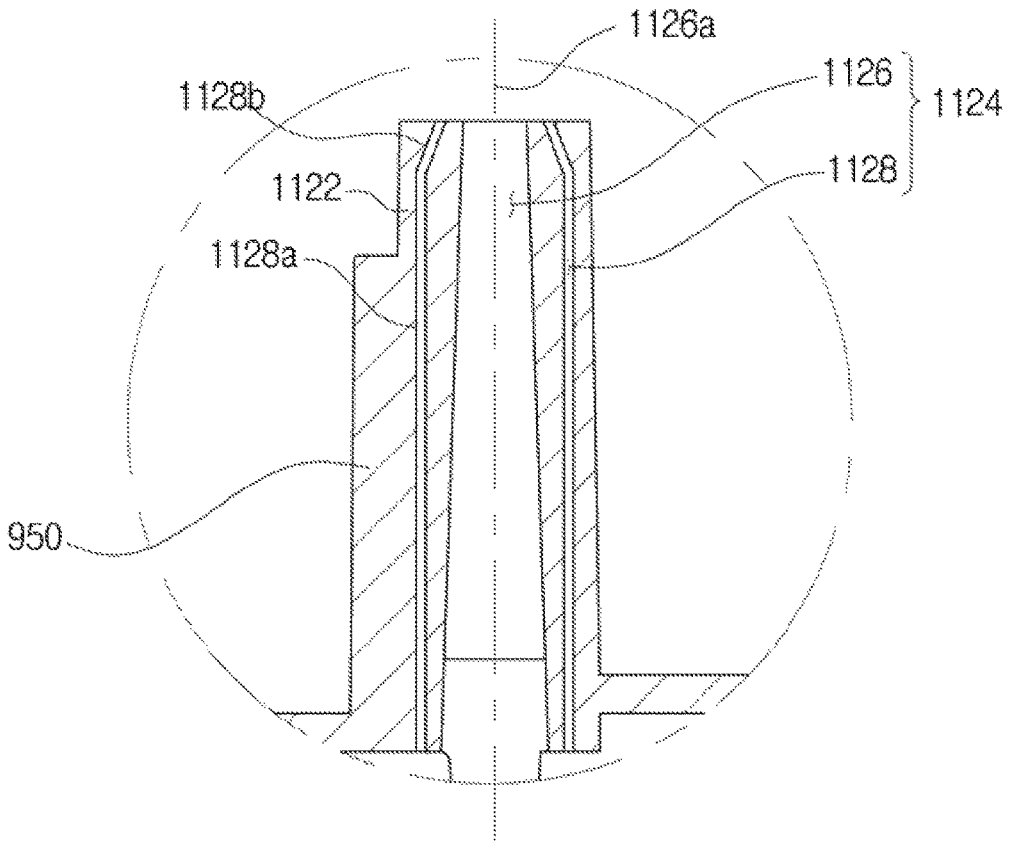
FIG. 63 is a cross sectional view of the jet nozzle according to the fourth embodiment of the present invention.

FIG. 61 is a top view of a jet nozzle according to a fourth embodiment of the present invention. FIG. 62 is a cross sectional perspective view of the jet nozzle according to the fourth embodiment of the present invention. FIG. 63 is a cross sectional view of the jet nozzle according to the fourth embodiment of the present invention.

A first jet unit 1100 may include a jet body 1110 combined with the washing tank 803 and a jet nozzle 1120 in which a jet flow path 1124 configured to jet washing water is provided.

The jet nozzle 1120 may include a nozzle body 1122 and the jet flow path 1124 formed inside the nozzle body 1122.

The jet flow path 1124 is provided such that washing water flows in the jet nozzle 1120 and washing water is jetted to the washing tank 803. The jet flow path 1124 may include a first flow path 1126 and a plurality of second flow paths 1128 provided in the vicinity of the first flow path 1126.

The first flow path 1126 is a flow path around a first flow path axis 1126*a* that is formed in a lengthwise direction of the jet nozzle 1120. The first flow path 1126 may have various cross section shapes, but have a circular shape in the embodiment of the present invention.

The plurality of second flow paths 1128 are formed to be adjacent to the first flow path 1126 and may have an independent outlet from the first flow path 1126.

The second flow path 1128 may include a guide pipe 1128*a* in which washing water is introduced from the distribution flow path and is introduced and guided to the second flow path 1128, and a bent pipe 1128*b* to be bent toward the first flow path 1126. Specifically, the first flow path 1126 may include the first flow path axis 1126*a* crossing a center thereof, a direction of washing water flowing in the guide pipe 1128*a* is changed when the washing water passes through the bent pipe 1128*b* that is bent toward the first flow path axis 1126*a* relative to the guide pipe 1128*a*, and linearity of washing water jetted through the first flow path 1126 may be provided.

The plurality of second flow paths 1128 are provided in the vicinity of the first flow path 1126, and may adjust a jet direction in several directions in order to obtain better linearity in a jet direction of the first flow path 1126.

In the jet nozzle 1120 of the present invention, the first jet units 900, 1000, and 1100 using the linear jetting method have been described, but it may also be applied to the second jet units 860 and 870 using the rotational jetting method.

According to the jet unit and the dish washing machine having the same of the present invention, linearity of the jet nozzle is improved and a size of the jet unit may be decreased accordingly. Therefore, it is possible to implement a compact dish washing machine.

Hereinafter, a jet nozzle, a method of manufacturing the same, and a dish washing machine having the same according to a fifth embodiment will be described.

Figure 64:
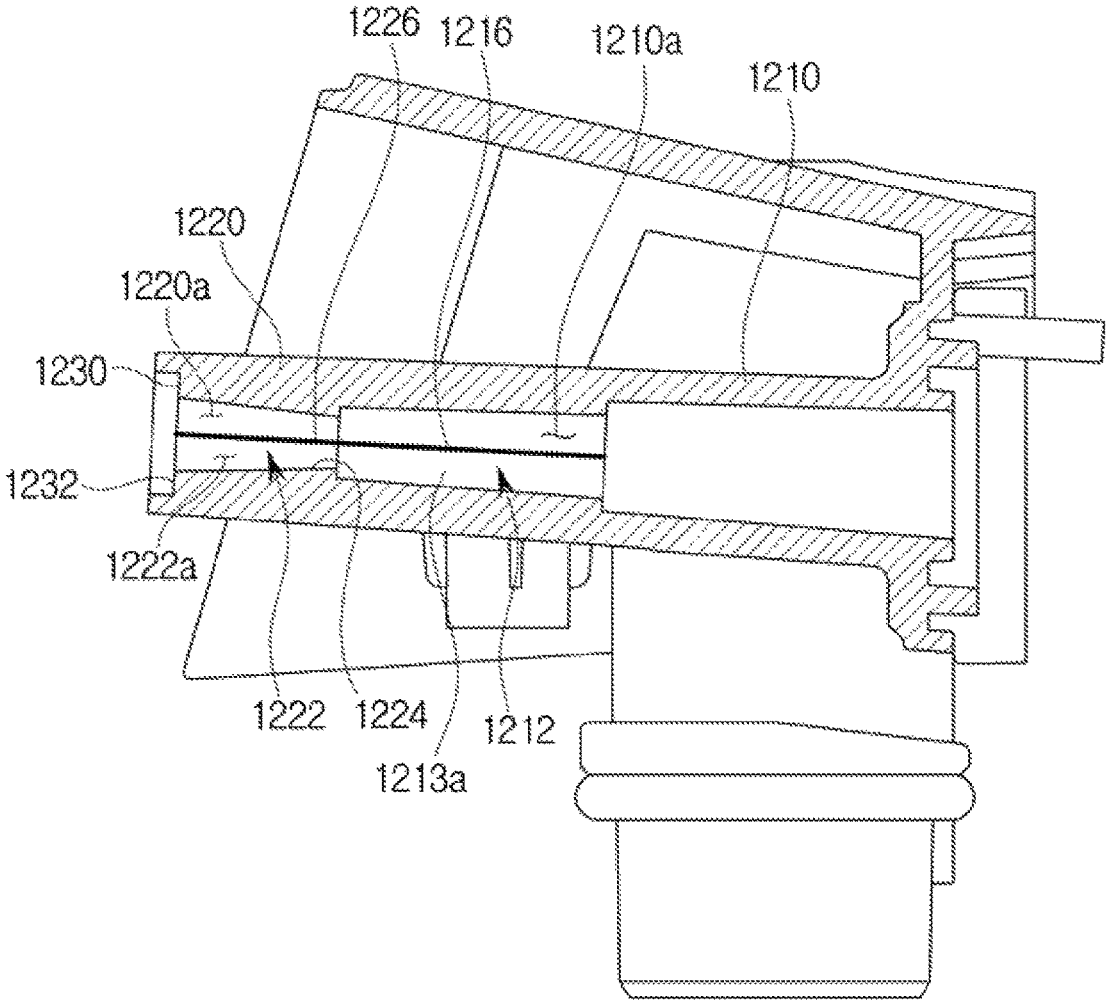
FIG. 64 is a cross sectional view of a jet nozzle according to a fifth embodiment of the present invention.
Figure 65:
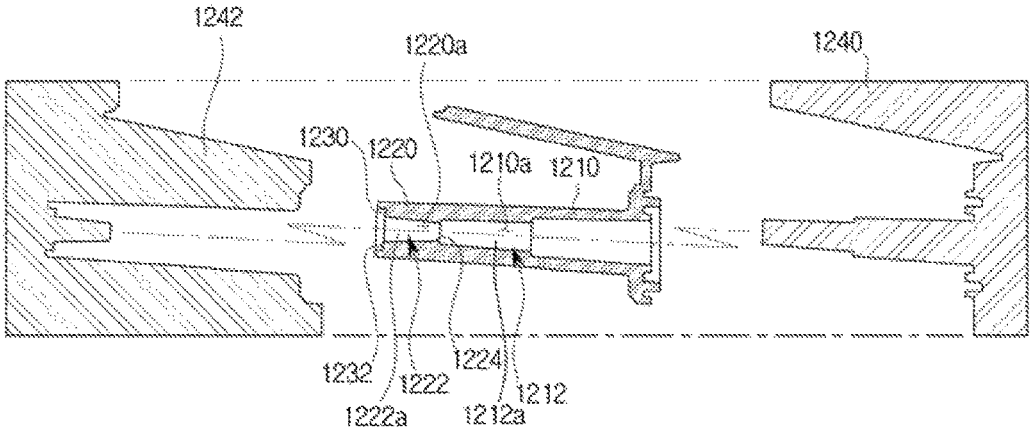
FIGS. 65 and 66 are diagrams illustrating a process of manufacturing a jet nozzle according to the fifth embodiment of the present invention.
Figure 66:
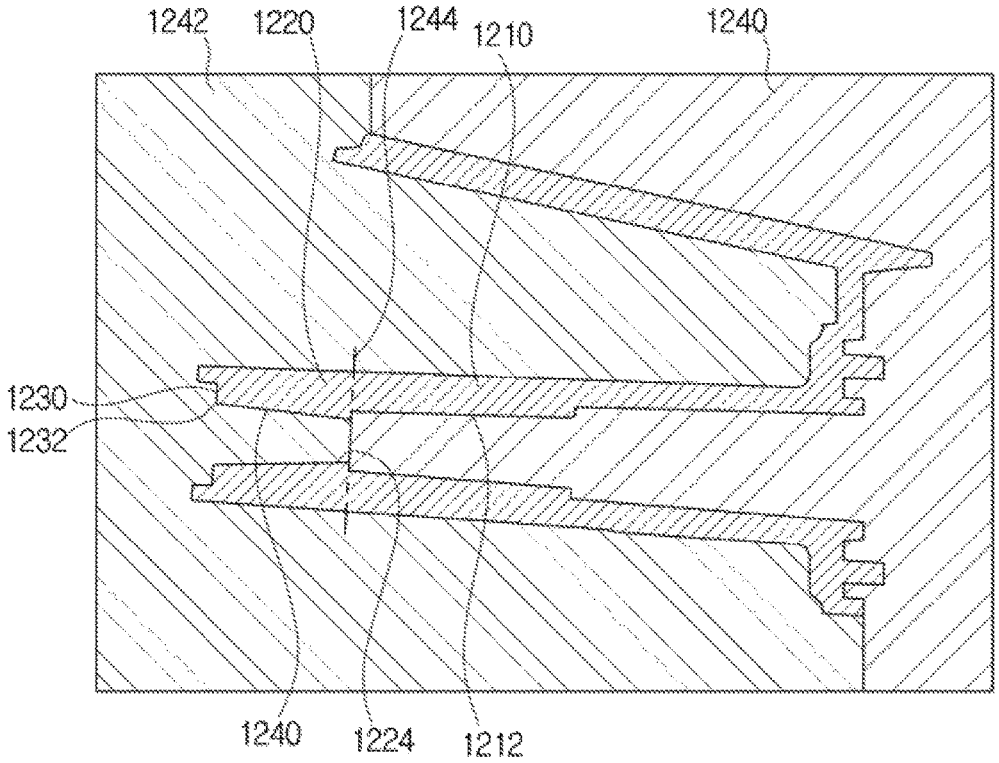

FIG. 64 is a cross sectional view of a jet nozzle according to a fifth embodiment of the present invention. FIGS. 65 and 66 are diagrams illustrating a process of manufacturing a jet nozzle according to the fifth embodiment of the present invention.

The same configuration as the above configuration will not be described.

A jet nozzle 1200 is provided to jet washing water into the washing tank.

The jet nozzle 1200 may include a first jet nozzle 1210 and a second jet nozzle 1220.

The first jet nozzle 1210 includes a first jet flow path 1210*a* whose cross-sectional area decreases in the traveling direction of washing water. The second jet nozzle 1220 includes a second jet flow path 1220*a* communicating with the first jet flow path 1210*a*. The first jet flow path 1210*a* and the second jet flow path 1220*a* are provided to communicate and may have the same center line. The first jet flow path 1210*a* may communicate with a nozzle flow path 1202 and receive washing water supplied from the nozzle flow path 1202.

The first jet nozzle 1210 may include a first nozzle inner wall 1212 forming the first jet flow path 1210*a*. The first nozzle inner wall 1212 may be formed to be inclined toward a center of the flow path in the traveling direction of washing water. According to such a configuration, the first jet flow path 1210*a* may be configured such that a cross-sectional area decreases in the traveling direction of washing water.

The second jet nozzle 1220 may include a second nozzle inner wall 1222 forming the second jet flow path 1220*a*. The second nozzle inner wall 1222 may be formed to be inclined away from the center of the flow path. According to such a configuration, the second jet flow path 1220*a* may be provided such that a cross-sectional area increases in the traveling direction of washing water. However, a degree of inclination of the second nozzle inner wall 1222 is not limited but may be parallel in the traveling direction of washing water.

The first nozzle inner wall 1212 and the second nozzle inner wall 1222 may be provided to have a step in the traveling direction of washing water. That is, the second jet nozzle 1220 may further include a step portion 1224 provided on the second jet flow path 1220*a* such that a cross-sectional area upstream along the second jet flow path 1220*a* becomes smaller than a cross-sectional area downstream along the first jet flow path 1210*a*. When the first nozzle inner wall 1212 and the second nozzle inner wall 1222 are connected to have a step through the step portion 1224, a flow rate of washing water flowing in the first jet flow path 1210*a* formed by the first nozzle inner wall 1212 increases when the washing water passes through the second jet flow path 1220*a* formed by the second nozzle inner wall 1222.

The first nozzle inner wall 1212 may include a plurality of first flow path inner walls 1212*a*.

The plurality of first flow path inner walls 1212*a* include an arc-shaped cross section perpendicular to the traveling direction of washing water. The plurality of first flow path inner walls 1212*a* may have different curvature radii, but have the same curvature radius in the embodiment of the present invention.

Also, centers of curvature radii of the plurality of first flow path inner walls 1212*a* may be different and separated from each other.

In this embodiment, four first flow path inner walls 1212*a* are provided to be radially symmetric, but the number thereof is not limited thereto.

The plurality of first flow path inner walls 1212*a* are provided such that centers of curvature radii are separated from each other and therefore the plurality of first flow path inner walls 1212*a* may abut each other at a constant angle. Specifically, when centers of curvature radii of the plurality of first flow path inner walls 1212*a* are separated, one end portion of any first flow path inner wall 1212*a* among the plurality of first flow path inner walls 1212*a* may be formed such that a contact with the other end portion of the adjacent first flow path inner wall 1212*a* has a shape that protrudes toward the first nozzle inner wall 1212.

That is, the first nozzle inner wall 1212 may include a plurality of first protrusions 1216 that are in contact with the plurality of first flow path inner walls 1212*a* and protrude toward the first jet flow path 1210*a*.

The plurality of first protrusions 1216 are formed to protrude toward the first jet flow path 1210*a* relative to the adjacent first nozzle inner wall 1212. The plurality of first protrusions 1216 are formed to protrude in the same direction as the traveling direction of washing water and are separately disposed in a circumferential direction along the first nozzle inner wall 1212.

Protruding shapes of the plurality of first protrusions 1216 are not limited thereto, but a shape of a curved surface that is convex and faces the first jet flow path 1210*a* is provided in the embodiment of the present invention. That is, an end portion of the first jet flow path 1210*a* of the first protrusion 1216 may be provided to be round.

The second nozzle inner wall 1222 may include a plurality of second flow path inner walls 1222*a*.

The plurality of second flow path inner walls 1222*a* include arc-shaped cross section perpendicular to the traveling direction of washing water. The plurality of second flow path inner walls 1222*a* may have different curvature radii, but have the same curvature radius in the embodiment of the present invention.

Also, centers of curvature radii of the plurality of second flow path inner walls 1222*a* may be different and separated from each other.

In this embodiment, four second flow path inner walls 1222*a* are provided to be radially symmetric, but the number thereof is not limited thereto.

The plurality of second flow path inner walls 1222*a* are provided such that centers of curvature radii are separated from each other and therefore the plurality of second flow path inner walls 1222*a* may abut each other at a constant angle. Specifically, when centers of curvature radii of the plurality of second flow path inner walls 1222*a* are separated, one end portion of any second flow path inner wall 1222*a* among the plurality of second flow path inner walls 1222*a* may be formed such that a contact with the other end portion of the adjacent second flow path inner wall 1222*a* has a shape that protrudes toward the second nozzle inner wall 1222.

That is, the second nozzle inner wall 1222 may include a plurality of second protrusions 1226 that are in contact with the plurality of second flow path inner walls 1222*a* and protrude toward the second jet flow path 1220*a*.

The plurality of second protrusions 1226 are formed to protrude toward the second jet flow path 1220*a* relative to the adjacent second nozzle inner wall 1222. The plurality of second protrusions 1226 are formed to protrude in the same direction as the traveling direction of washing water and are separately disposed in a circumferential direction along the second nozzle inner wall 1222.

Protruding shapes of the plurality of second protrusions 1226 are not limited thereto, but a shape of a curved surface that is convex and faces the second jet flow path 1220*a* is provided in the embodiment of the present invention. That is, an end portion of the second jet flow path 1220*a* of the second protrusion 1226 may be provided to be round.

While this embodiment has described that the first nozzle inner wall 1212 and the second nozzle inner wall 1222 include the plurality of first flow path inner walls 1212*a* and the plurality of second flow path inner walls 1222*a*, respectively, the present invention is not limited thereto, and an inner wall of a circular cross section may be provided.

A washing water jet hole 1232 through which washing water is discharged to the outside may be included in an end portion of the flow path in which washing water flows. The washing water jet hole 1232 may be provided in an end portion of the jet nozzle 1200, but is provided in a concave portion 1230 that is formed to be concave relative to the adjacent jet nozzle 1200 at the end portion of the jet nozzle 1200 in the embodiment of the present invention. That is, when the washing water jet hole 1232 is not exposed to the outside, but is disposed in a portion that is concave into the jet nozzle 1200, it is possible to protect the washing water jet hole 1232. When the washing water jet hole 1232 is exposed to the outside, a problem of deformation occurs due to an influence from the outside and washing water jet is not constantly jetted. According to the configuration of this embodiment, it is possible to protect the washing water jet hole 1232 and maintain a jet state of washing water.

Hereinafter, a method of manufacturing the jet nozzle 1200 according to this embodiment will be described.

The first nozzle inner wall 1212 and the second nozzle inner wall 1222 forming the first jet flow path 1210*a* and the second jet flow path 1220*a*, respectively, may be formed by a first core 1240 and a second core 1242 which are provided to face.

Specifically, the first core 1240 and the second core 1242 have a flow path in which washing water may flow and a cavity having a shape corresponding to an appearance of the jet nozzle 1200, and are provided to face. Also, a portion corresponding to a jet flow path of the first core 1240 and a portion corresponding to a jet flow path of the second core 1242 may be formed to have different diameters. That is, a diameter at an end portion of a part forming the jet flow path in the first core 1240 and a diameter at an end portion of a part forming the jet flow path in the second core 1242 may be formed to be different.

The first core 1240 and the second core 1242 are combined, a molding material is injected into a cavity, and therefore injection molding of the jet nozzle 1200 may be performed.

A parting surface 1244 may be formed by a portion in which the first core 1240 and the second core 1242 are engaged. The parting surface 1244 may be formed on the jet flow path. In the injection molding, a burr may occur in the parting surface 1244 that is formed by combining the cores. The parting surface 1244 may be disposed on the jet flow path rather than in the washing water jet hole 1232 that is a discharge port of the jet flow path. When the parting surface 1244 is formed in the washing water jet hole 1232 and the burr occurs, washing water may not be jetted in a desired direction and changed when washing water is jetted. Therefore, according to such a configuration, even when the burr occurs during a manufacturing process, the jet direction of washing water may be re-adjusted by the second nozzle inner wall 1222 provided after the parting surface 1244. Accordingly, it is possible to easily control jetting of washing water.

The first core 1240 and the second core 1242 may be formed to be inclined such that a cross-sectional area of the jet flow path decreases toward the parting surface 1244.

The jet flow path of the jet nozzle 1200 formed by the first core 1240 and the second core 1242 may be applied to the jet nozzle 1200 that includes the nozzle inner wall formed of the plurality of flow path inner walls as in the embodiment or the jet nozzle 1200 that includes a nozzle inner wall of a circular cross section.

Hereinafter, a dish washing machine according to a sixth embodiment will be described.

Figure 67:
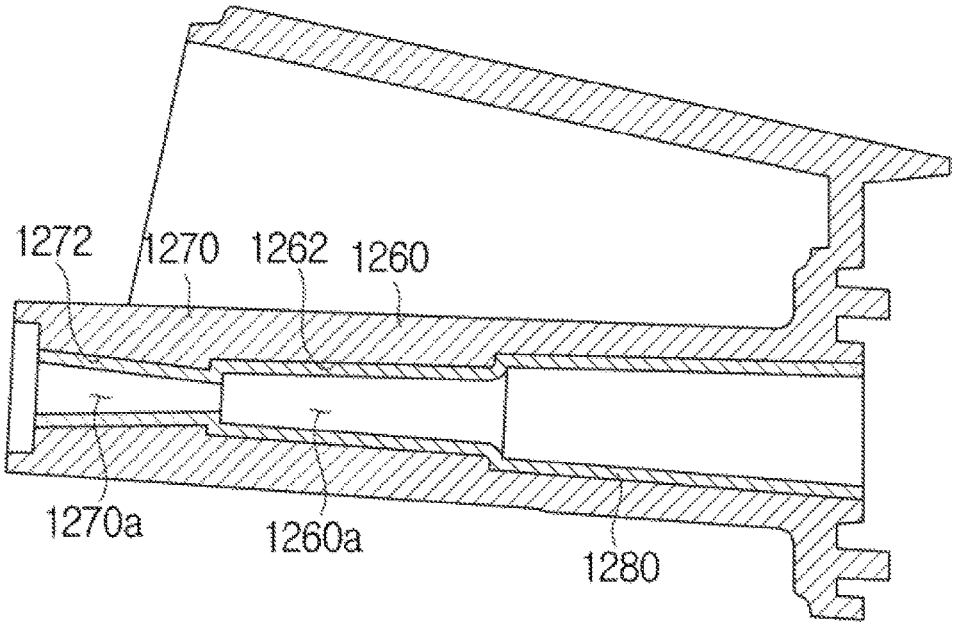
FIG. 67 is a cross sectional view of a jet nozzle according to a sixth embodiment of the present invention.

FIG. 67 is a cross sectional view of a jet nozzle according to a sixth embodiment of the present invention.

Configurations identical to those in the above description will not be described.

A jet nozzle 1250 may include a first jet nozzle 1260 and a second jet nozzle 1270. The nozzle inner wall may include a first nozzle inner wall 1262 and a second nozzle inner wall 1272. The jet nozzle 1250 may include a nozzle tip 1280 that is formed to cover at least a part of the nozzle inner wall.

The nozzle tip 1280 is made of a metal material to minimize damage to the jet nozzle 1250 due to a constant flow of washing water flowing in a first jet flow path 1260*a* or a second jet flow path 1270*a* of the jet nozzle 1250 and prevent a change in a washing water flow due to a burr and the like that may occur during injection of the jet nozzle 1250.

The nozzle tip 1280 may be formed to cover at least a part of the nozzle inner wall or may be formed in an entire nozzle inner wall. A cross section shape of the nozzle tip 1280 may be changed according to a shape of the nozzle inner wall. In the embodiment of the present invention, the first nozzle inner wall 1262 and the second nozzle inner wall 1272 include a plurality of first flow path inner walls 1264 and a plurality of second flow path inner walls 1274, respectively, and are provided to correspond thereto. Without being limited thereto, when a nozzle inner wall having a circular cross section is configured, the nozzle tip 1280 may also have a circular cross section. That is, the shape of the nozzle inner wall is not limited as long as it can be configured to protect the nozzle inner wall.

The nozzle tip 1280 may be formed to cover the nozzle inner wall through an insert injection molding in addition to an injection method in the fifth embodiment. However, the manufacturing method is not limited thereto, but may include a method in which the nozzle tip 1280 is provided to cover at least a part of the nozzle inner wall.

Hereinafter, a dish washing machine according to a seventh embodiment will be described.

Figure 68:
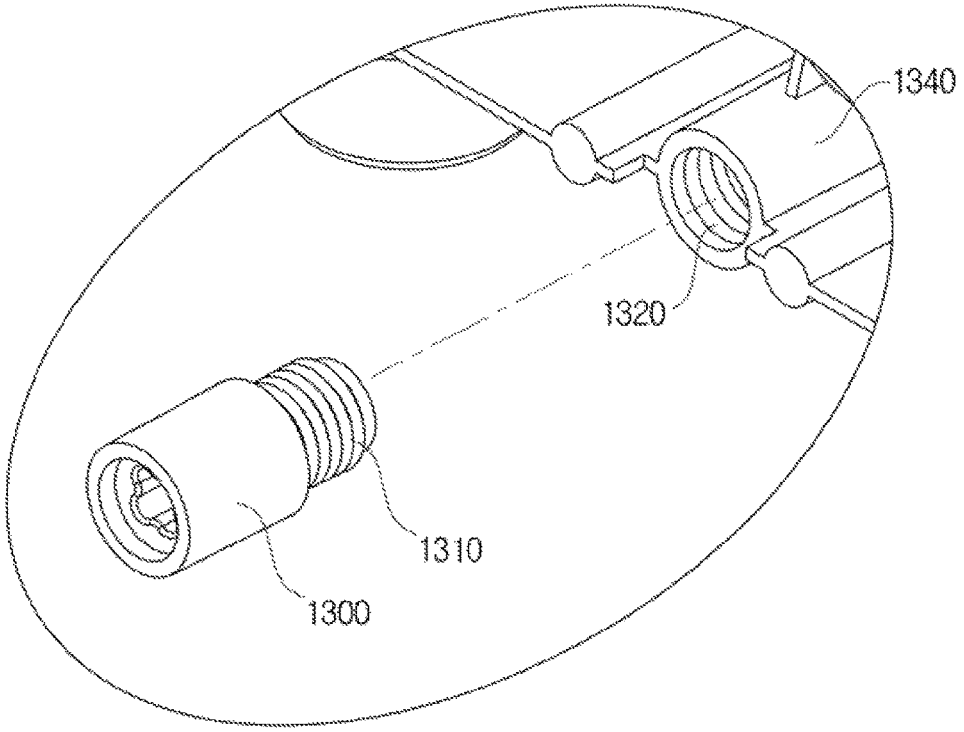
FIG. 68 is a perspective view of a jet nozzle according to a seventh embodiment of the present invention.
Figure 69:
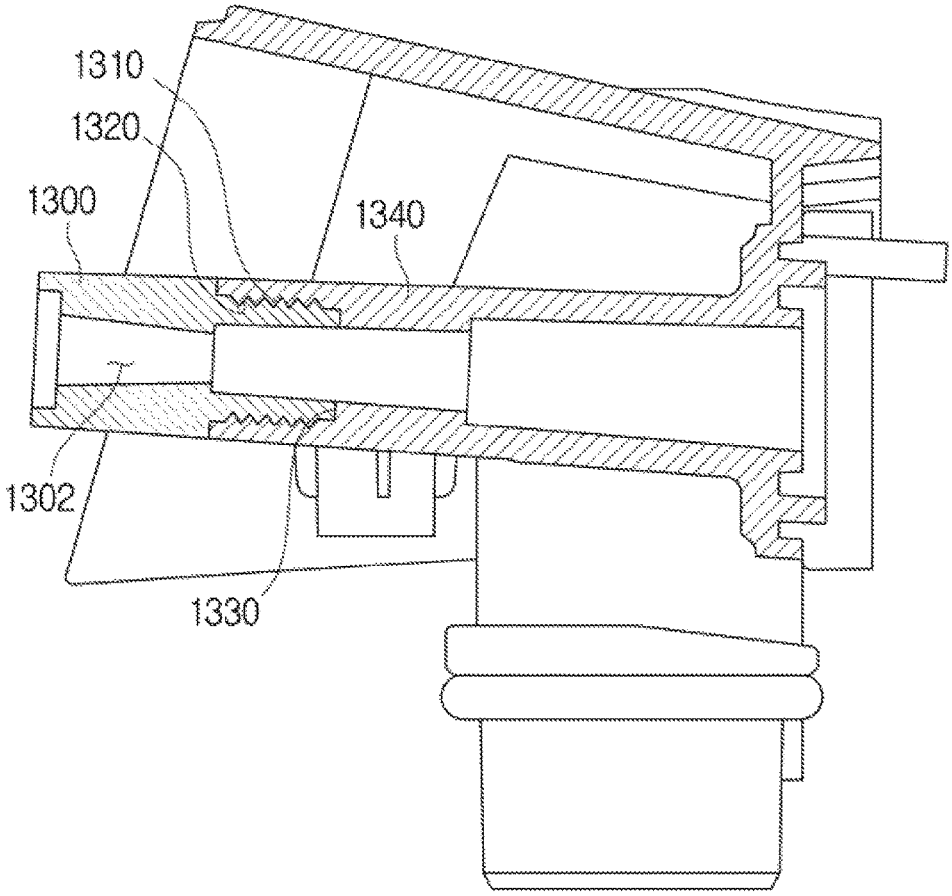
FIG. 69 is a cross sectional view of the jet nozzle according to the seventh embodiment of the present invention.

FIG. 68 is a perspective view of a jet nozzle according to a seventh embodiment of the present invention. FIG. 69 is a cross sectional view of the jet nozzle according to the seventh embodiment of the present invention.

Configurations identical to those in the above description will not be described.

A jet nozzle 1300 may be configured to be detachably combined with a fixed nozzle assembly 1340. A pressure of washing water or an amount of jetted washing water should be differently applied according to a volume of the washing tank, a dish to be accommodated, and the like. When the jet nozzle 1300 is integrally formed in the fixed nozzle assembly 1340, since the fixed nozzle assembly 1340 itself should be changed, it is inefficient. Therefore, it may be provided such that only the jet nozzle 1300 can be replaced.

A screw thread portion 1310 may be formed in an outer circumferential surface of the jet nozzle 1300 to be combined with the fixed nozzle assembly 1340. In the fixed nozzle assembly 1340, a screw groove portion 1320 may be formed to correspond to the screw thread portion 1310. The screw thread portion 1310 and the screw groove portion 1320 are provided to have the same length. When the jet nozzle 1300 is combined with the fixed nozzle assembly 1340, it is possible to prevent excessive insertion or loose insertion.

That is, a stopper portion 1330 configured to prevent the screw thread portion 1310 from being inserted more than a predetermined interval is provided in an end portion of the screw groove portion 1320. It is possible to prevent a jet flow path 1302 from being changed or prevent a direction of the jet nozzle 1300 from twisting due to excessive insertion of the screw thread portion 1310 into the screw groove portion 1320.

Hereinafter, a dish washing machine according to an eighth embodiment will be described.

Figure 70:
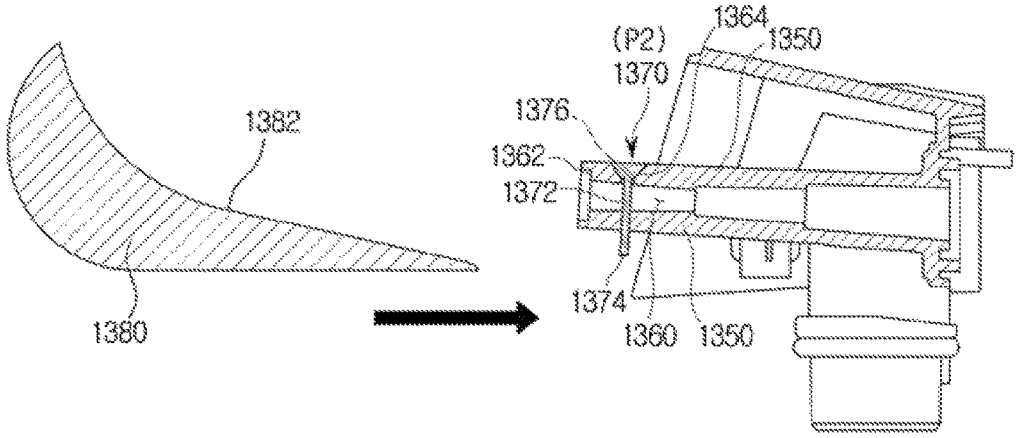
FIGS. 70 and 71 are diagrams illustrating an operation of a jet nozzle according to an eighth embodiment of the present invention.
Figure 71:
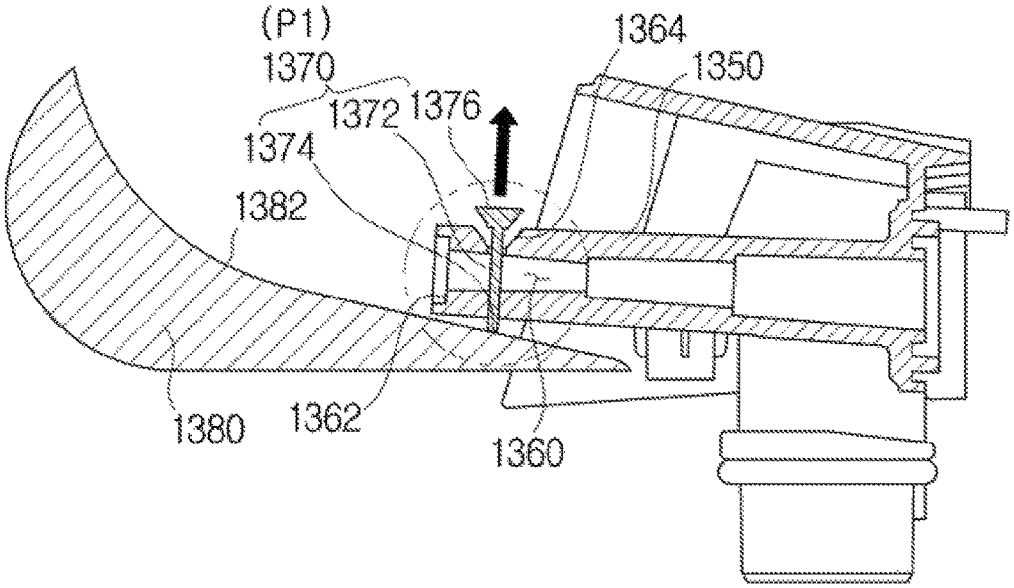
Figure 72:
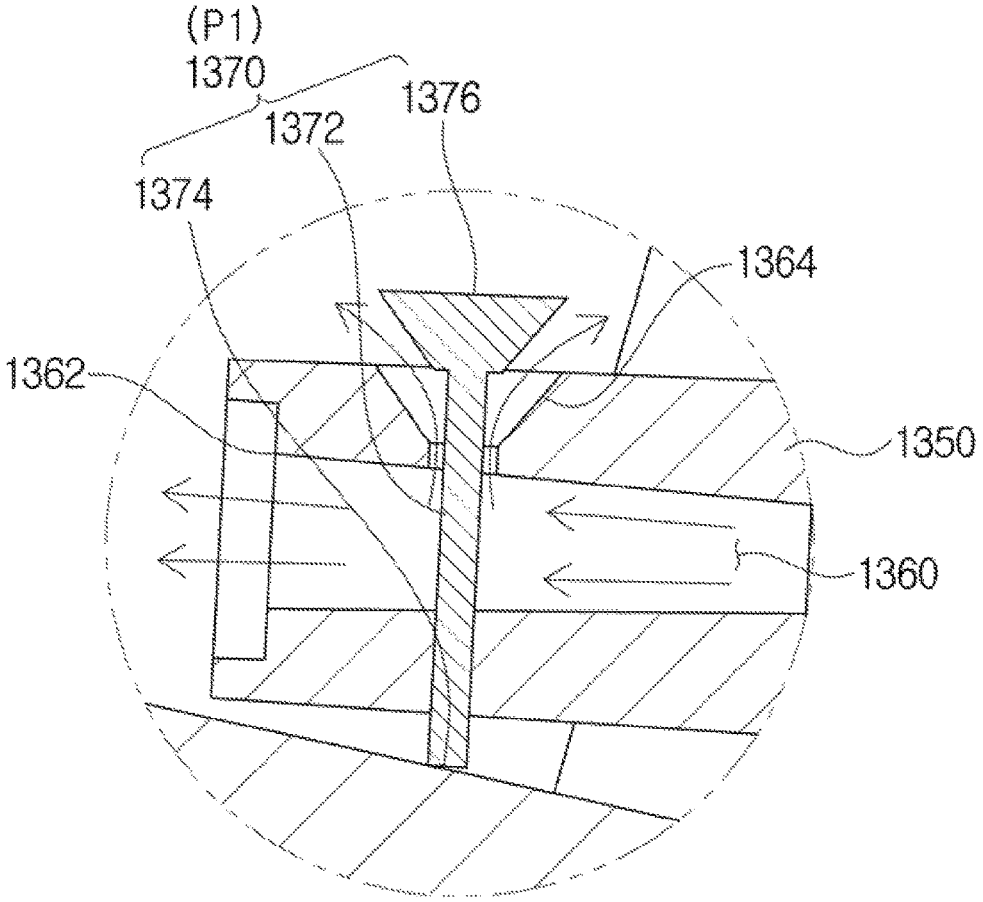
FIG. 72 is an enlarged view of a part of the jet nozzle according to the eighth embodiment of the present invention.

FIGS. 70 and 71 are diagrams illustrating an operation of a jet nozzle according to an eighth embodiment of the present invention. FIG. 72 is an enlarged view of a part of the jet nozzle according to the eighth embodiment of the present invention.

Configurations identical to those in the above description will not be described.

A jet nozzle 1350 may include a sub jet hole 1364.

The sub jet hole 1364 passes through the jet nozzle 1350 and enables an outside of the jet nozzle 1350 to communicate with a jet flow path 1360 inside the jet nozzle 1350.

Disposition of the sub jet hole 1364 is not limited thereto. In this embodiment, the sub jet hole 1364 may be provided to pass through the flow path of the jet nozzle 1350 vertically.

The sub jet hole 1364 may be opened or closed by an opening and closing member 1370.

The opening and closing member 1370 is provided to reciprocate an open position P1 in which the sub jet hole 1364 is opened and a close position P2 in which the sub jet hole 1364 is closed. Specifically, the opening and closing member 1370 may include an opening and closing member body 1372, a pressing protrusion 1374 that is provided below the opening and closing member body 1372 and pressed by a vane 1380 to be described below, and an opening and closing unit that is provided above the opening and closing member body 1372 and selectively opens the sub jet hole 1364.

Hereinafter, operations of the dish washing machine according to this embodiment will be described.

As described in the embodiment, the vane 1380 is provided to be movable in the washing tank. As the vane 1380 moves toward the jet nozzle 1350, it presses the pressing protrusion 1374 of the opening and closing member 1370. Specifically, in the vane 1380, a reflection surface 1382 in which washing water is bent is formed to extend toward the opening and closing member 1370. When the vane 1380 moves toward the jet nozzle 1350, it presses the pressing protrusion 1374 of the opening and closing member 1370 by the extended reflection surface 1382.

The opening and closing member 1370 pressed by the pressing protrusion 1374 moves upward and therefore the opening and closing unit opens the sub jet hole 1364. During this process, washing water flowing in the jet flow path 1360 is discharged through a washing water jet hole 1362 and the sub jet hole 1364, and is jetted above the fixed nozzle assembly. In other words, the opening and closing member 1370 moves from the close position P2 to the open position P1 by movement of the vane 1380, the sub jet hole 1364 is opened, and washing water is jetted through the sub jet hole 1364.

When washing water is bent by only the vane 1380, only an upper part on a movement path of the vane 1380 is influenced. In this case, an upper part of the fixed nozzle assembly that is not on the movement path of the vane 1380 is not washed by washing water.

However, since washing water may be branched above the fixed nozzle assembly by selectively opening the sub jet hole 1364, it is possible to decrease a blind area that is not influenced by washing water. Also, according to such operations, contaminants to be accumulated in the fixed nozzle assembly may be washed, a lifespan of the dish washing machine may increase, and an odor and the like caused by contaminants may be prevented.

Hereinafter, a dish washing machine according to a ninth embodiment will be described.

Figure 73:
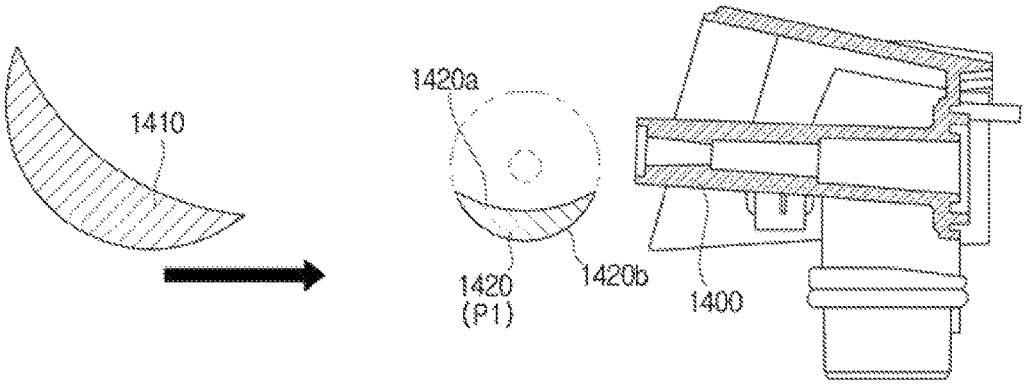
FIGS. 73 and 74 are diagrams illustrating an operation of a jet nozzle according to a ninth embodiment of the present invention.
Figure 74:
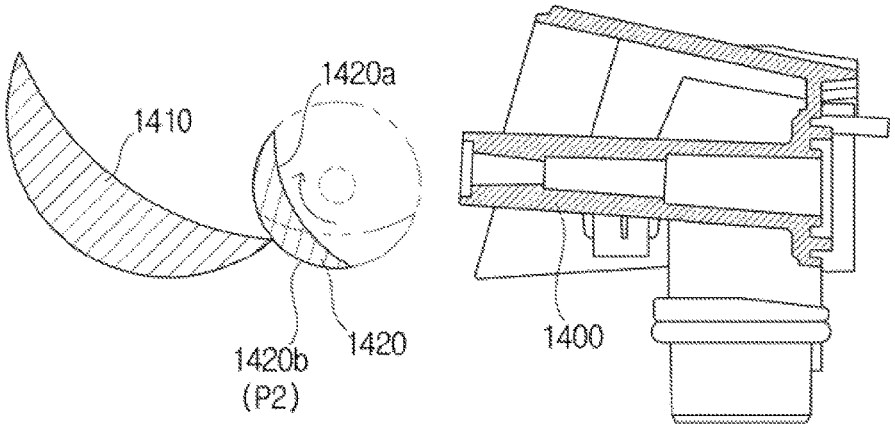

FIGS. 73 and 74 are diagrams illustrating an operation of a jet nozzle according to a ninth embodiment of the present invention.

Configurations identical to those in the above description will not be described.

A vane 1410 bends washing water jetted from the fixed nozzle assembly to the basket and is movably provided. In addition to the vane 1410 provided to be movable, a sub vane 1420 rotatable in a fixed state is included in this embodiment.

The sub vane 1420 is provided to rotate a waiting position P1 that is disposed to be separated from an end portion of a jet nozzle 1400 in the traveling direction of washing water and a reflection position P2 that is disposed in the traveling direction of washing water and reflects a direction of washing water.

Operations of the sub vane 1420 may be performed by movement of the vane 1410. Specifically, when the vane 1410 moves toward the jet nozzle 1400, it presses a rear surface 1420*b* of a reflection surface 1420*a* in which washing water is bent in the sub vane 1420, the sub vane 1420 rotates due to pressing by the vane 1410 and operates from the waiting position P1 to the reflection position P2.

When the sub vane 1420 is in the waiting position P1, washing water jetted from the jet nozzle 1400 is bent toward the basket by the moving vane 1410. When the sub vane 1420 is in the reflection position P2, washing water jetted from the jet nozzle 1400 may be bent by the sub vane 1420 rotated from the waiting position P1, and advance to the upper part of the fixed nozzle assembly.

When washing water is bent by the vane 1410, only the upper part on the movement path of the vane 1410 is influenced. In this case, an upper part of the fixed nozzle assembly that is not on the movement path of the vane 1410 is not washed by washing water.

However, while the sub vane 1420 moves from the waiting position P1 to the reflection position P2, since the traveling direction of washing water may be bent at a right angle or more, it is possible to decrease a blind area that is not influenced by washing water. Also, according to such operations, contaminants to be accumulated in the fixed nozzle assembly or the jet nozzle may be washed, a lifespan of the dish washing machine may increase, and an odor and the like caused by contaminants may be prevented.

In the above embodiments, each embodiment in which some configurations of the dish washing machine are different has been described, but these may be applied together rather than independently, and descriptions of redundant configurations were omitted.

[A Structure of a Nozzle to Prevent Introduction of a Foreign Substance]

According to the fixed nozzle assembly of the present invention and the dish washing machine having the same, since the jet nozzle may be maintained clean, durability of the fixed nozzle assembly may increase.

[Floral-Patterned Nozzle]

According to the jet unit of the present invention and the dish washing machine having the same, since linearity of the jet nozzle may be improved and a size of the jet unit may be reduced accordingly, it is possible to implement a compact dish washing machine.

Also, since a flow rate of washing water may increase, it is possible to increase washing efficiency.

In addition, it is possible to increase durability of the jet nozzle.

The scope of the present invention is not limited to the above-described specific embodiments. Various other embodiments that may be changed or modified by those skilled in the art without departing from the scope and spirit of the present invention defined by the appended claims fall within the scope of the present invention.

What is claimed is:

1. A dish washing machine, comprising:

a main body;

a washing tank provided inside the main body; and a fixed nozzle assembly fixed in one side of the washing tank and configured to jet washing water, a vane configured to reflect the washing water from the fixed nozzle assembly to the dish while linearly moving;

a rail guiding the vane to linearly move; and wherein the vane includes:

a cap portion provided at a center of the vane and coupled to the rail, a first reflection portion extending from the cap portion in a first direction, a second reflection portion extending from the cap portion in a second direction opposite to the first direction, wherein the fixed nozzle assembly includes a first fixed nozzle disposed to correspond to the first reflection portion, and a second fixed nozzle disposed to correspond to the second reflection portion.

2. The dish washing machine according to claim 1, wherein the rail extending in a direction orthogonal to the first direction at a center portion of a bottom plate of the washing tank, and washing tank includes a first region positioned in the first direction from the rail and a second region positioned in the second direction from the rail.

3. The dish washing machine according to claim 2, wherein the first reflecting portion and the first fixed nozzle are disposed on the first region, and the second reflecting portion and the second first fixed nozzle are disposed on the second region.

4. The dish washing machine according to claim 3, further comprising a control unit for controlling the injection of the fixed nozzle assembly, and wherein the control unit is configured to control the injection of the fixed nozzle assembly so that the washing water is jetted from at least one of the first fixed nozzle and the second fixed nozzle.

5. The dish washing machine according to claim 4, wherein the control unit is configured to control the injection of the fixed nozzle assembly so that the fixed nozzle assembly is selectively clean the tableware on the first region and the tableware on the second region.

6. The dish washing machine according to claim 4, wherein the control unit is configured to control the injection of the fixed nozzle assembly so that the fixed nozzle assembly is clean both the tableware on the first region and the tableware on the second region.

7. The dish washing machine according to claim 1, further comprising a distribution device for distributing the washing water, and wherein the distribution device is provided to independently distribute washing water to the first fixed nozzle and the second fixed nozzle.

8. The dish washing machine according to claim 7, wherein the distribution device includes a first hose connected to the first fixed nozzle and a second hose connected to the second fixed nozzle.

9. The dish washing machine according to claim 8, further comprising a control unit for controlling the distribution device, and wherein the control unit is configured to control the distribution device so that the distribution device supply the washing water to at least one of the first hose and the second hose.

* * * * *